US006191417B1

(12) United States Patent
Douglas et al.

(10) Patent No.: US 6,191,417 B1
(45) Date of Patent: Feb. 20, 2001

(54) MASS SPECTROMETER INCLUDING MULTIPLE MASS ANALYSIS STAGES AND METHOD OF OPERATION, TO GIVE IMPROVED RESOLUTION

(75) Inventors: Donald J. Douglas; Zhaohui Du, both of Vancouver; Bruce A. Collings, Burnaby, all of (CA)

(73) Assignee: University of British Columbia, Vancouver (CA)

( * ) Notice: Under 35 U.S.C. 154(b), the term of this patent shall be extended for 0 days.

(21) Appl. No.: 09/188,352

(22) Filed: Nov. 10, 1998

(51) Int. Cl.[7] ..... H01J 49/42

(52) U.S. Cl. ..... 250/282; 250/281; 250/292; 250/423 R; 250/424

(58) Field of Search ..... 250/282, 281, 250/292, 423 R, 424

(56) References Cited

U.S. PATENT DOCUMENTS

| | | | | |
|---|---|---|---|---|
| 4,234,791 | | 11/1980 | Enke et al. | 250/281 |
| 4,329,582 | | 5/1982 | French et al. | 250/292 |
| 4,988,869 | | 1/1991 | Aberth | 250/281 |
| 6,114,691 | * | 9/2000 | Cousins | 250/282 |

FOREIGN PATENT DOCUMENTS

| | | | |
|---|---|---|---|
| 10-214591 | 8/1998 | (JP) | H01J/49/42 |

OTHER PUBLICATIONS

D. J. Douglas: Applications of Collision Dynamics in Quadrupole Mass Spectrometry–Techniques and Applications of Tandem Mass Spectrometry, Journal of the American Society for Mass Spectrometry, U.S., Elsevier Science Inc., vol. 9, No. 2, Feb. 1, 1998, pp. 101–113, XP004114918.

Du, Zhaohui et al, "Inductively Coupled Plasma Mass Spectrometry...Third Stability Region", J. Am. Soc. Mass Spectrom, 8, 1230, 1997.

Konenkov, N.V., "Coupling the Analyzers of Tandem Quadrupole Mass Filters", Journal of Technical Physics, vol. 60, N 10, 153–157, 1990.

Konenkov, N.V., "Coupling Mass Filters of the Tandem Quadrupole Mass Spectrometer", Journal of Technical Physics, vol. 61, N 12, 120–125, 1990.

Konenkov, N.V. and Kratenko, V.I., "Characteristics of a quadrupole mass filter in the separation mode of a few stability regions", International Journal of Mass Spectrometry and Ion Processes, 108, 115, 1991.

White, F.A. et al, "A Two Stage Magnetic Analyzer for Isotopic Ratio...", Second Annual Meeting of ASTM Committee E–14 on Mass Spectrometry, New Orleans, 1954.

Wilson, H.W. et al, "Two Stage Mass Spectrometer for Nuclear Physics Application", Nuclear Instruments and Methods, 13, 269, 1961.

* cited by examiner

*Primary Examiner*—Teresa M. Arroyo
*Assistant Examiner*—Nikita Wells
(74) *Attorney, Agent, or Firm*—Bereskin & Parr

(57) ABSTRACT

A method is provided of operating a mass spectrometer apparatus comprising a pair of quadrupole rod sets. Each quadrupole rod set is operated in a mass resolving mode. They may be operated in the same or different stability regions. The rod sets are operated to select essentially ions of the same mass to charge ratio, and are operated such that the combined resolution of the two rod sets is greater than the resolution of either rod set. The rod sets can be operated at relatively low resolution, with the combined peak shape from the two rod sets showing high resolution. This can make up for mechanical imperfections in the rod sets, losses due to high gas pressures, etc. A mass shift can be provided to give the desired resolution. The rod sets can be close coupled, and for this purpose neutralizing capacitors can be provided to prevent electrical interference between adjacent rod sets. The rod sets can be provided with the same frequency signal, which preferably is a phase locked and shifted, to give enhanced sensitivity.

20 Claims, 47 Drawing Sheets

$$\Phi = \frac{(x^2 - y^2)}{r_0^2}\phi_0$$

MASS SPECTROMETER INCLUDING MULTIPLE MASS ANALYSIS STAGES AND METHOD OF OPERATION, TO GIVE IMPROVED RESOLUTION

FIELD OF THE INVENTION

This invention relates to a mass spectrometer including multiple mass analysis stages and a method of operation to give improved resolution, and more particularly is concerned with tandem quadrupole spectrometer systems.

BACKGROUND OF THE INVENTION

A wide variety of mass spectrometer systems have been proposed. For quadrupole mass spectrometers, there are many designs which include two, three or more quadrupole rod sets. Conventionally, each of these has its own function and often the various quadrupoles will be operated at different pressures. Where an individual quadrupole rod set is operated as a mass analyzer, this is usually independent of the function of adjacent rod sets.

Tandem quadrupole systems have been widely used for so called triple quadrupole MS/MS experiments (See for example U.S. Pat. No. 4,234,791, Nov. 18, 1980 "Tandem Quadrupole Mass Spectrometer for Selected ion Fragmentation Studies and Low Energy Collision Induced Dissociation Therefor" by C. G. Enke, R. A. Yost and J. D. Morrison). In these systems a first quadrupole mass analyzer selects an ion of one particular mass to charge ratio (m/e) from a mixture produced in an ion source. These selected ions then collide with a gas in a second quadrupole operated in RF only mode. The collisions transfer translational energy to internal energy of the ions and cause them to fragment. A mass spectrum of the fragment ions is then obtained with a third quadrupole.

U.S. Pat. No. 4,329,582, May 11, 1982 "Tandem Mass Spectrometer with Synchronized Fields" by J. B. French, shows the use of phase locked RF fields to improve the transmission of a triple quadrupole MS/MS system. The RF voltage applied to all three sections or quadrupoles is synchronized or phase locked with a phase shift preferably of zero between the sections. The rods are spaced apart longitudinally by a very short distance not exceeding $r_0$, the radius of the inscribed circle within the quadrupole rods.

N. V. Konenkov in an article "Coupling the Analyzers of Tandem Quadrupole Mass Filters" published in the Journal of Technical Physics (Russia) 60, 153–157, 1990 (in Russian), and N. V. Konenkov and V. I. Kratenko in the article "Characteristics of a Quadrupole Mass Filter in the Separation Mode of a Few Stability Regions" published in the International Journal of Mass Spectrometry and Ion Physics 108, 115–136, 1991, show operation of a tandem mass filter with the first rod set operated in the stability zone with Mathieu parameters (a,q)=(3,3) and the second rod set operated in the stability zone with Mathieu parameters (a,q)=(0,7.55). Operation in the region near (a,q)=(0,7.55) can be advantageous to mass analyze ions of high kinetic energy or to produce higher resolution than operation in the conventional mode in the first stability region near (a,q)=(0.2,0.7). However, when ions of a particular mass to charge ratio, m/e are transmitted in the (a,q)=(0,7.55) region, ions of 8.4 m/e and higher are simultaneously transmitted because these have stable motion in the first stability region near (a,q)=(0.2,0.7). Thus an additional mass analyzer is required to prevent these higher m/e ions from reaching the second quadrupole. As described, a single RF power supply is used to provide the RF voltage for the two quadrupoles.

The quadrupoles are thus phase locked with zero phase shift (FIG. 20 of that paper). Operation of the quadrupoles is otherwise conventional. In particular, operation in the same stability region, operation with a mass shift between the quadrupoles, operation in other stability regions or combinations of other stability regions, or operation with a phase shift other than zero are not described.

N. V. Konenkov in the paper "Coupling Mass Filters of the Tandem Quadrupole Mass Spectrometer" published in the Journal of Technical Physics (Russia) 61, N12, 120–125 (in Russian) describes operation of a triple quadrupole MS/MS system with the mass analyzing quadrupoles operated in the first or third stability regions and the collision cell, an RF only quadrupole, operated in the first region. As in the U.S. Pat. No. 4,329,582, the quadrupoles are phase locked and the optimum phase shift is claimed to be zero. There is a collision cell between the two mass analyzing quadrupoles, and no mass shift or phase shift other than zero between the quadrupoles is described. There is no suggestion that two quadrupoles essentially be operated to effect a single mass analysis.

In the article "Inductively Coupled Plasma Mass Spectrometry with a Quadrupole Operated in the Third Stability region" by Zhaohui Du, Terry Olney, and D. J. Douglas published in The Journal of the American Society for Mass Spectrometry, 8, 1230–1236, December, 1997 it was shown that with operation of the quadrupole in the third stability region the peaks of a mass spectrum can have unusually sharp sides on both the high and low mass sides. This is advantageous because it means a minor peak can be detected without interference beside a major peak of much greater intensity.

What is common in all these earlier proposals is that each quadrupole rod set is essentially operated independently of the others, that is, to perform a function that is independent of functions being carried out in adjacent rod sets. There is no teaching that functions of adjacent rod sets can be combined in any way, to give a single combined function, such as mass selection, which is enhanced as compared to the function available from a single rod set. While there are proposals to connect rod sets electrically, only U.S. Pat. No. 4,329,582 discusses fixing the phase shifts between the rods; even so, this patent teaches a preferred phase shift at zero and it has not been realized that a set non-zero phase shift can give enhanced-sensitivity, at least in some applications.

In the past magnetic analyzers have also been operated in tandem. For example in the article "A Two Stage Magnetic Analyzer for Isotopic Ratio Determination of $10^4$ or greater" by F. A. White and T. L. Collins published in Applied Spectroscopy, 8, 169, 1954 it is shown that two magnetic analyzers can be operated in tandem to produce less peak tailing than either analyzer operated alone. R. Schnitzer and M. Anbar in the Proceedings of the 24th Conference on Mass Spectrometry and Allied Topics, p 361, 1976 describe operation of a Wien filter followed by a magnetic analyzer. These and other applications of tandem magnetic analyzers are described in the book "Mass Spectroscopy" by H. E. Duckworth, R. C. Barber and V. S. Venkatasubramanian published by Cambridge University Press, London 1986 on pages 86–90. However in none of these articles is operation with a mass shift between the analyzers described.

SUMMARY OF THE INVENTION

In contrast to these earlier proposals, the invention that we disclose here has only two quadrupoles, each is operated in mass analyzing mode, there is no collision cell between the quadrupoles, fragment ions are not generated between the quadrupoles, and the optimum phase shift between the RF applied to the rods is generally not zero.

In accordance with a first aspect of the present invention, there is provided a method of operating a quadrupole spectrometer apparatus including a first quadrupole rod set and a second quadrupole rod set, the method comprising:

(1) applying RF and DC voltages to the first and second quadrupole rod sets, to scan the first and second quadrupole rod sets in selected stability regions, and operating both the first and second quadrupole in a resolving mode for ions with the same mass to charge ratio;

(2) generating a stream of ions and passing the stream of ions through the first quadrupole rod set and subsequently the second quadrupole rod set, and detecting ions exiting the second quadrupole rod set;

(3) obtaining a peak shape from the ions exiting the second quadrupole rod set, the peak shape having at least one of higher resolution than the resolution of either one of the first and second quadrupole rod sets and less peak tailing than either one of the first and second rod sets.

Preferably, the method includes mounting the first and second quadrupoles close to one another along a common axis. Preferably, the method comprises providing quadrupoles having the same inscribed circle diameter with a radius of $r_0$, wherein the method comprises mounting the quadrupoles less than or equal to $r_0$ apart, more preferably 0.3 $r_0$ apart or less, with no intervening lens.

The voltages applied to the first and second quadrupole rod sets can be adjusted to provide a mass shift between the first and second quadrupoles, to improve the resolution of the tandem quadrupole mass analyzer.

A further aspect of the present invention includes operating the first and second quadrupole rod sets at the same frequency and locking the phase of the first and second quadrupoles relative to one another.

It has been discovered that the transmission can be improved by providing a fixed phase shift between the first and second quadrupoles, for example a phase shift of in the range 10–20°, with the radio frequency signal provided to the second quadrupole rod set lagging behind the signal supplied to the first quadrupole rod set.

The quadrupoles can be operated in a variety of stability regions and can be operated in the same or different stability regions. Thus, the first and second quadrupole rod sets can be operated in the third stability region, with one of the quadrupole rod sets operating at the upper tip of the third stability region and the other of the quadrupole rod sets operating at the lower tip of the third stability region, or both of the first and second quadrupole rod sets can be operated in the first stability region, or both the first and second quadrupoles can be operated in the second stability region.

Another aspect of the present invention provides a method of operating a mass spectrometer comprising a plurality of separate quadrupole rod sets, the method comprising:

(1) providing desired RF and DC voltages to each quadrupole rod set and providing the same frequency of RF voltage to each quadrupole rod set;

(2) phase locking each quadrupole rod set with each adjacent quadrupole rod set; and (3) for each quadrupole rod set downstream from a first quadrupole rod set, providing a phase shift relative to an immediate upstream quadrupole rod set.

A third aspect of the present invention provides a mass spectrometry apparatus comprising:

two aligned quadrupole rod sets;

voltage generation means for generating a radio frequency signal for each rod set and connected to the two quadrupole rod sets;

an oscillator; and a phase shifter connected to the oscillator and having outputs connected to the voltage generation means for the quadrupole rod sets, the oscillator generating a signal determining the frequency of the radio frequency signals supplied to each rod set, and the phase shifter being adjustable to enable the relative phase between the radio frequency signals applied to the two rod sets to be adjusted.

Another aspect of the present invention provides a method of operating a spectrometer apparatus including a first Wien filter stage and a second Wien filter stage, the method comprising:

(1) applying electric fields and magnetic fields in the first and second stages, to scan the first and second Wien filter stages, whereby both the first and second spectrometer stages operate in a resolving mode for ions with the same mass to charge ratio;

(2) generating a stream of ions and passing the stream of ions through the first Wien filter stage and subsequently the second Wien filter stage, and detecting ions exiting the second Wien filter stage;

(3) obtaining a peak shape from the ions exiting the second Wien filter stage, the peak shape having at least one of higher resolution than the resolution of either one of the first and second Wien filter stages sets and less peak tailing than either one of the first and second Wien filter stages.

Further a mass shift between the Wien filter stages can be provided.

A further aspect of the present invention provides a method of operating a spectrometer apparatus including a first spectrometer stage and a second spectrometer stage, the method comprising:

(1) applying at least one of electric fields and magnetic fields in the first and second spectrometer stages, to scan the first and second spectrometer stages;

(2) generating a stream of ions and passing the stream of ions through the first spectrometer stage and subsequently through the second spectrometer stage, and detecting ions exiting the second spectrometer stage;

(3) obtaining a peak shape from the ions exiting the second spectrometer stage, wherein the first and second spectrometer stages are operated in a resolving mode for a selected mass, wherein a mass shift is provided between the selected masses of the first and second spectrometer stages and an overlap is provided between the peak shapes of the first and second spectrometer stages, whereby the peak shape obtained at the exit of the second spectrometer stage has at least one of higher resolution than the resolution of either one of the first and second spectrometer stage sets and less peak tailing than either one of the first and second spectrometer stages.

In this aspect of the present invention, each of the first and second mass spectrometer stages can be provided as one of a magnetic mass analyzer, a Wien filter and a quadrupole mass spectrometer. More preferably, the method provides a magnetic mass analyzer as one of the mass spectrometer stages and a Wien filter as the other mass spectrometer stage.

It is contemplated that these last two aspects of the invention can be provided as corresponding apparatus. While it is preferred to apply the invention to quadrupole mass spectrometers, the invention is in general applicable to any mass spectrometry device that produces peaks, of varying resolution, by scanning across mass. The basic concept is to offset and combine two peaks so as to produce a combined peak with a higher resolution than each individual peak alone.

BRIEF DESCRIPTION OF THE DRAWINGS

For a better understanding of the present invention and to show more clearly how it may be carried into effect, reference has been made, by way of example, to the accompanying drawings in which.

DESCRIPTION OF THE PREFERRED EMBODIMENTS

Figure 1A:
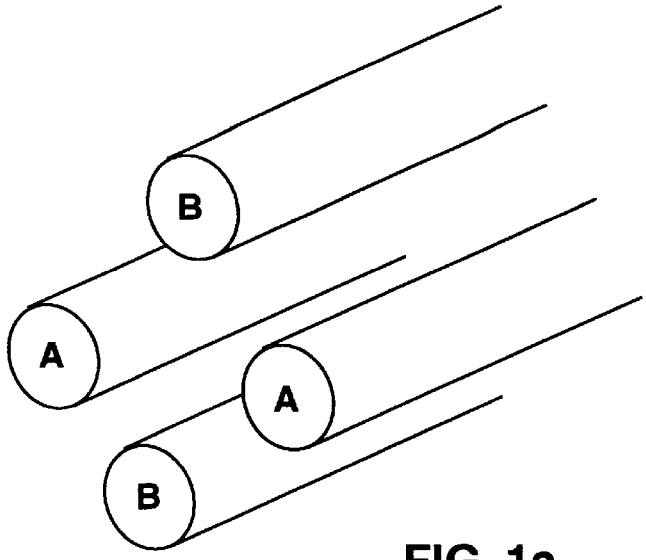
FIG. 1*a* is a schematic perspective view of a set of quadrupole rods.
Figure 1B:
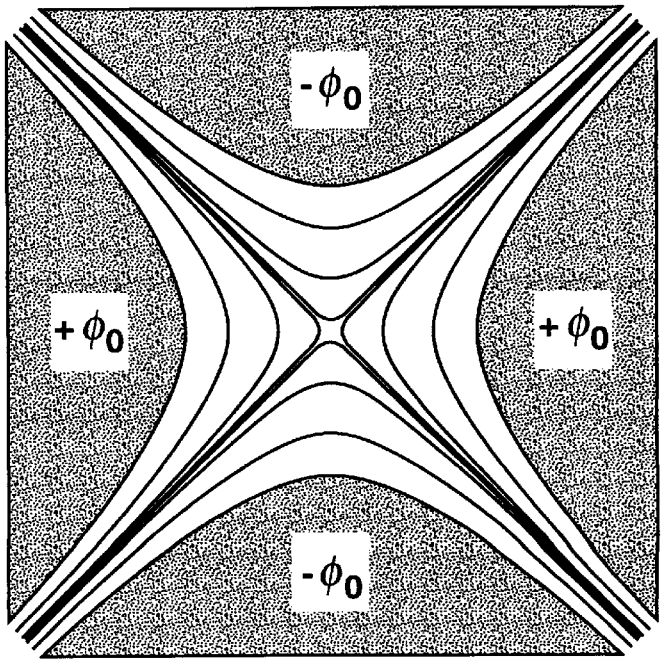
FIG. 1*b* is a schematic cross-section showing the potential distribution between rods having an idealized hyperbolic shape.

Firstly, a brief review is given of quadrupole operation. A quadrupole device comprises a set of four parallel rods as shown in FIG. 1*a*. Ideally, the rods have a hyperbolic shape but round rods are often used as well and for most purposes are an adequate approximation to hyperbolic rods. Opposite pairs of rods are connected together and a potential is applied between these pairs. The potential between the rods has the form $$\Phi(x, y) = \left(\frac{x^2 - y^2}{r_0^2}\right)\Phi_0 \tag{1}$$

where $r_0$ is the distance from the center of the quadrupole set to one of the rods. This is shown in FIG. 1*b*. The potential applied to the rods has both DC (U) and RF (V) components and is given by $$\Phi_0 = U - V\cos\omega t \tag{2}$$

For the discussion here, the poles in the x direction that have the positive DC voltage applied will be called the "A" poles and the poles in the y direction that have the negative DC voltage applied will be called the "B" poles.

Figure 2:
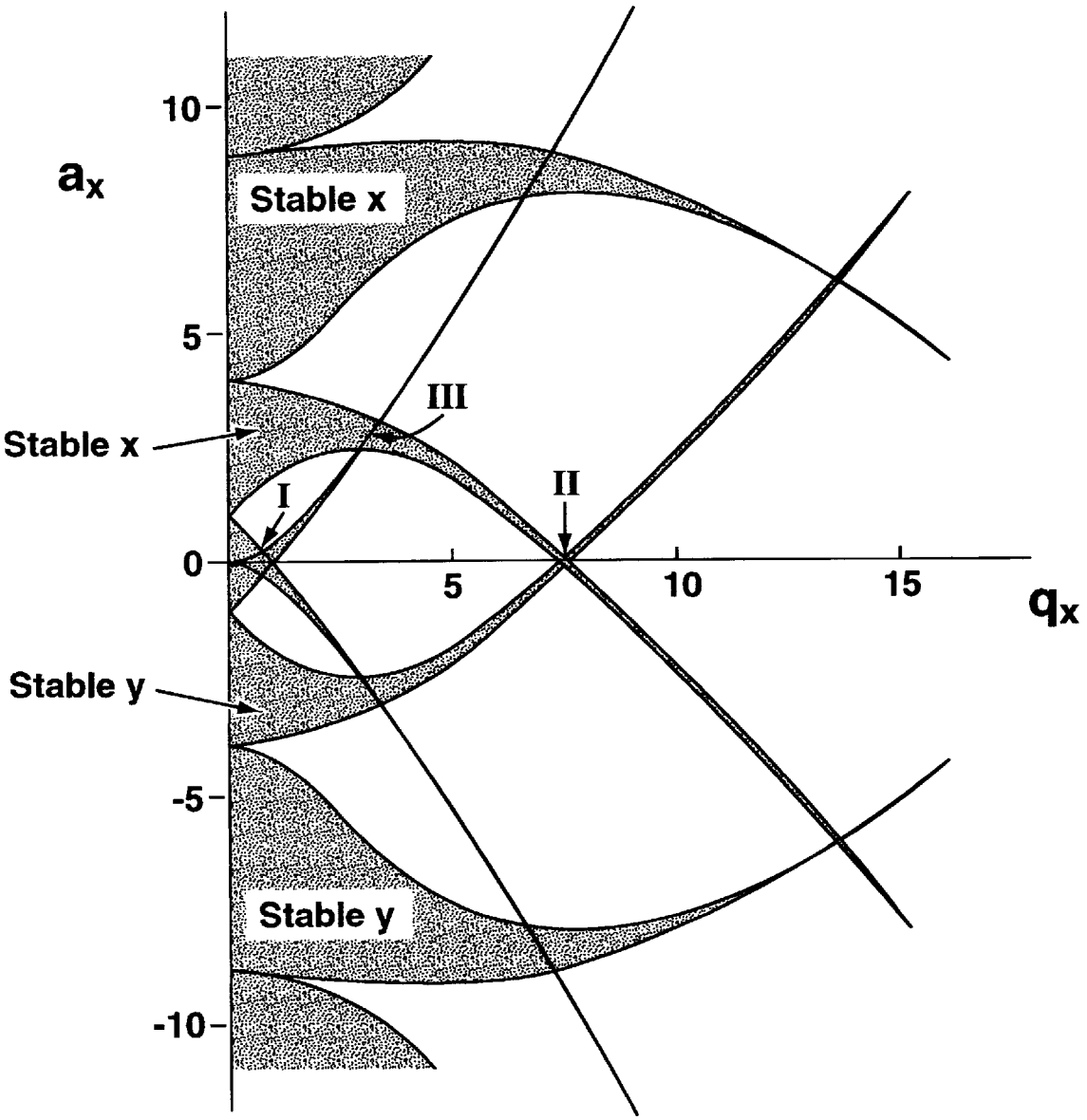
FIG. 2 is a conventional stability diagram showing different stability regions for a quadrupole mass spectrometer.

Ions to be mass analyzed are injected along the axis of the quadrupole and in general have complex trajectories. The trajectories are classified as "stable" or "unstable". For a trajectory to be "stable" the amplitude of the ion motion in the x or y directions must remain less than $r_0$. For some modes of operation, the voltages can be such that substantially all ions of interest are stable; the device then operates solely to transmit ions with almost no mass analysis effects. An "unstable" trajectory means the amplitude of ion motion increases until an ion strikes an electrode and the ion is not transmitted. The ion motion is usually described by the Mathieu parameters $$a = \frac{8eU}{m\omega^2 r_0^2} \text{ and } q = \frac{4eV}{m\omega^2 r_0^2} \tag{3}$$

where e is the charge on an ion, m is the ion mass, $\omega = 2\pi f$ with f the RF frequency, U is the DC voltage from a pole to ground and V is the zero to peak RF voltage from each pole to ground. Combinations of a and q which give stable ion motion in both the x and y directions are usually shown on a stability diagram like that of FIG. 2. The notation of FIG. 2 for the regions of stability is taken from Quadrupole Mass Spectrometry and its Applications, P. H. Dawson ed., Elsevier Amsterdam, 1976. The "first" stability region refers to the region near (a,q)=(0.2, 0.7), the "second" stability region refers to the region near (a,q)=(0.02, 7.55) and the "third" stability region refers to the region near (a,q)=(3,3). It is important to note that there are many regions of stability (in fact an unlimited number). While the detailed description below focuses on operation in the first, second and third stability regions, it is to be appreciated that, in accordance with the present invention, in theory, one could operate in any two stability regions. Selection of the desired stability regions, and selected tips or operating points in each region, will depend on the intended application.

Figure 3A:
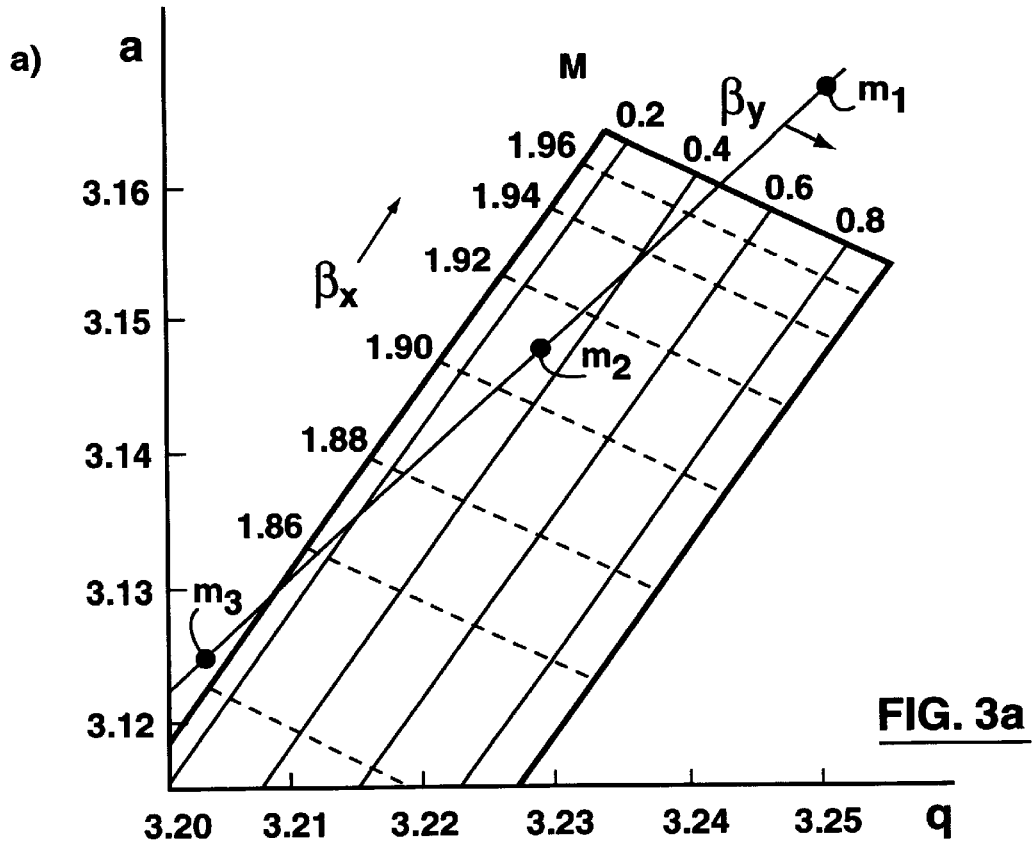
FIGS. 3*a* and 3*b* are enlarged portions of a third stability region indicated at III in FIG. 2.
Figure 3B:
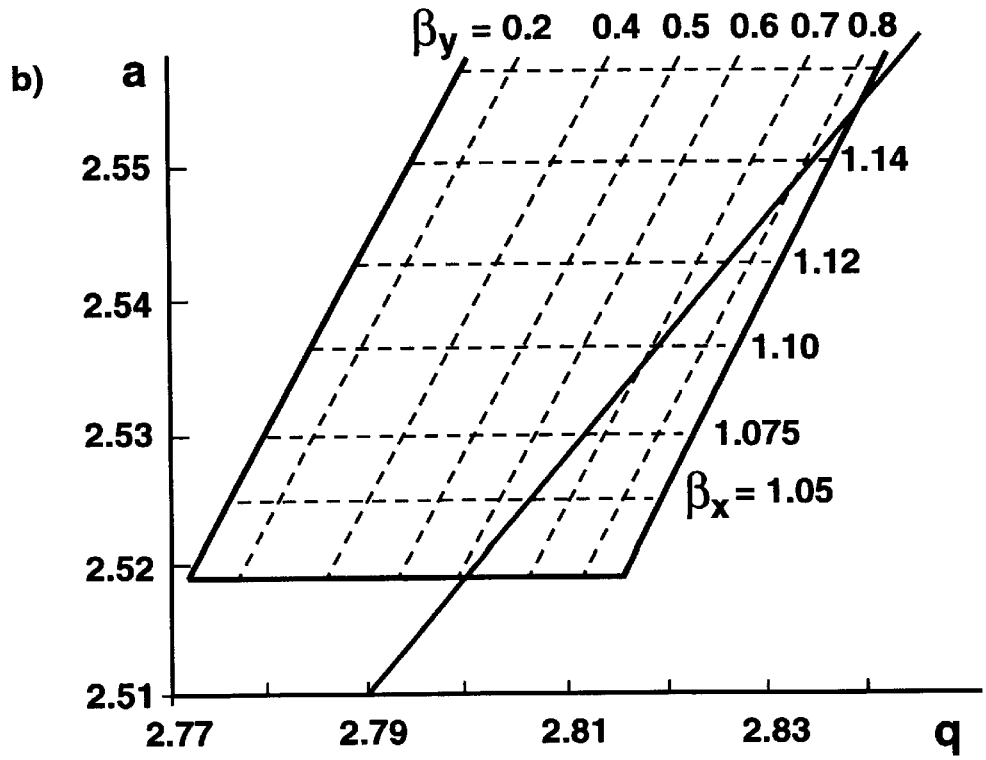

Mass analysis is usually obtained by selecting the magnitude of the DC and RF voltages applied to the quadrupole so that an ion of interest is near the tip of a stability region. For example, FIG. 3 shows that when an ion of mass $m_2$ is at the upper tip of the third stability region lighter ions of mass $m_1$ and heavier ions of mass $m_3$ are outside the stability region and are not transmitted (here, reference to "mass" is shorthand for the mass to charge ratio m/e). Thus the ion of mass $m_2$ is separated from the ions of mass $m_1$ and $m_3$. The line connecting $m_1$, $m_2$ and $m_3$ is an operating line for a fixed ratio of a:q, indicative of the ratio of the selected operating voltages, and any ion will be on this line as determined by its mass to charge (m/e) ratio. For the third stability region mass analysis can be obtained with operation at the upper tip or lower tip and FIG. 3*b* shows an operating line for operation at the lower tip (see for example "Inductively Coupled Plasma Mass Spectrometry with a Quadrupole Operated in the Third Stability region" by Zhaohui Du, Terry Olney, and D. J. Douglas published in The Journal of the American Society for Mass Spectrometry, 8, 1230–1236, December, 1997).

The resolution of a quadrupole mass filter is normally changed by changing the ratio of DC voltage (U) to RF voltage (V). If for example a higher ratio of U/V is used, the ratio a/q increases, i.e. the slope of the operating line increases. In FIG. 3*a* this would place $m_2$ closer to the tip of the stability diagram and the range of masses around $m_2$ that is transmitted will decrease. Thus the mass resolution is increased.

Various definitions of resolution can be used. Here we use the definition of resolution at half height $R_{1/2}$ given by $$R_{1/2} = \frac{m}{\Delta m_{1/2}} \tag{4}$$

where m is the mass to charge (m/e) ratio of a peak in the mass spectrum and $\Delta m_{1/2}$ is the peak width measured at a mass to charge ratio where the intensity is half the maximum height. While high resolution is desirable in a mass spectrometer it is important to recognize that there are other figures of merit for a peak in a mass spectrum such as the extent to which it tails to adjacent peaks.

In the article "Inductively Coupled Plasma Mass Spectrometry with a Quadrupole Operated in the Third Stability region" by Zhaohui Du et al., cited above, it was shown that with operation of the quadrupole in the third stability region the peaks of a mass spectrum can have unusually sharp sides on both the high and low mass sides. However this is only possible with low energy ions (2–5 eV in the cited work). At higher ion energies the peaks form tails and this behaviour is detailed below in relation to FIGS. 4 and 5.

Figure 4A:
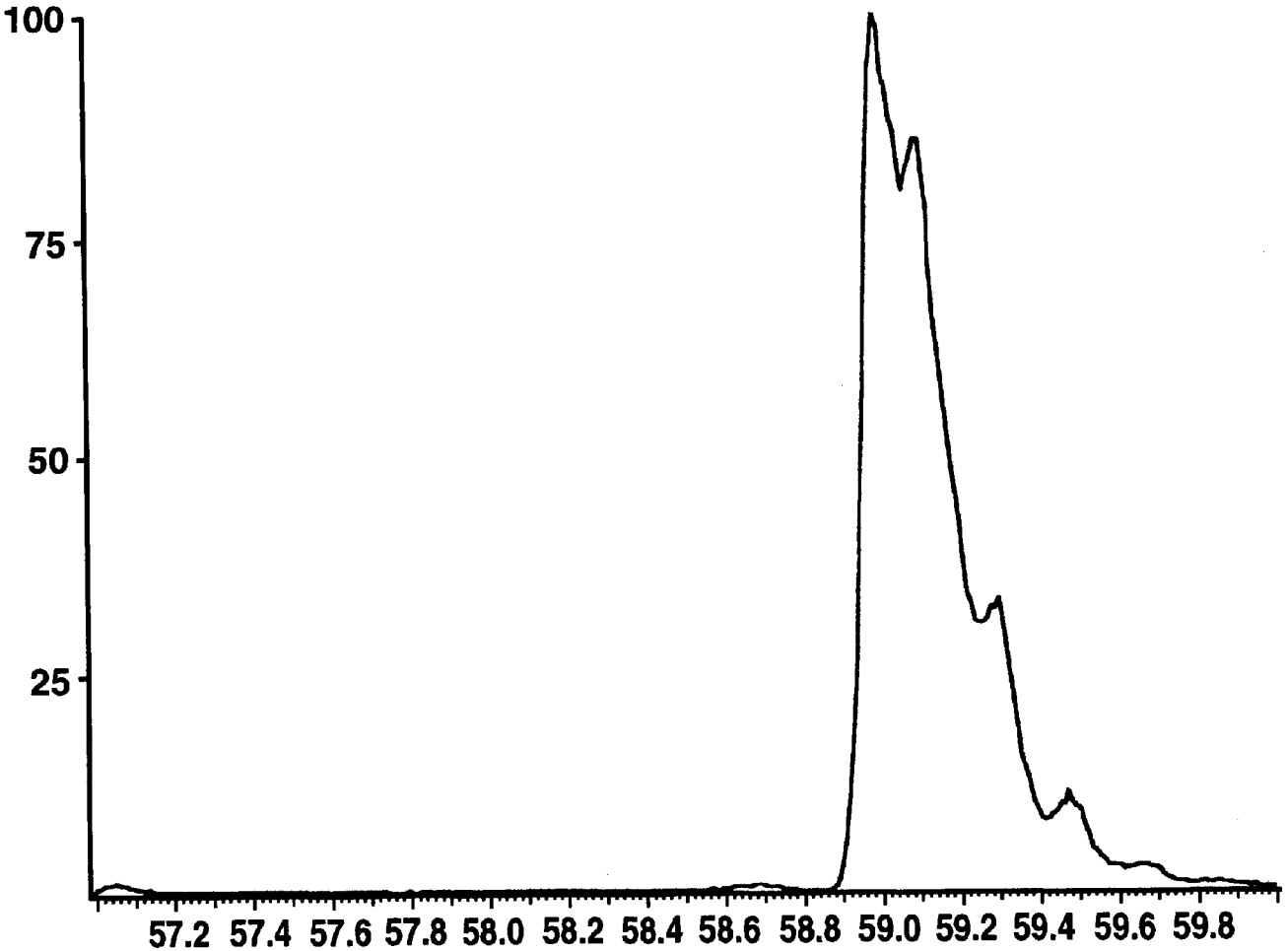
FIGS. 4*a* and 4*b* show the peak shape obtained with operation at the upper tip of the third region, with linear and logarithmic scales for the vertical axis respectively.
Figure 4B:
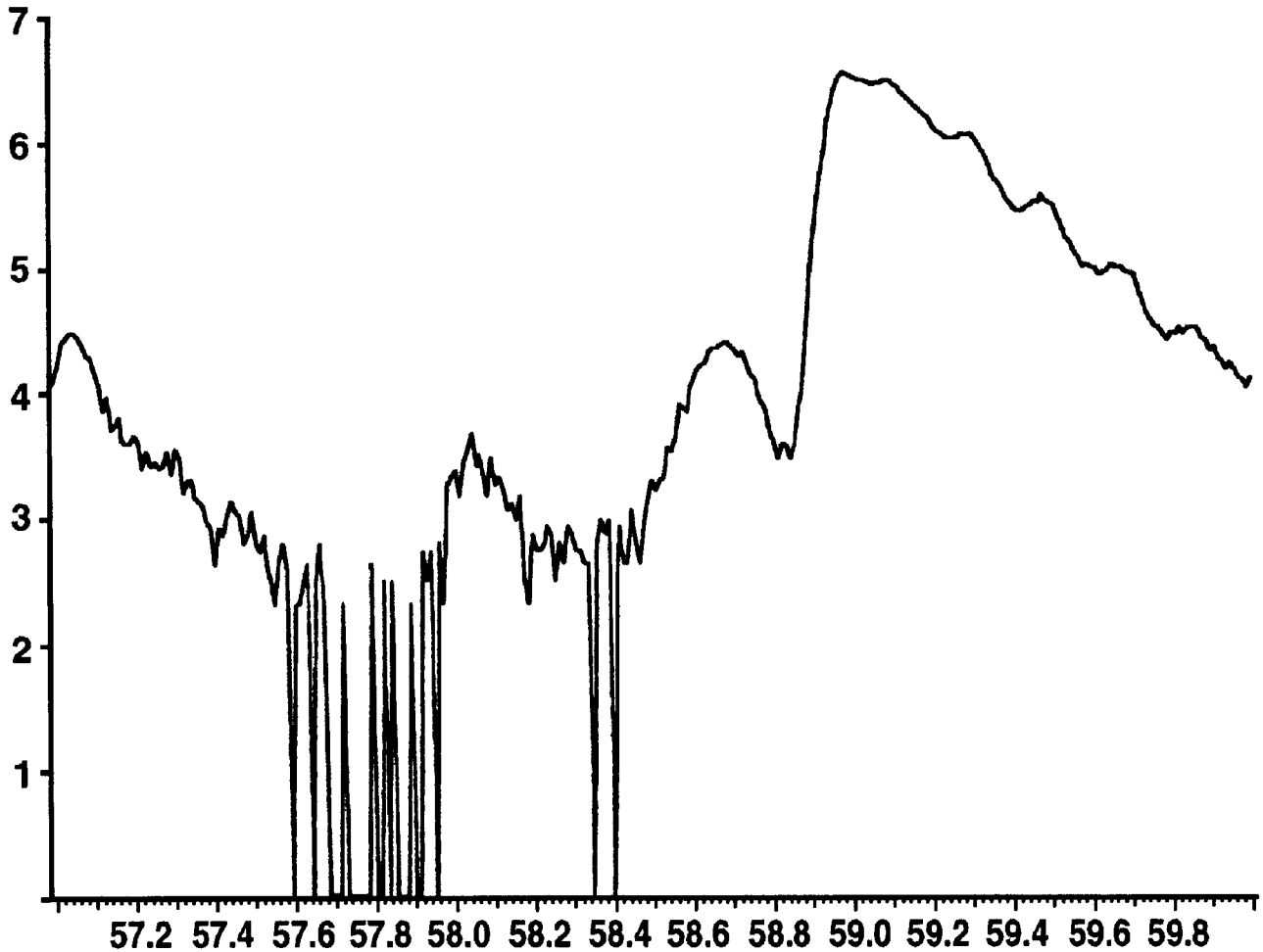
Figure 5A:
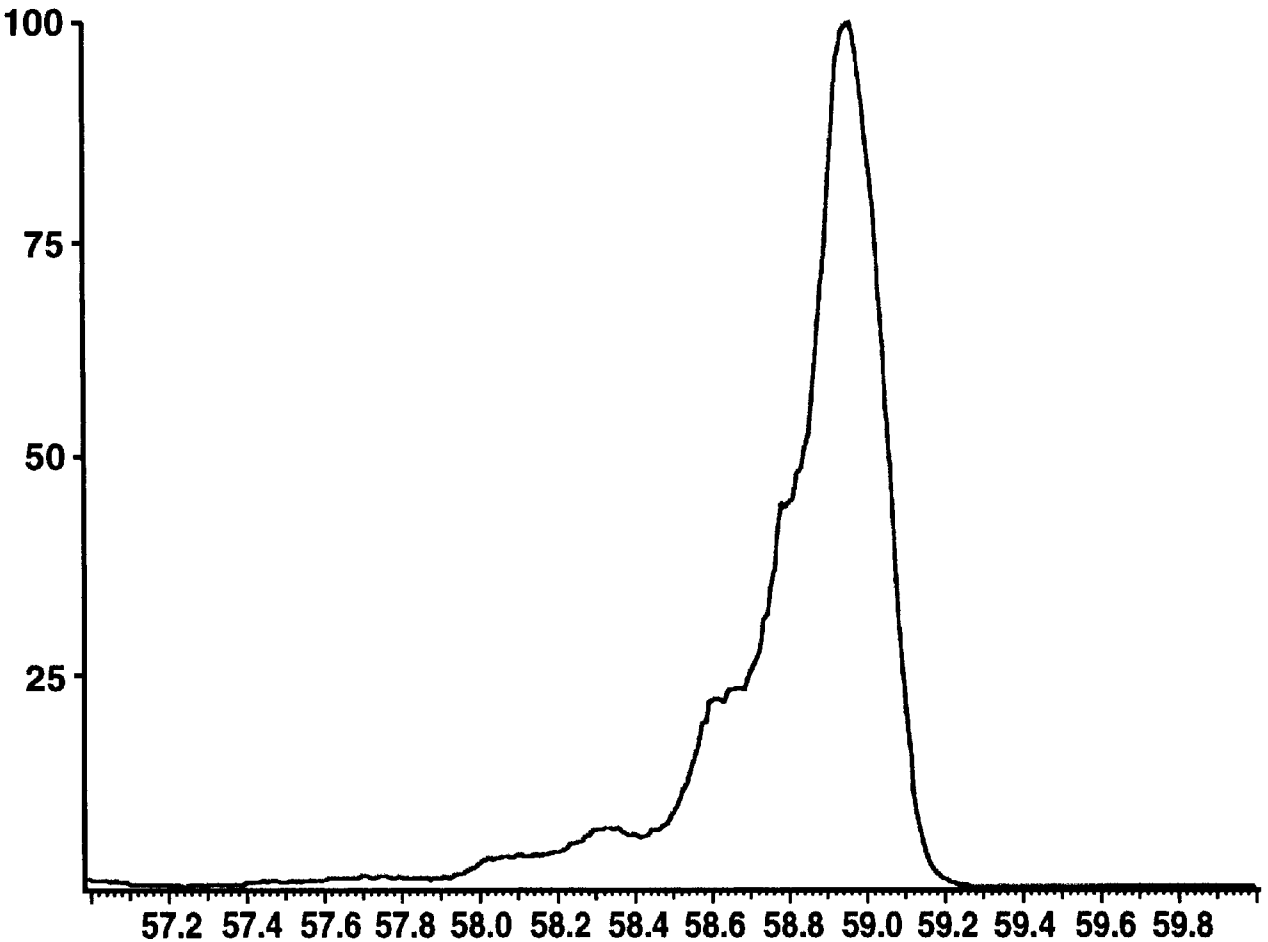
FIGS. 5*a* and 5*b* show the peak shapes obtained with operation at the lower tip of the third stability region, with linear and logarithmic vertical scales respectively.
Figure 5B:
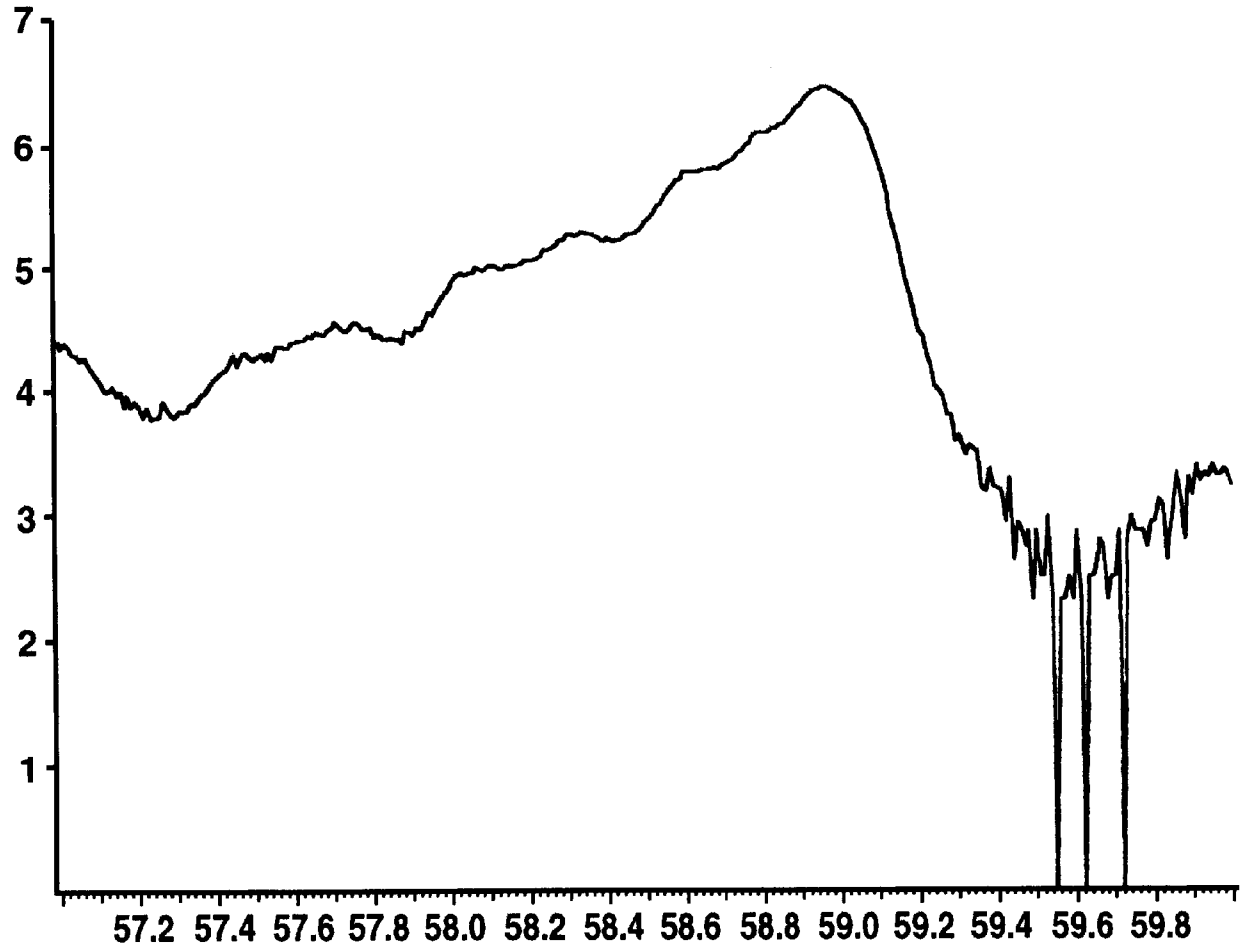

FIG. 4*a*, for example, shows the peak shape obtained with operation at the upper tip of the third stability region, i.e. as in FIG. 3*a*, and with ca. 120 eV $Co^+$ ions (m/e=59). FIG. 4*b* shows the same scan on a logarithmic vertical scale. It can be seen that there is a long "tail" on the high mass side of the peak, although the peak retains a relatively sharp cut-off on the low mass side. Similarly, FIG. 5*a* shows the peak shape obtained with operation at the lower tip, i.e. as in FIG. 3*b*, with 110 eV $Co^+$ ions. FIG. 5*b* shows the same peak but on a logarithmic vertical scale. It is seen that there is a long tail on the peak, but here it is on the low mass side and here it is the high mass side that has a relatively sharp cutoff.

Figure 6A:
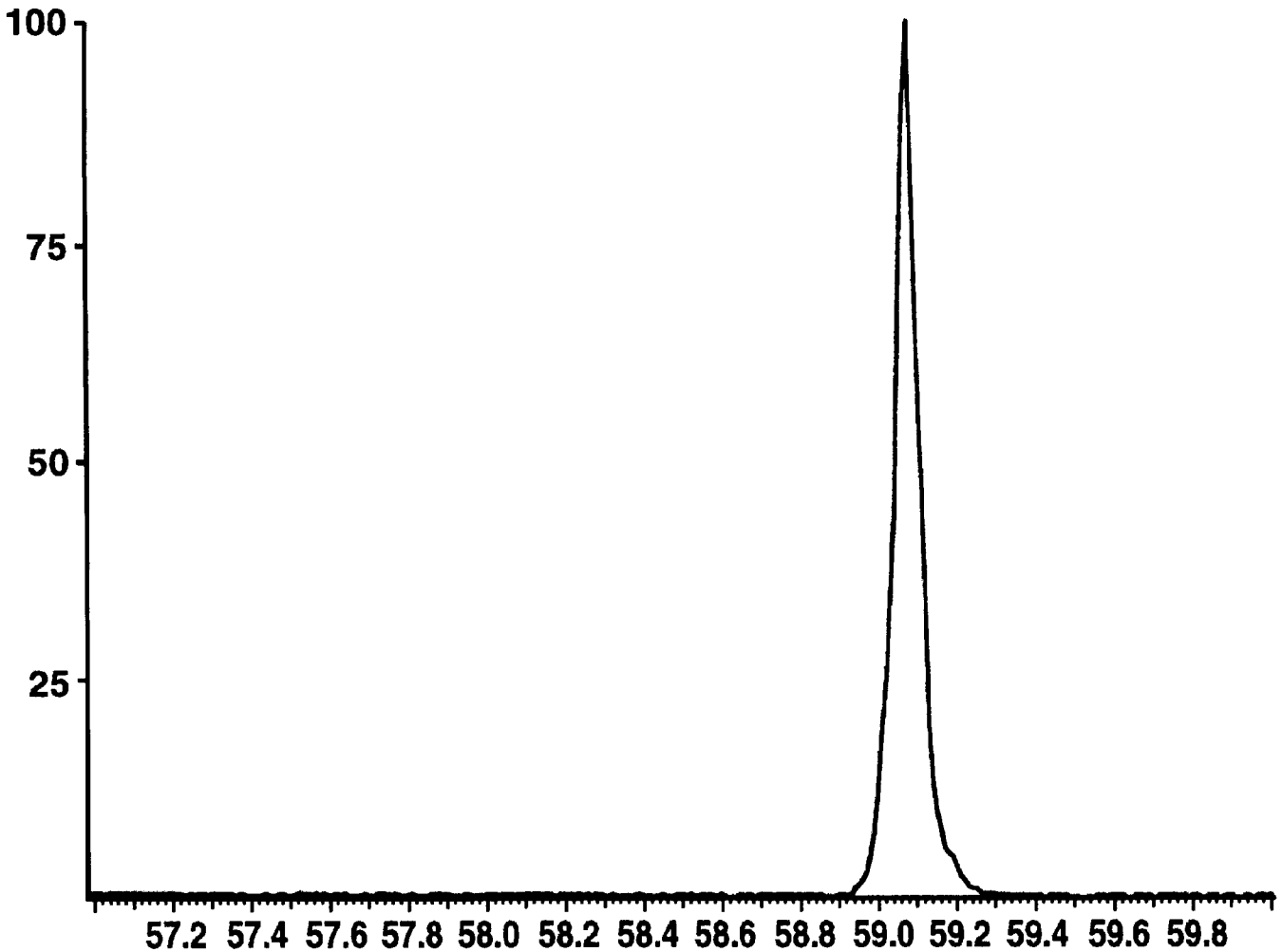
FIGS. 6*a* and 6*b* show the peak shape obtained with combined operation of two quadrupoles operated at the lower and upper tips of the third stability region, with linear and logarithmic vertical scales respectively.
Figure 6B:
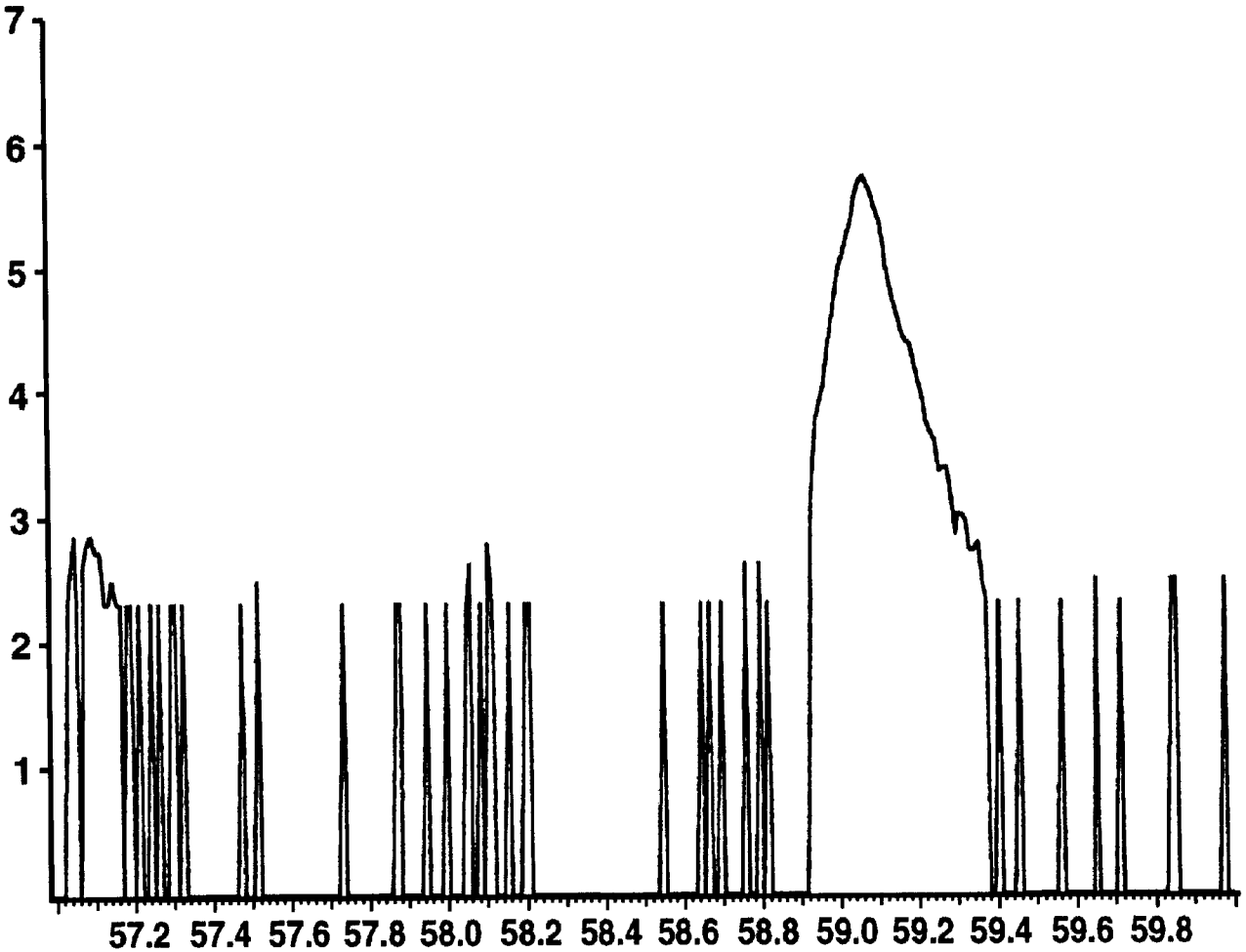

To eliminate these tails, the present invention provides for two quadrupoles operated in tandem and at conditions such that they both mass select the same ion. Then, their two characteristics or peak shapes can be combined to give a single, enhanced, higher resolution peak. This was carried out with $Co^+$ ions that had 120 eV energy in the first quadrupole and 110 eV energy in the second quadrupole. The first was operated at the upper tip with a peak shape like that of FIG. 4 and the second was operated at the lower tip with a peak shape like that of FIG. 5. The quadrupoles were scanned together and produced the peak shape of FIG. 6 (shown in a linear plot in 6*a* and a logarithmic plot in 6*b*). It is seen that the peak is narrower than the peak produced by either the first quadrupole or the second quadrupole alone. It is also seen that there is no tailing on either side of the peak. Thus, in accordance with one aspect of the present invention, two tandem quadrupoles are operated in selected stability regions to select ions with the same m/e ratio; here the quadrupoles were operated in the third stability region with one quadrupole operated at the upper tip and the second quadrupole at the lower tip. Improved peak shape can be obtained with the quadrupoles operated either in the order upper tip-lower tip or in the order lower tip-upper tip. For example with the 110 eV or 120 eV $Co^+$ ions it is not possible to generate peaks with sharp sides as shown in FIG. 6, with operation of a single quadrupole in the first or third stability regions, but this can be achieved with the present invention.

Figure 7A:
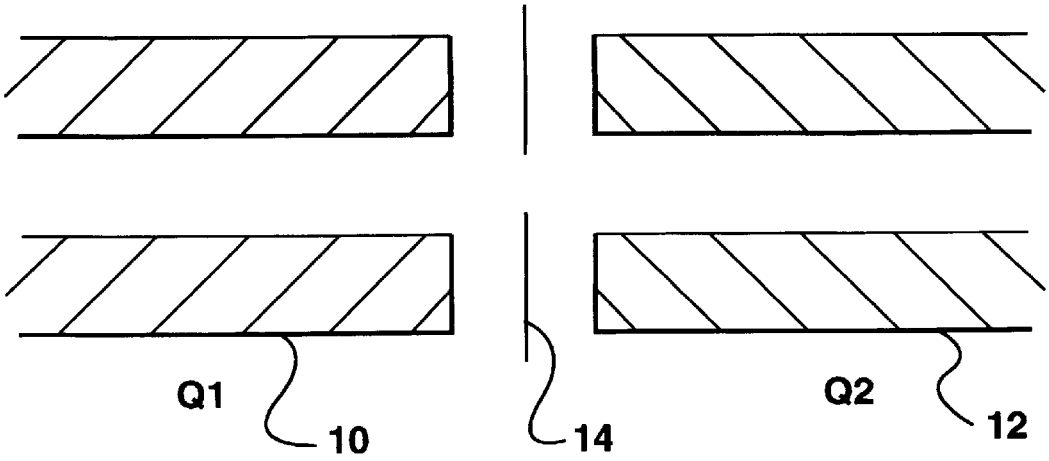
FIG. 7*a* shows schematically a first embodiment of a tandem quadrupole apparatus in accordance with the present invention, including an aperture lens between the quadrupoles.
Figure 7B:
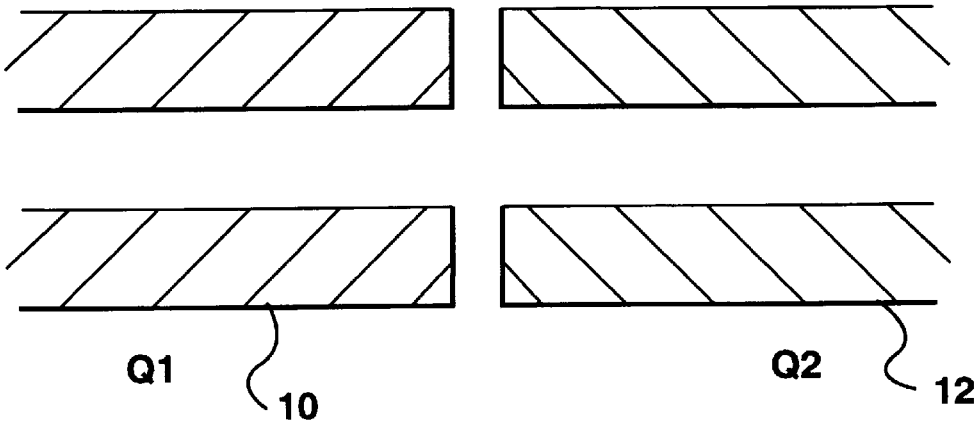
FIG. 7*b* shows schematically a second embodiment of a tandem quadrupole apparatus in accordance with the present invention, showing close coupling of the quadrupole rod sets.

A first set of experiments to demonstrate the feasibility of operating tandem quadrupoles was carried out with the apparatus of FIG. 7*a*. Two quadrupoles, identified as Q1, Q2 in known manner, were placed in series and the A poles of the first quadrupole were aligned with the A poles of the second quadrupole. Ions leaving the first quadrupole passed through an aperture lens 14 into the second quadrupole. The lens 14 shielded the RF circuit of each quadrupole from the RF of the other quadrupole. The diameter of the inscribed circle within the quadrupoles was 13.83 mm ($r_0$=6.915 mm). Lens aperture diameters of 11, 16, 22 and 30 mm were tested and all gave similar sensitivity. Then the lens 14 was removed and the quadrupoles Q1, Q2 placed adjacent to each other with a separation of 7 mm, i.e. about equal to $r_0$ as shown in FIG. 7*b*. This required modifications to the electrical connections of the quadrupoles as detailed below.

With the quadrupoles placed close together, and with no lenses between the quadrupoles, the transmission or sensitivity of the tandem quadrupole mass analyzer was found to increase about ten times. It is believed that this is because the ions remain within the third stability region as they pass from the first to second quadrupoles. With a lens placed between the quadrupoles, the quadrupole fields reach zero at the lens (or at least a level much lower than the fields within the quadrupoles). This causes the ion motion to become unstable in the region between the two quadrupoles; ions are lost and the sensitivity or transmission is reduced.

Figure 8A:
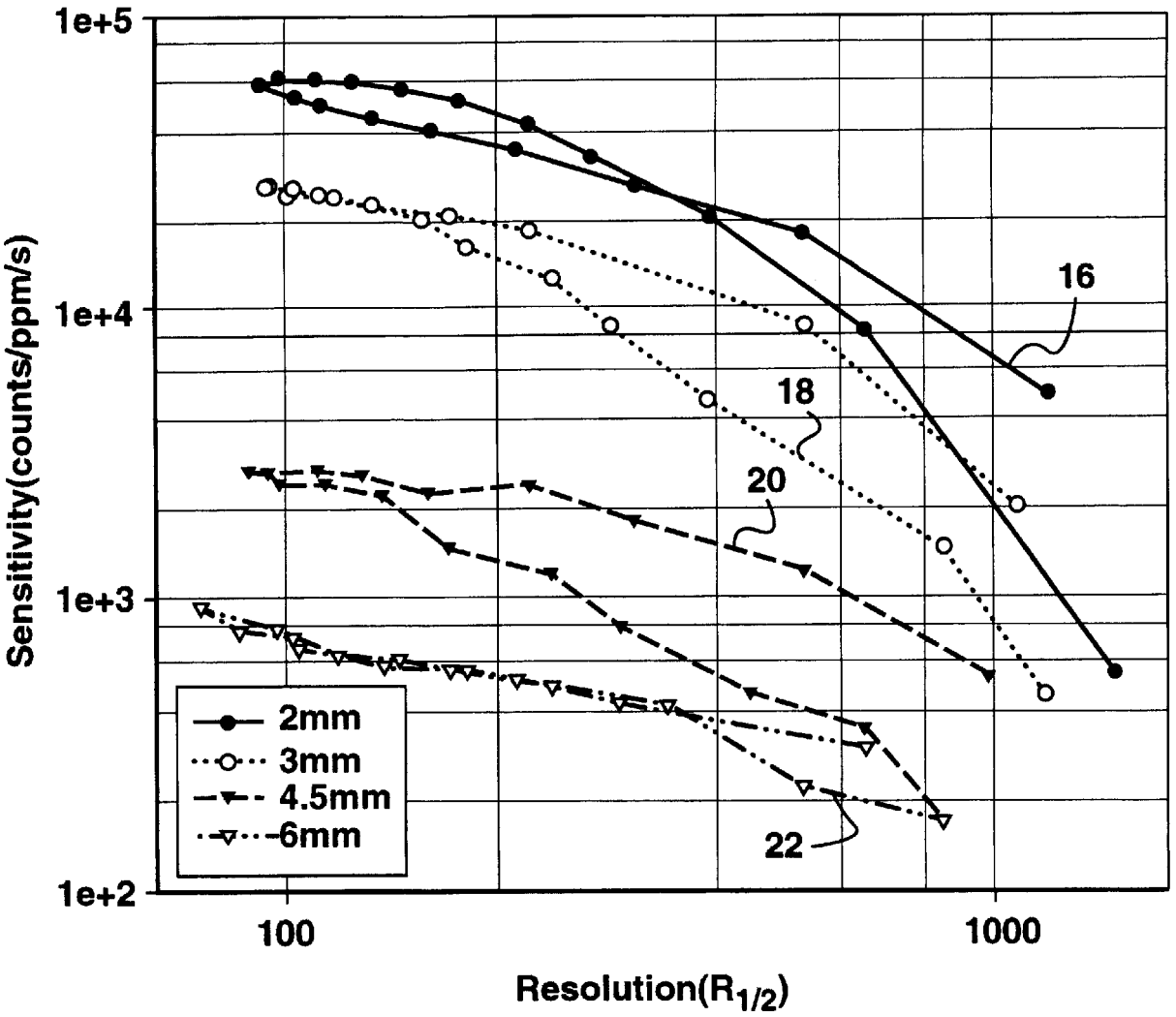
FIG. 8*a* shows graphs of the variation of sensitivity with resolution, for different quadrupole spacings, with the first quadrupole operated at the upper tip of the third stability region and the second quadrupole operated at the lower tip of the third stability region.

With no lens between the quadrupoles the sensitivity of the analyzer was measured at different resolutions. The resolution was changed by introducing a mass shift between the quadrupoles as described below. The sensitivity-resolution curves were measured for quadrupole spacings of 2.0, 3.0, 4.5 and 6 mm, indicated at 16, 18, 20 and 22 respectively in FIG. 8*a*. Here the variation of sensitivity with resolution was measured for operation of Q1 at the upper tip of the third region and Q2 at the lower tip of the third region. In this experiment the ion energy ($Co^+$, m/e 59) was ca. 9 eV. The curves were obtained by progressively varying the mass shift between the two quadrupoles. Each curve shows a starting position with partial overlap of the two peaks, the highest sensitivity and lowest resolution is obtained with full overlap of the peaks, and then resolution improves as the peaks shift to a partially overlapped condition as described below. It is seen that decreasing the spacing from 6 mm to 2 mm causes a more than tenfold increase in the sensitivity.

Figure 8B:
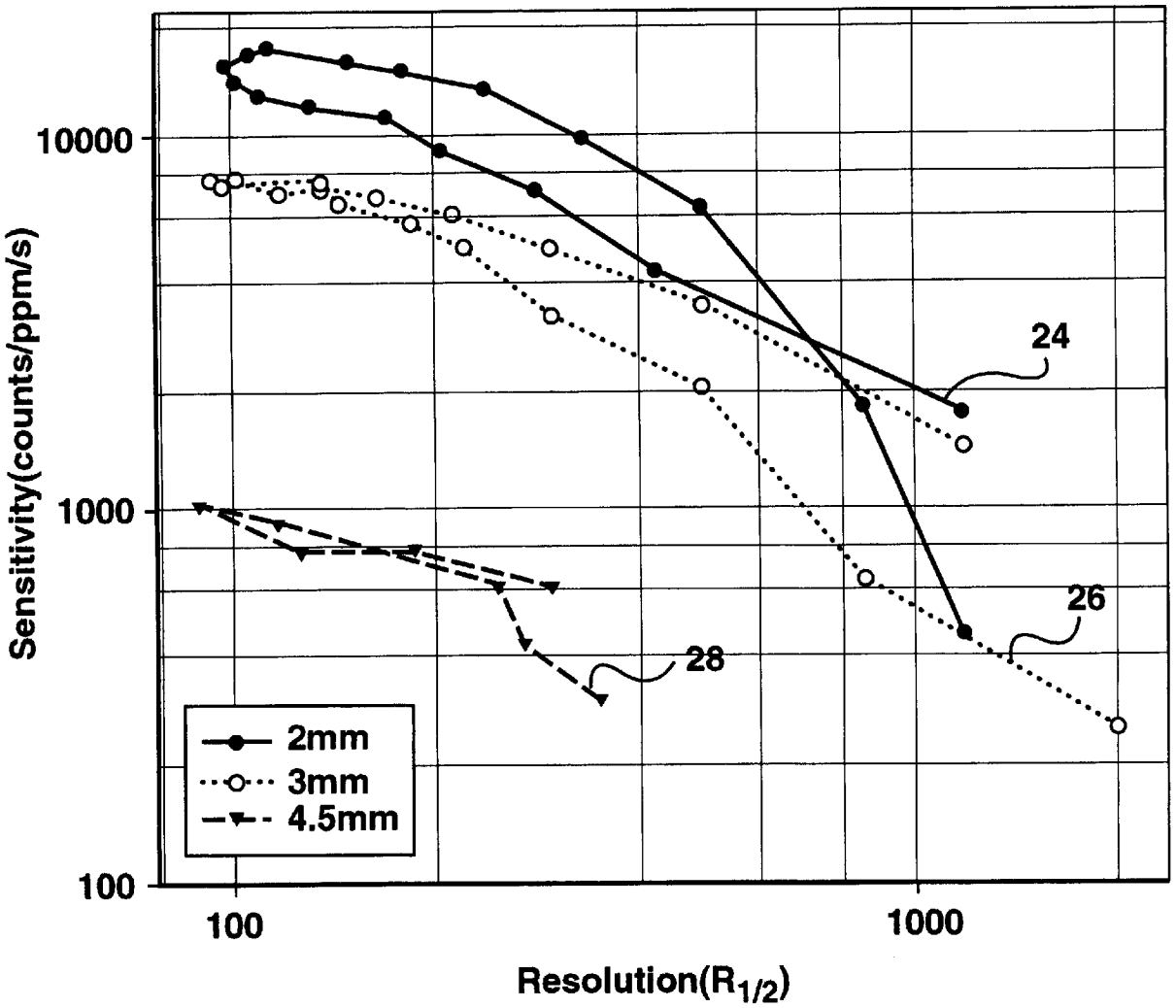
FIG. 8*b* shows graphs of the variation of sensitivity with resolution, for different quadrupole spacings, with the first quadrupole operated at the lower tip of the third stability region and the second quadrupole operated at the upper tip of the third stability region.

The experiment was repeated but with Q1 operated at the lower tip of the third stability region and with Q2 operated at the upper tip. This was done for quadrupole spacings of 2.0, 3.0 and 4.5 mm, indicated at 24, 26 and 28 respectively in FIG. 8*b*. Again, it is seen in FIG. 8*b* that reducing the spacing to 2.0 mm causes a dramatic increase in the sensitivity. It is expected that with much higher ion energies the quadrupole spacing can be greater than 2 mm while maintaining good transmission. However, the preferred method of operation is with a spacing of 2 mm or less because in this case ions of any energy have good transmission. Thus, another aspect of the present invention requires that the quadrupoles be adjacent to each other with the poles aligned and with a spacing less than $2r_0$ and preferably about $r_0$ or even 0.3 $r_0$ or less.

With the quadrupoles placed close together and with no lens between the quadrupoles it was found that capacitance coupling of the RF between the quadrupoles caused problems with the control circuits. There are many known quadrupole designs which have multiple rod sets, which are mounted close to one another. However, the problem of capacitance coupling between rod sets is not usually a problem for a number of reasons. Often one rod set is larger than another, so that the larger rod set at least will not sense any significant effect from a field from a smaller rod set. In many cases, the RF drive for one rod set is derived by a capacitance connection with another rod set or its RF driver circuit, so that adjacent rod sets are, in any event, coupled. In some cases the quadrupoles operate at different frequencies so that one quadrupole power supply is not sensitive to electrical pick-up from another. Also, for many quadrupole designs, one rod set is often enclosed in a chamber, with lens at either end, so that it can be operated at a different pressure from adjacent rod sets. The lenses at either end serve not only to isolate the different pressure regions but also to provide isolation or separation between fields of the different rod sets. For example, a common design includes three quadrupole rod sets in series, with the second or central rod set being enclosed for operation at a higher pressure as a collision cell.

Figure 9:
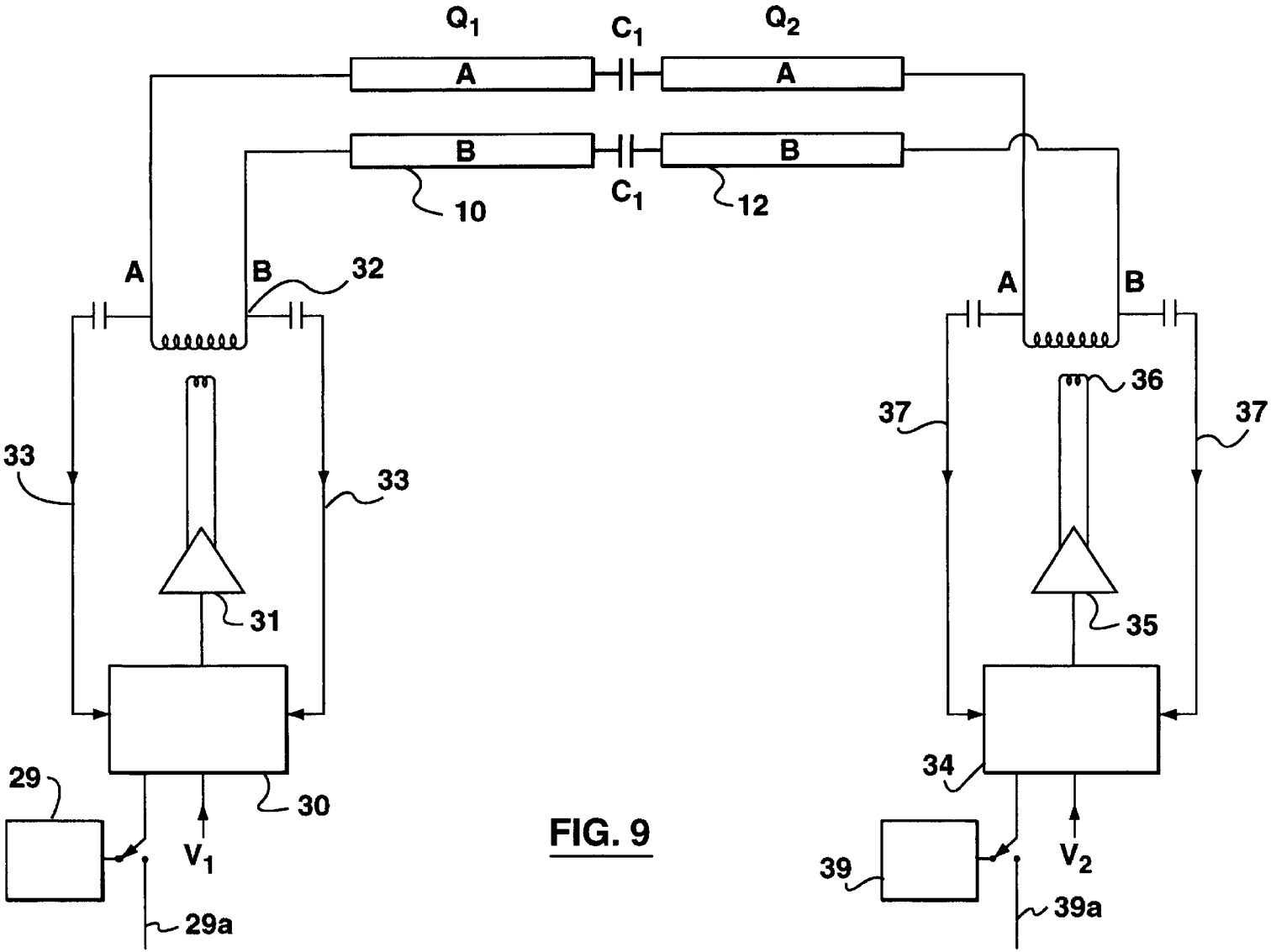
FIG. 9 is a schematic circuit diagram showing a control circuit for the quadrupoles of the present invention.

Thus, in known designs, problems due to close coupling have in general not been identified. For the present invention, when quadrupole mass filters were close coupled it was found that the RF field on one quadrupole power supply interfered with the second power supply due to a capacitance effect between adjacent rods. Referring to FIG. 9, each quadrupole RF power supply has a low voltage control circuit, indicated at 30 and 34 followed by a respective RF power amplifier 31, 35, and a respective high Q resonance step up transformer 32, 36. The RF signal for the circuit is generated either by an internal oscillator 29, 39 or can be supplied by an external RF drive as indicated 29*a*, 39*a*. A small fraction of the output RF voltage is returned through a respective feedback circuit 33, 37 for comparison with the requested or set voltage. When the two quadrupoles are placed close together, with poles aligned, there is a stray capacitance $C_1$ (FIG. 10) between the ends of the A poles of quadrupole Q1 and the A poles of quadrupole Q2 and also a stray capacitance $C_1$ between the B poles of quadrupole Q1 and B poles of quadrupole Q2. These capacitances couple some of the RF potential of the rods from each quadrupole to the rods of the other. The feedback and control circuit of the quadrupole power supplies used were not designed to accommodate this. For example, if quadrupole Q1 is operated at high voltage and quadrupole Q2 at a lower voltage, the RF coupling between quadrupole Q1 and quadrupole Q2 induces a higher than expected voltage in the feedback circuit of quadrupole Q2 and the control circuitry fails.

Figure 10:
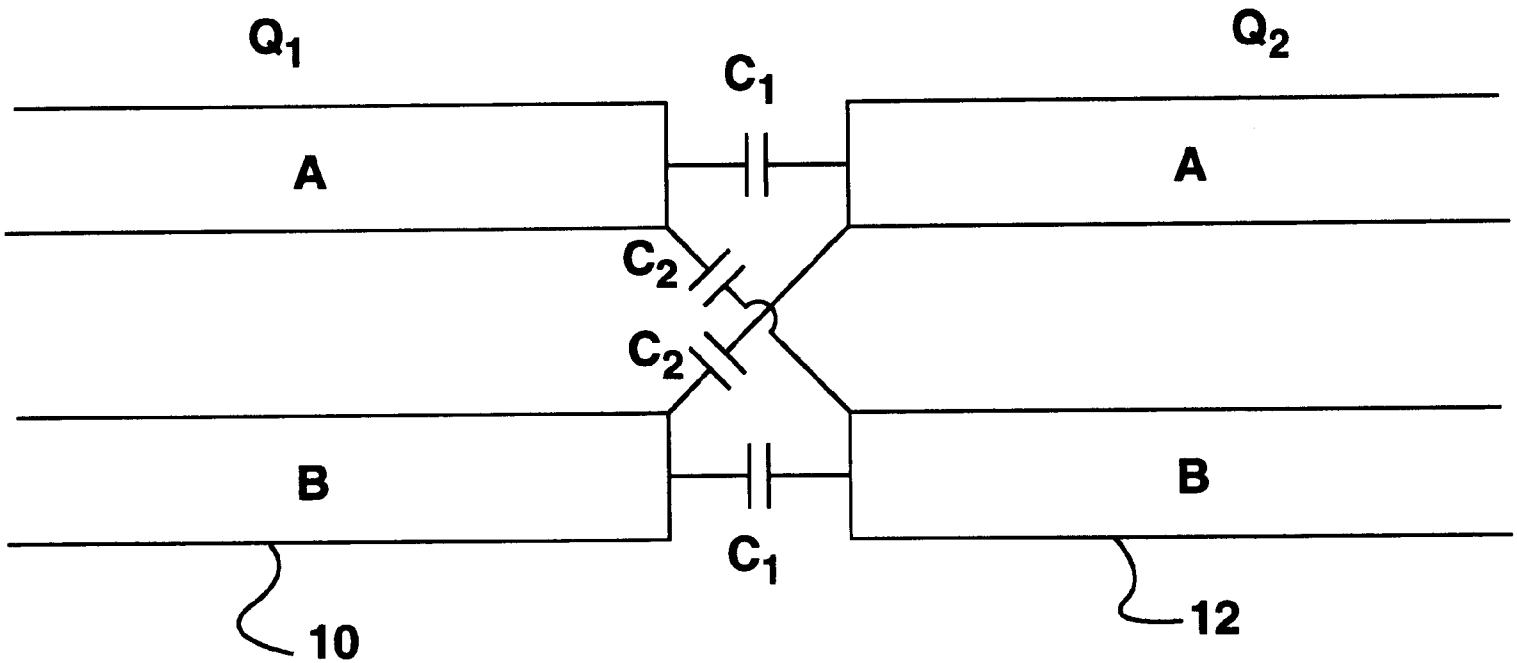
FIG. 10 is a schematic showing capacitor connections for close coupled quadrupoles in accordance with the present invention.

This was overcome by a technique of "neutralization", shown in FIG. 10. The quadrupoles are phase locked and the voltage applied to the A poles of quadrupole Q1 is the same polarity as the voltage applied to the A poles of quadrupole Q2. An additional capacitor, $C_2$, with a value equal to $C_1$, is used to couple a voltage from the B poles of quadrupole Q2 to the A poles of quadrupole Q1 equal in amplitude but opposite in polarity to that which the A poles of quadrupole Q1 receives from the A poles of quadrupole Q2 through the capacitance $C_1$. These two voltages exactly cancel and no net coupling remains between quadrupole Q2 and the A poles of quadrupole Q1. Similarly, a capacitor $C_2$ is connected between the A poles of quadrupole Q2 and the B poles of quadrupole Q1 to eliminate coupling between the B poles of quadrupoles Q1 and Q2. With this change to the RF excitation circuitry of the quadrupoles the feedback circuits functioned as intended.

It will be appreciated that other neutralization methods are possible. The essential requirement is to pick up part of the RF signal applied to one pair of rods and apply this to the other pair of rods in a manner that neutralizes the coupling effect of the capacitors C1. For example, some extra turns could be provided on the transformer 32 and connected to a suitable coil on the transformer 36 to achieve this effect.

As indicated above, another aspect of the present invention involves scanning of tandem quadrupoles with a mass offset between them to produce a mass spectrum with higher resolution than the resolution of the individual quadrupoles. This is illustrated for an idealized case in FIGS. 11–13. Real cases and data are detailed below.

Figure 11A:
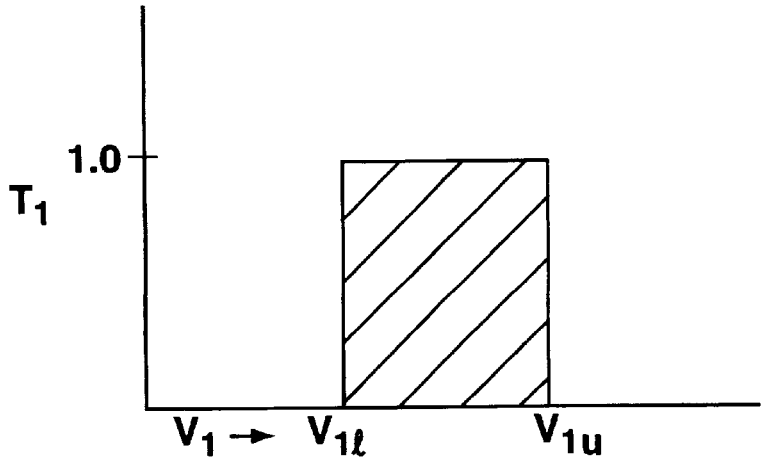
FIGS. 11*a*, 11*b*, and 11*c* show idealized peak shapes and the peak shape of a tandem mass analyzer.
Figure 11B:
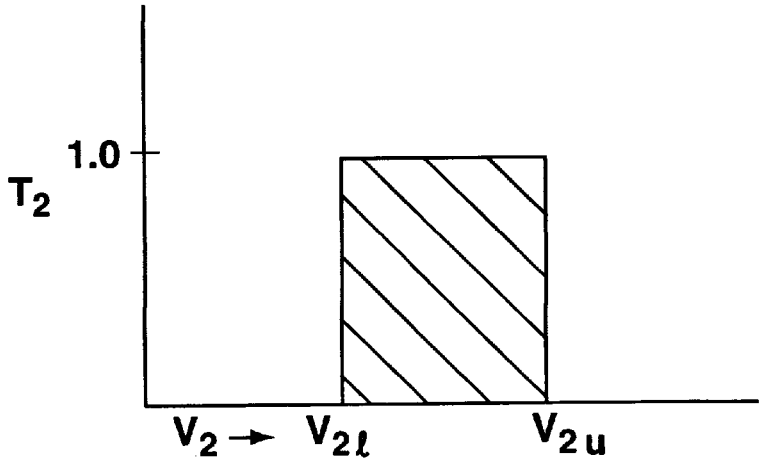

In FIG. 11*a, b* the peak shapes of Q1 and Q2 are shown as ideal rectangular shapes, with a transmission of either 0 or 100%. The peak shape is a graph of the transmission of an ion, T, of a particular m/e value as the RF and DC voltages of the quadrupole increase. The DC and RF voltage applied to the rods is proportional to a control voltage $V_1$ or $V_2$ for Q1 and Q2 respectively, with the ratio of RF to DC of each quadrupole kept constant. Thus in FIG. 11*a*, for the quadrupole Q1 there is a range of voltages $V_1$ from a lower control voltage $V_{1l}$ to an upper control voltage $V_{1u}$ for which an ion is transmitted. Similarly, in FIG. 11*b*, there is a lower control voltage $V_{2l}$ and an upper control voltage $V_{2u}$ for which the same ion is transmitted through Q2. If Q1 and Q2 have the same $r_0$ and are operated at the same frequency, and if the quadrupole power supplies for Q1 and Q2 are identical, the upper and lower control voltages will be the same for Q1 and Q2. If Q1 and Q2 are then scanned in tandem, the transmission will be the product of the transmission through Q1, $T_1$, and the transmission through Q2, $T_2$. For the case where the quadrupoles are scanned with no mass shift, the transmission windows of Q1 and Q2 will overlap exactly and the resolution of the tandem quadrupole will be the same as either of the single quadrupoles, as shown in FIG. 11*c*.

FIG. 12 illustrates what happens if the two quadrupoles are scanned simultaneously but the control voltage $V_2$ applied to Q2 is adjusted to be lower than the control voltage $V_1$ by an amount Δ. This corresponds to scanning Q2 at a slightly lower mass setting than Q1. Ions are still transmitted for the same values of $V_{1l}$, $V_{1u}$ and $V_{2l}$, $V_{2u}$, as shown in FIGS. 12*a* and *b*. However, the voltage $V_{2l}$ and $V_{2u}$ for which ions are transmitted through Q2 are not reached until the control voltages of Q1 are somewhat higher than in FIG. 11. This is shown in FIG. 12*c* which shows the window of transmission through Q2 as a function of the Q1 voltage $V_1$. For an ion to be transmitted it must pass through both Q1 and Q2. As the voltages on Q1 and Q2 increase first the ion is transmitted by Q1 because $V_1$ reaches $V_{1l}$. However the ion is not transmitted by Q2 because $V_2$ is less than $V_1$ and hence $V_2$ is less than $V_{2l}$. When the voltages $V_1$ and $V_2$ are further increased $V_2$ reaches $V_{2l}$ and the ion is transmitted by both Q1 and Q2. As the voltages further increase, Q1 reaches $V_{1u}$ and the ion is no longer transmitted by Q1 although the voltages applied to Q2 allow transmission of the ion in Q2. If the transmission is plotted vs. $V_1$ as is done on FIG. 12*d* the transmission of Q1 is indicated at 40 and the transmission of Q2 at 42. It is seen that there is a narrower range of voltages, indicated by the central region 44 for which an ion of a given m/e is transmitted by both Q1 and Q2. A narrower peak is produced in the mass spectrum and hence the resolution is improved over that of either Q1 or Q2 alone.

Similarly Q2 can be scanned at a mass slightly higher than Q1 by adjustment of the applied voltages, as illustrated in FIG. 13. FIGS. 13*a, b* show the transmission of Q1 vs. $V_1$, and $Q_2$ vs. $V_2$, which are the same as in earlier FIGS. 11*a, b* and 12*a, b* respectively. FIG. 13*c* shows the transmission of Q2 plotted vs. $V_1$. Because Q2 is scanned at a slightly higher mass setting than Q1, it transmits ions when Q1 is set to a lower voltage than Q2. Again, for an ion to be transmitted it must pass through Q1 and Q2. If the transmission is plotted vs. $V_1$ as in FIG. 13*d* (and again for simplicity 40, 42 and 44 are used to denote the different peaks), there is a narrower range of $V_1$ for which the ion is transmitted. A narrower peak is produced in the mass spectrum and the resolution is again improved over that of either Q1 or Q2.

Figure 11C:
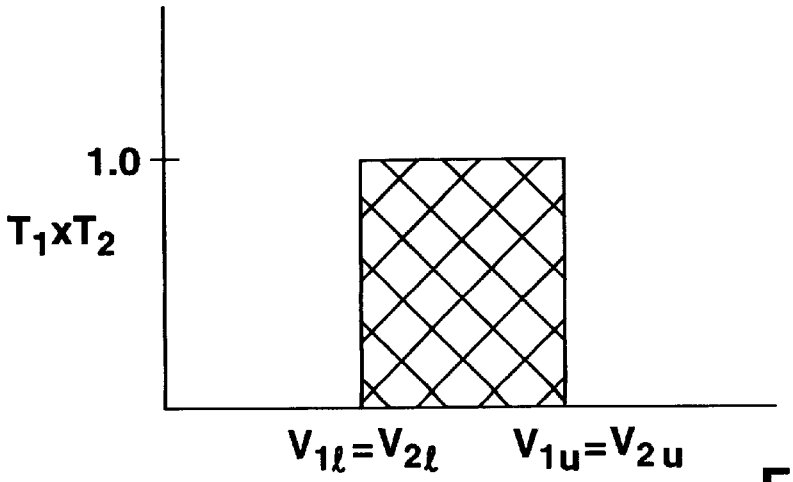
Figure 12A:
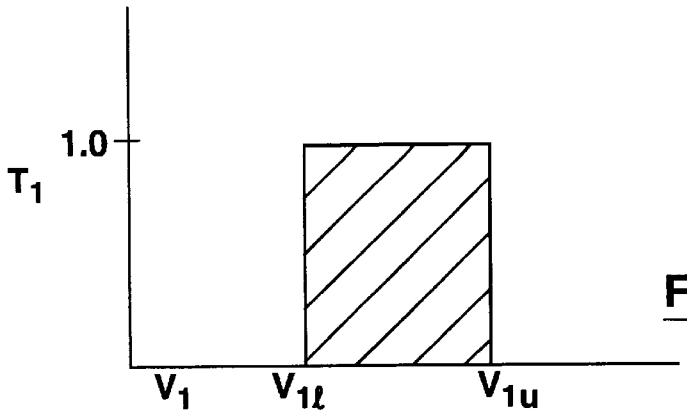
FIGS. 12*a*, 12*b*, 12*c* and 12*d* are similar schematic diagrams to FIG. 11 showing the effect of mass offset, with the second quadrupole scanned at a slightly lower mass setting than the first quadrupole.
Figure 12B:
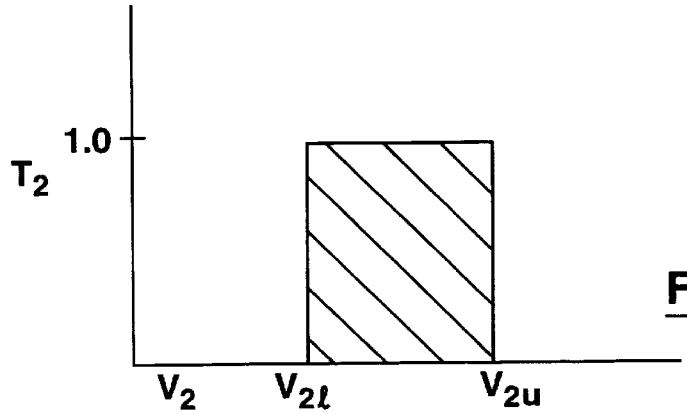
Figure 12C:
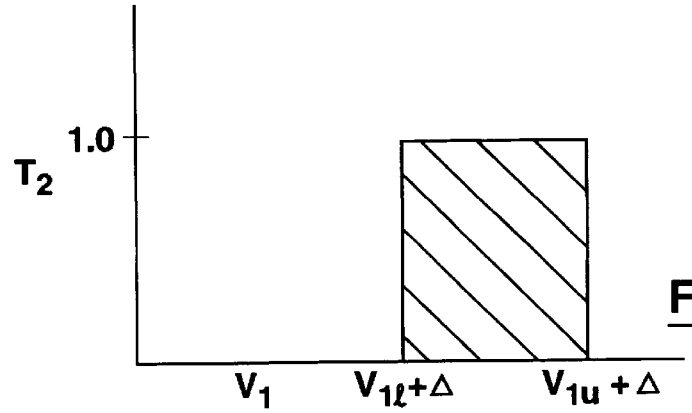
Figure 12D:
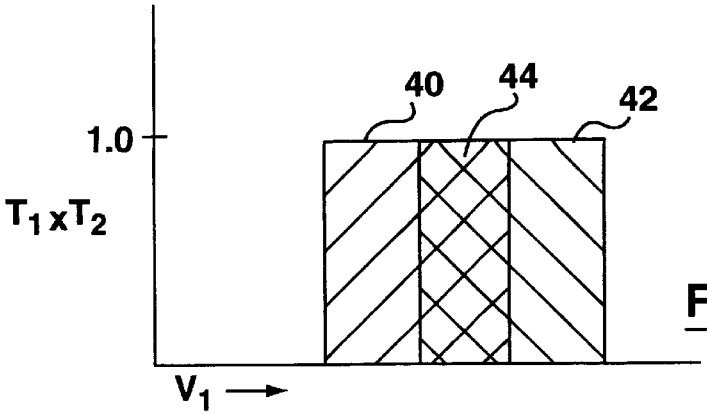
Figure 13A:
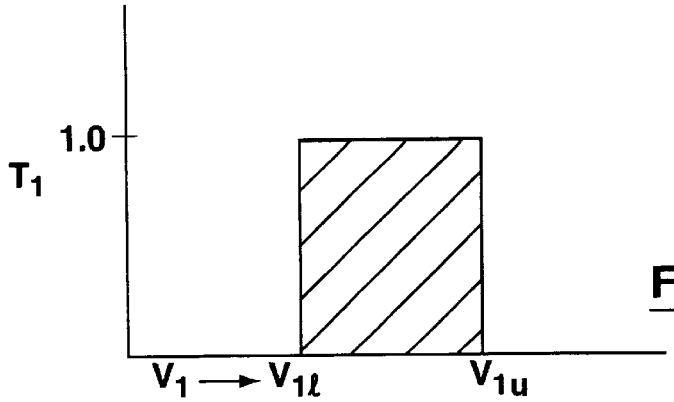
FIGS. 13*a*, 13*b*, 13*c* and 13*d* are schematic views, similar to FIG. 11 showing scanning with the second quadrupole at a mass setting slightly higher than the first quadrupole.
Figure 13B:
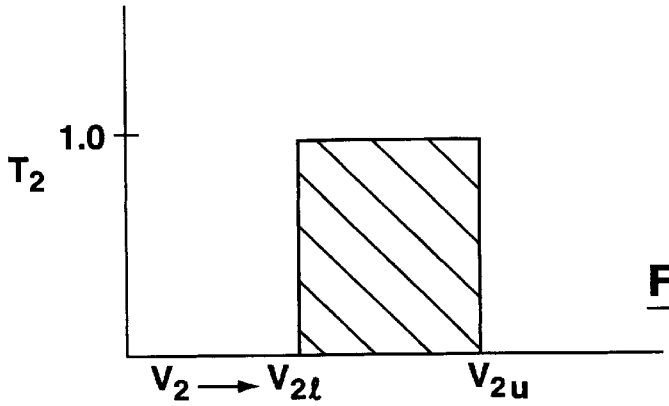
Figure 13C:
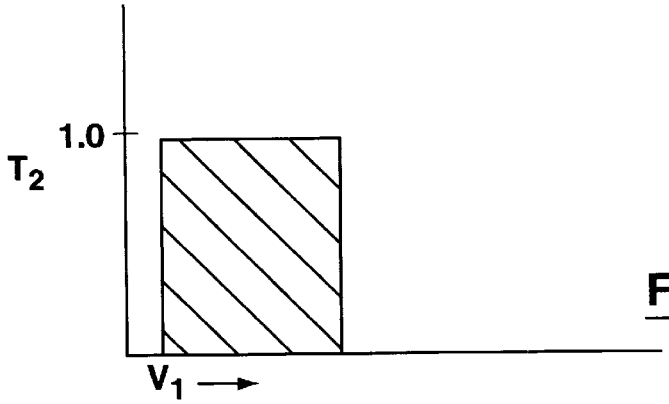
Figure 13D:
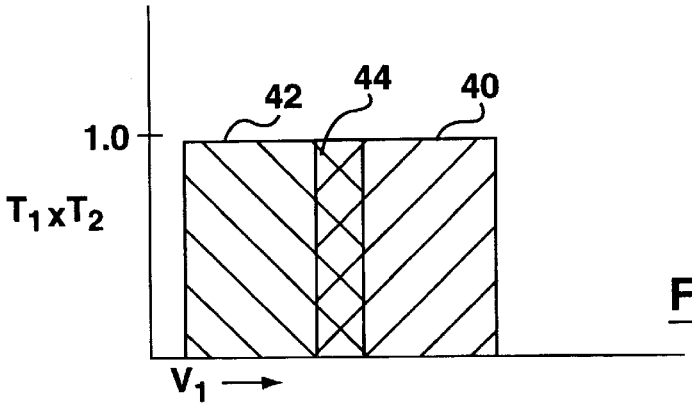
Figure 13E:
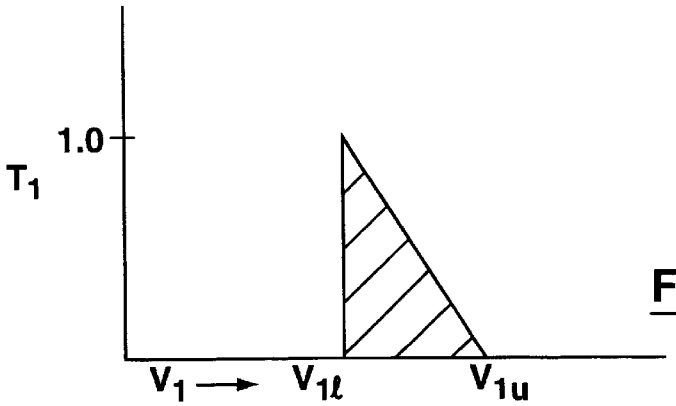
FIGS. 13*e*, 13*f*, 13*g*, and 13*h* are views similar to FIGS. 13*a*–13*d*, showing the effect of different peak shapes and the offset required to give reasonable overlap between the quadrupoles and effective ion transmission.
Figure 13F:
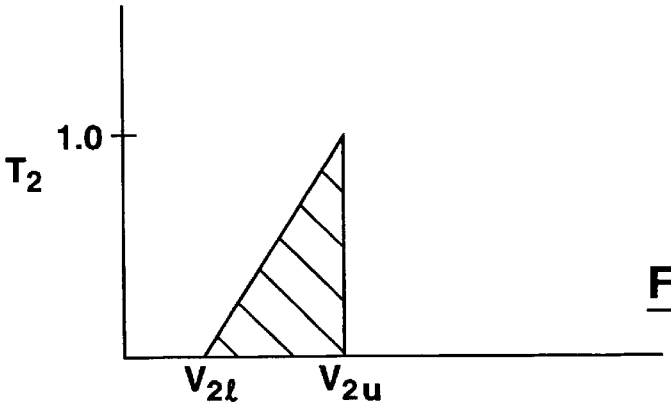

The peak width of the tandem analyzer is given by the shaded areas in FIGS. 11*c*, 12*d* and 13*d*. This area can be changed by changing the mass shift between the analyzers. For example, in FIG. 13*d*, the mass offset is greater than in FIG. 12*d* and a narrower peak is produced. Thus, another aspect of the invention is the ability to change the resolution of the tandem analyzer by changing the mass offset of the two quadrupoles. This offset can be either positive or negative. Here a positive offset means that Q2 scans at a lower m/e setting than Q1 (as in FIG. 12) and a negative offset means that Q2 scans at a higher m/e setting than Q1 (as in FIG. 13).

Figure 13G:
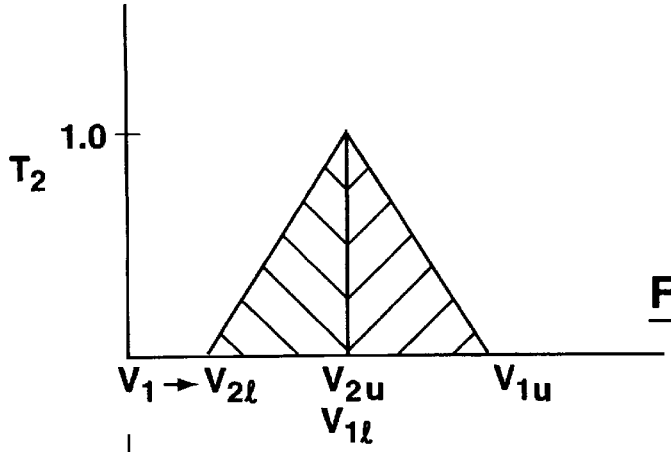
Figure 13H:
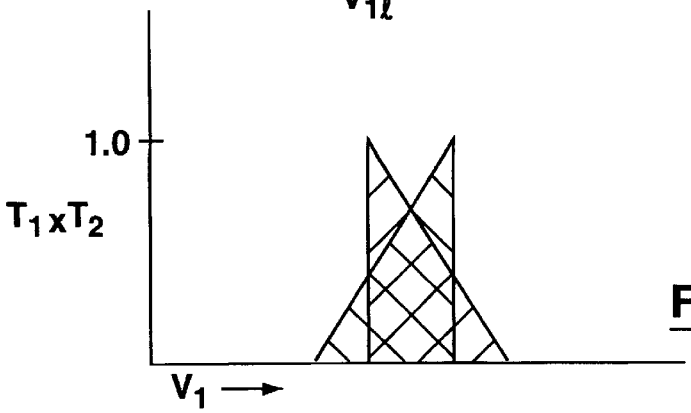

The offset that gives the broadest peak is zero for the examples just given. However, the offset giving the broadest peak shape and the offset giving the maximum transmission will depend on the peak shapes of the individual quadrupoles. Consider the example of FIG. 13*e*–*h*. Here the peak shape in Q1 (FIG. 13*e*) is shown as triangular with a tail on the high mass side. This is approximately similar to that of FIGS. 4*a, b*. The peak shape of Q2 (FIG. 13*f*) is shown as triangular with a tail on the low mass side. This is approximately similar to FIGS. 5*a, b*. If the mass spectrometer is calibrated so that the highest point on the peak is considered to correspond to the m/e value of the peak, and if the quadrupoles are scanned together with no mass shift, there will be no overlap of the peaks as is shown in FIG. 13*g*, and no ions will be transmitted. To transmit ions will require a mass shift to cause some overlapping of the peaks, as shown in FIG. 13*h*. Thus in general the mass shift giving maximum transmission or maximum resolution will depend on the peak shapes of the individual analyzers and the manner in which the mass filters Q1, Q2 are mass calibrated.

These theoretical examples show that the resolution of the tandem quadrupole can be changed by changing the mass shift between the quadrupoles, while each quadrupole is operated at the same constant resolution. This is now illustrated for real peak shapes obtained with tandem quadrupoles Q1 and Q2 under various conditions.

The theoretical examples of FIGS. 11, 12 and 13 assumed that the two quadrupoles were identical and were operating with the same ratio of RF to DC (V/U), i.e. that the quadrupoles were both scanning along the same operating line. This need not always be the case; the quadrupoles can operate in different stability regions or in different parts of the same stability region (as in FIGS. 3*a*, 3*b*). They may also operate at the same tip of a given stability region but at different resolutions. In these cases, they will have different RF to DC ratios and will have different operating lines. Nonetheless, each quadrupole will still have a common control voltage, and its response can be graphed against that voltage as in FIGS. 11, 12 and 13. It will be recognized that the relative shift between control voltage for the two quadrupoles can still be adjusted and can be expressed as a mass shift to obtain the desired degree of peak overlap.

Results will now be described for operation of tandem quadrupoles in the third stability region. For these, and all other results described here, the apparatus was similar to that described in the article "Inductively Coupled Plasma Mass Spectrometry with a Quadrupole Operated in the Third Stability region" by Zhaohui Du, Terry Olney, and D. J. Douglas published in The Journal of the American Society for Mass Spectrometry, 8, 1230–1236, December, 1997. Ions were produced in an inductively coupled plasma source and focussed into Q1 through a series of cylindrical lenses. $Co^+$ ions (m/e 59) were used. The ion energy from the source was ca. 3 eV. The single quadrupole analyzer was replaced with two quadrupoles operated in tandem. The ion energies in the quadrupoles could be increased by lowering the rod offset of the quadrupoles, as is known.

Figure 14A:
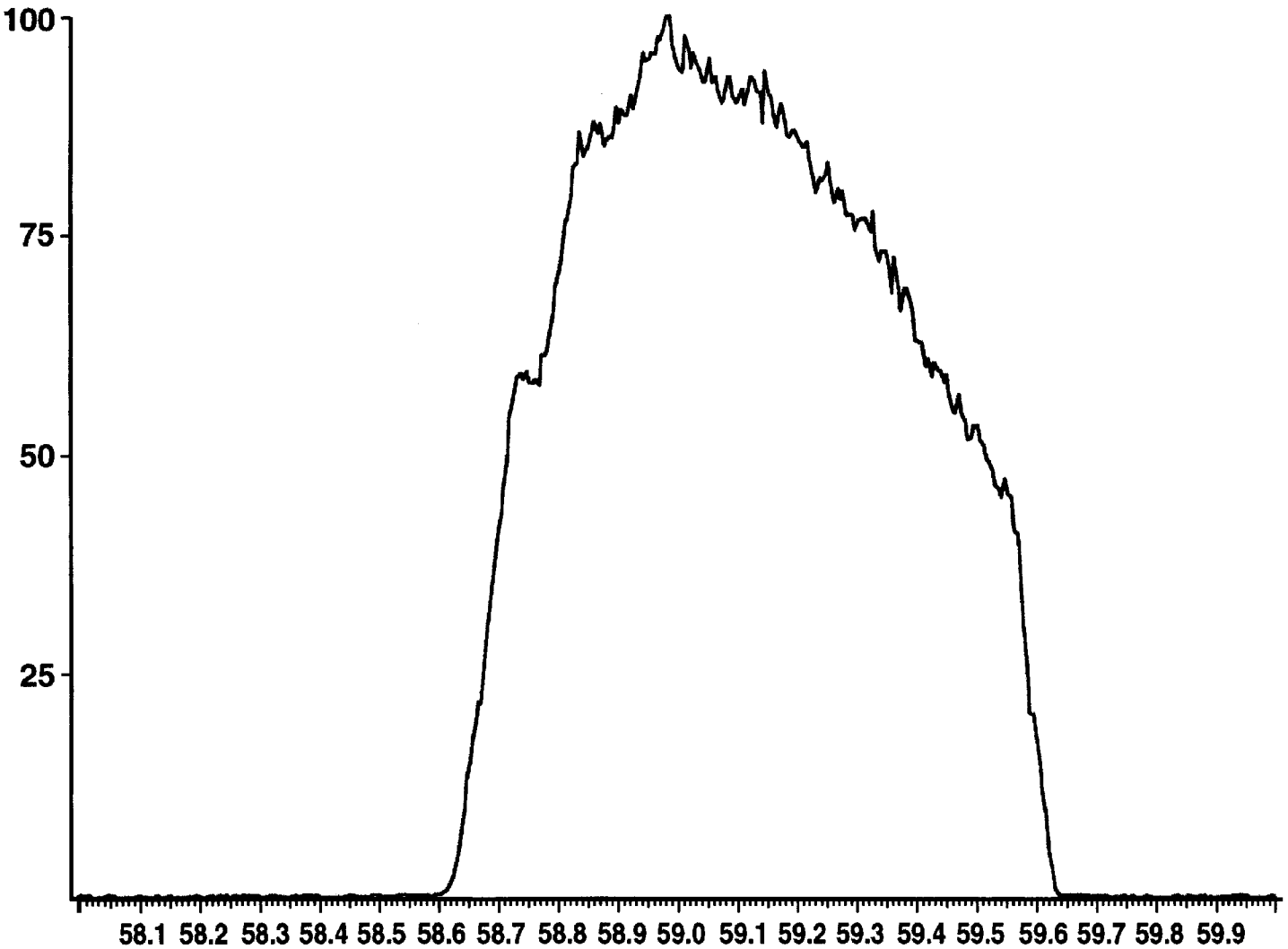
FIGS. 14*a*, 14*b* and 14*c* show respectively peak shapes obtained with the first quadrupole scanned at the upper tip of the third stability region, the second quadrupole scanned at the lower tip of the third stability region and for both quadrupoles with the second quadrupole scanned 1.3 m/e higher than the first quadrupole.
Figure 14B:
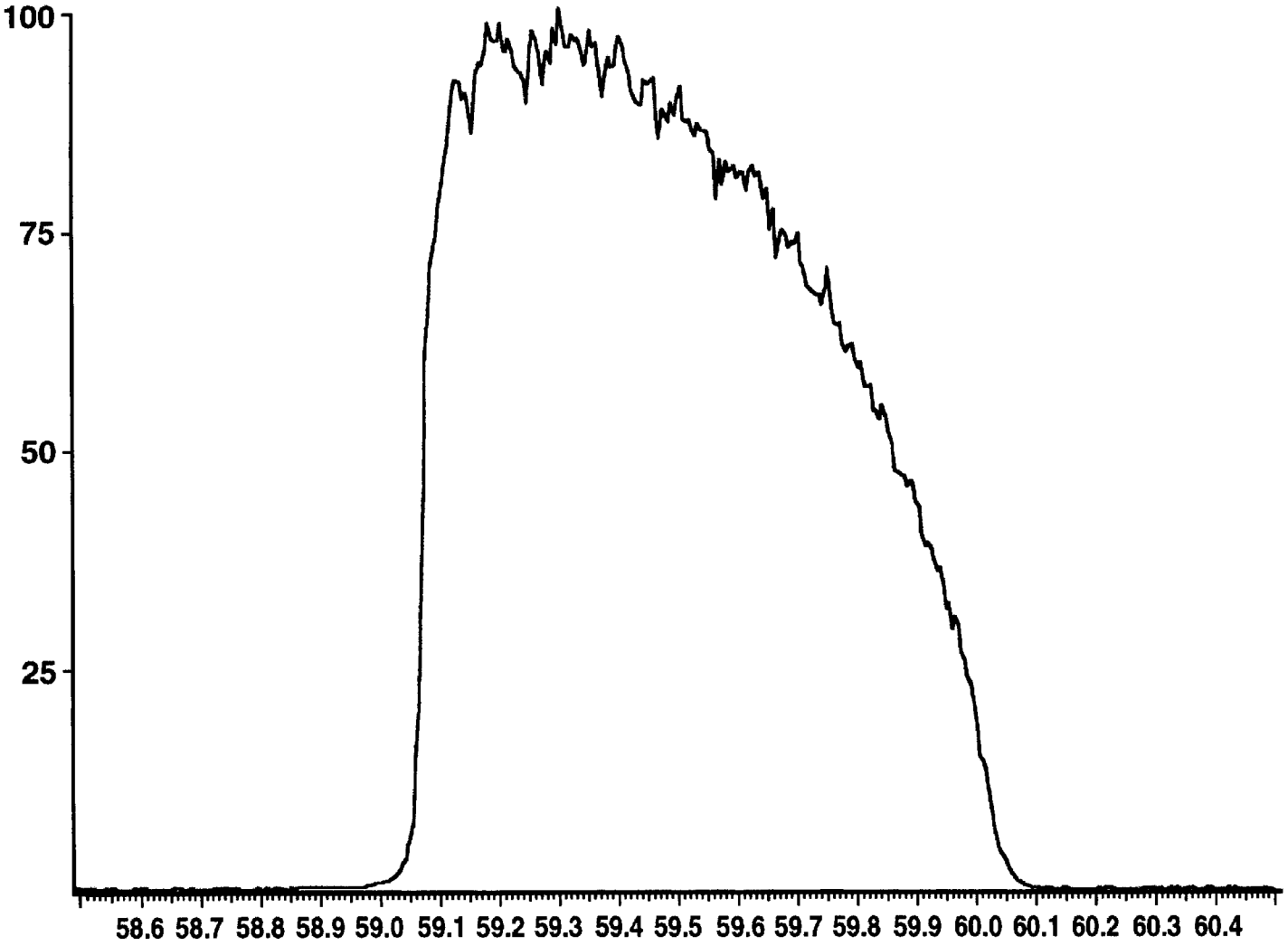
Figure 14C:
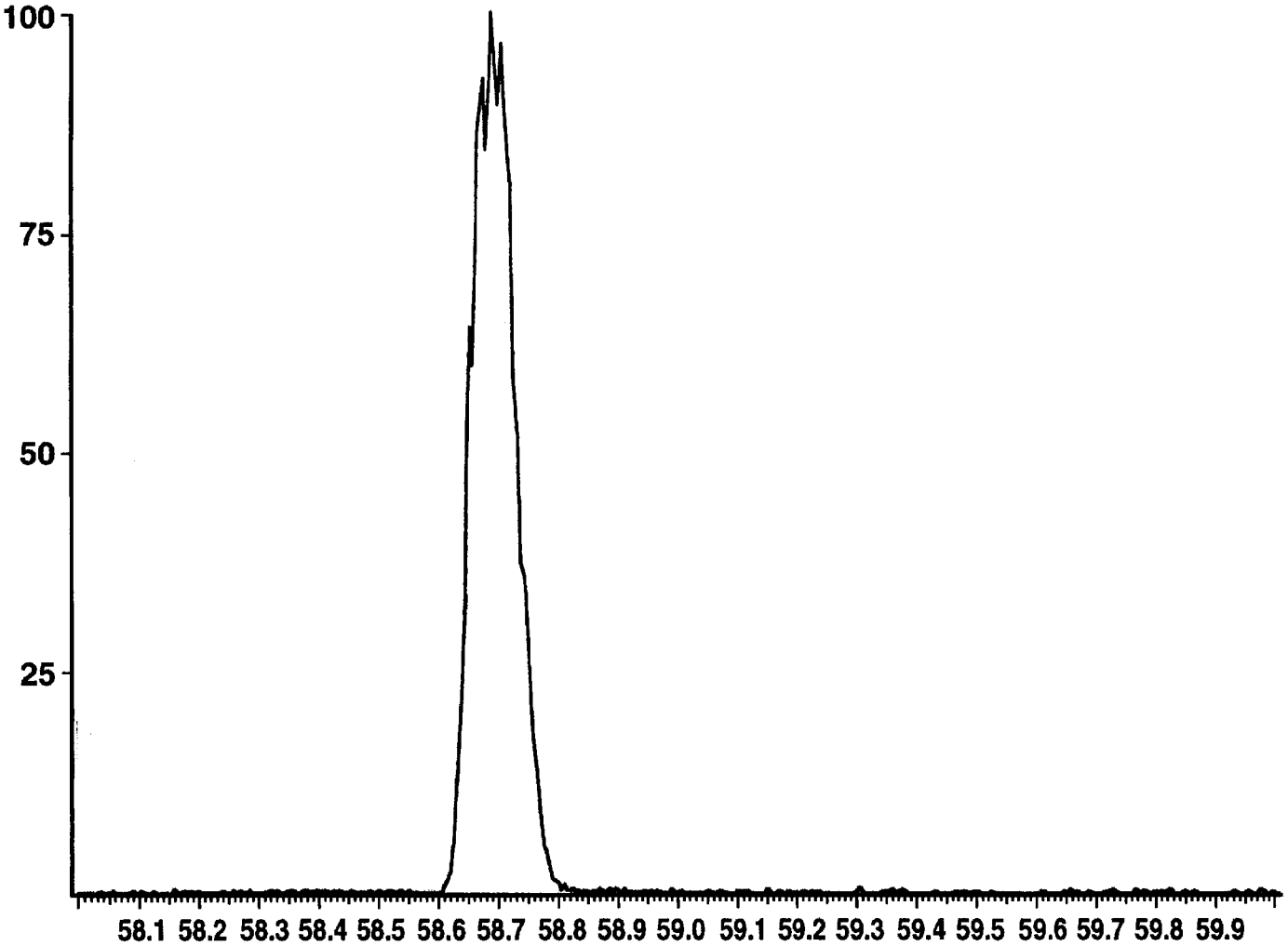
Figure 14D:
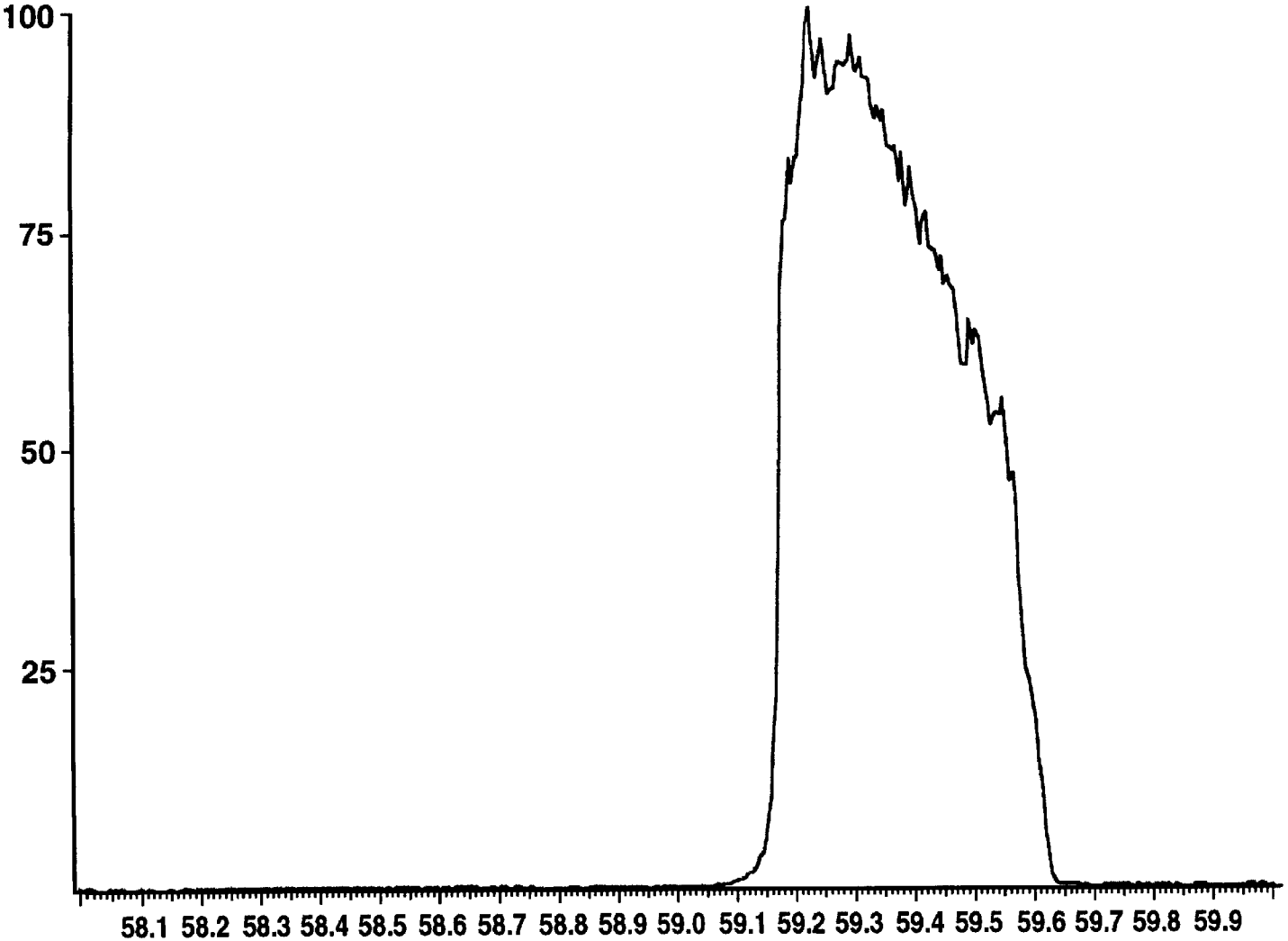
FIG. 14*d* shows the peak shape obtained by scanning the two quadrupoles simultaneously, with the first quadrupole scanned at the upper tip of the third stability region and the second quadrupole scanned at the lower tip of the third stability region and with the second quadrupole set 0.1 m/e lower than the first quadrupole.
Figure 15A:
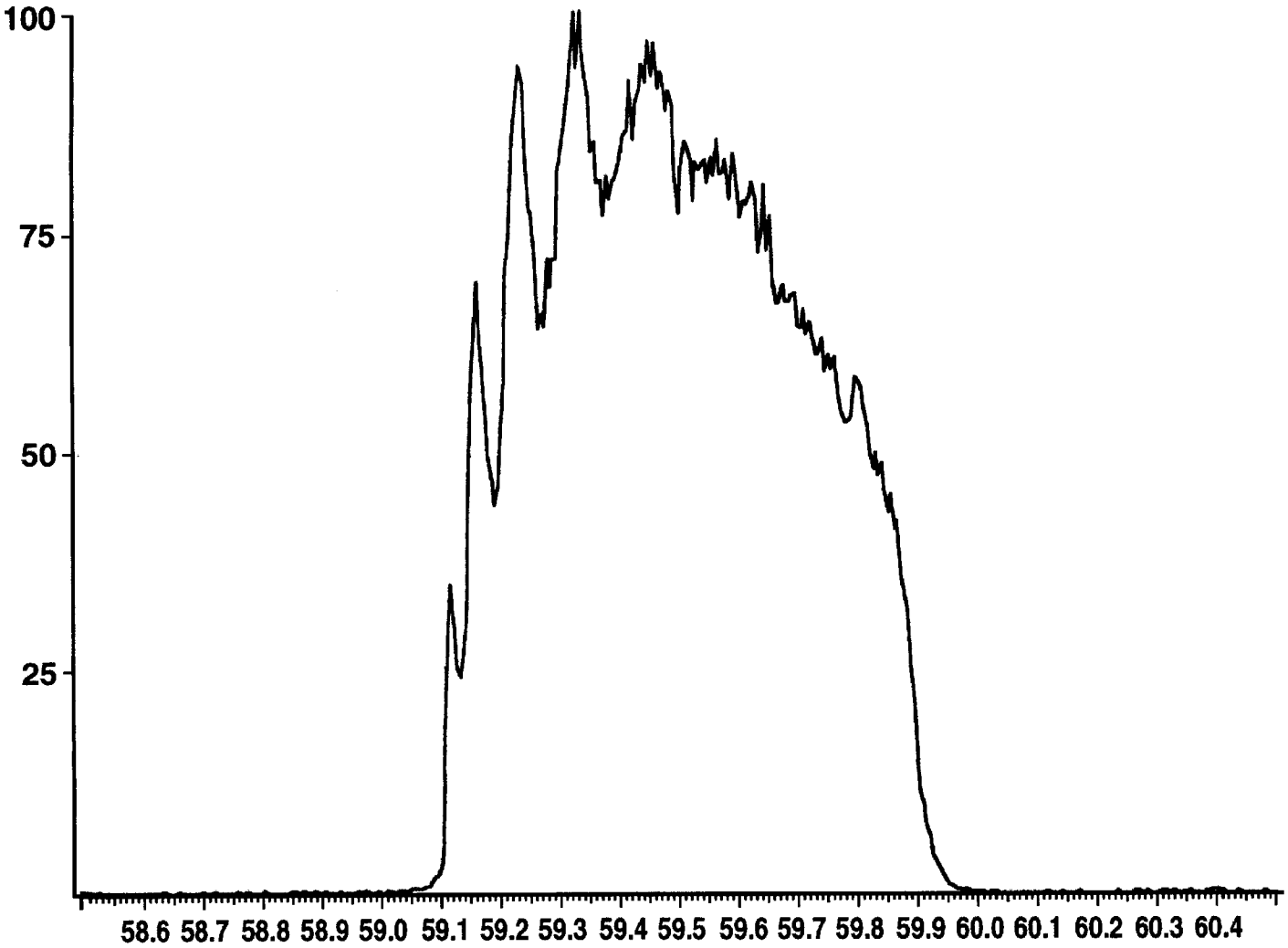
FIGS. 15*a*, 15*b* and 15*c* show, respectively, peak shapes obtained with the first quadrupole scanned at the lower tip of the third stability region, the second quadrupole scanned at the upper tip of the third stability region and for both quadrupoles, with the second quadrupole scanned 1.2 m/e lower than the first quadrupole.
Figure 15B:
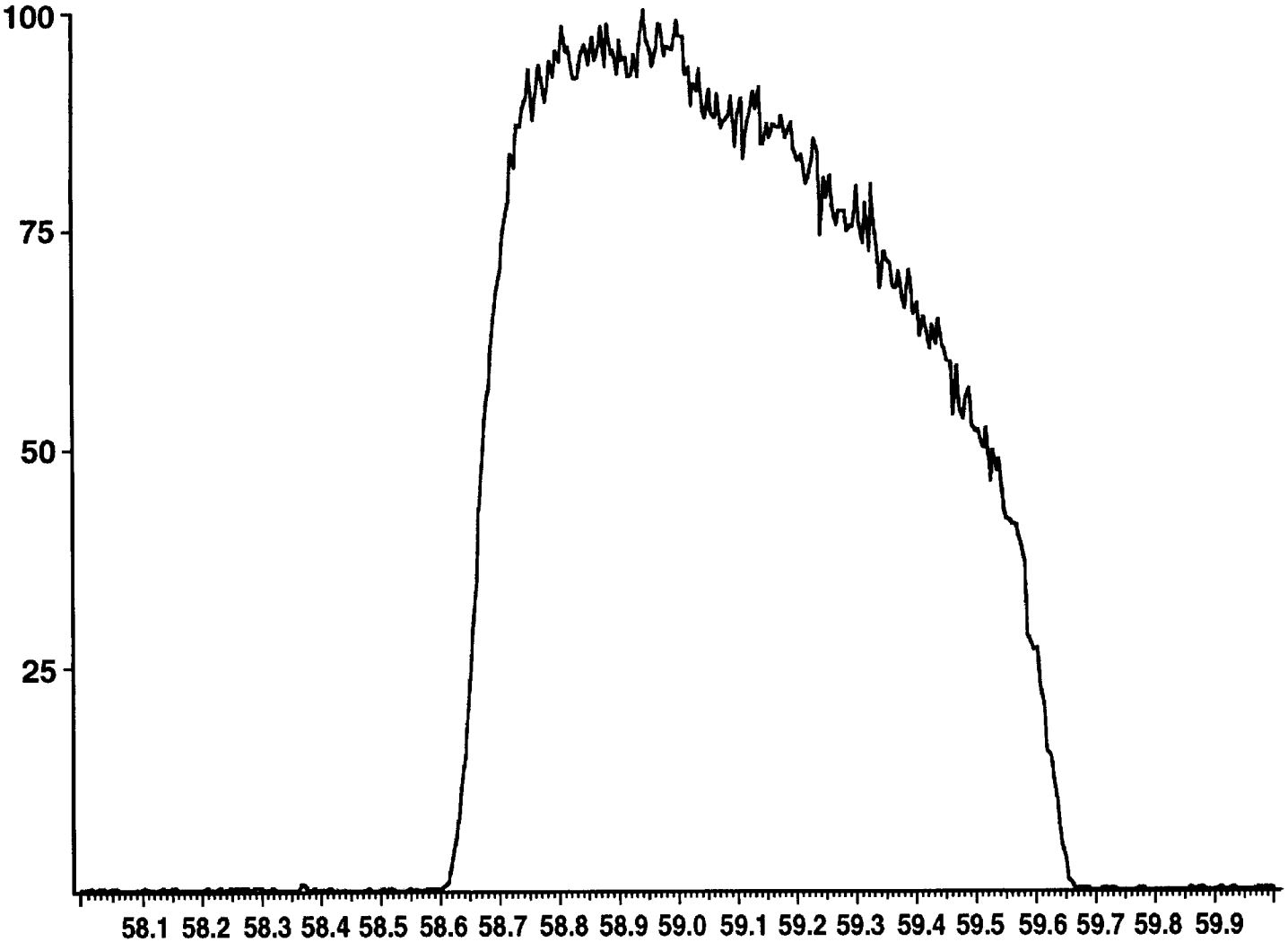
Figure 15C:
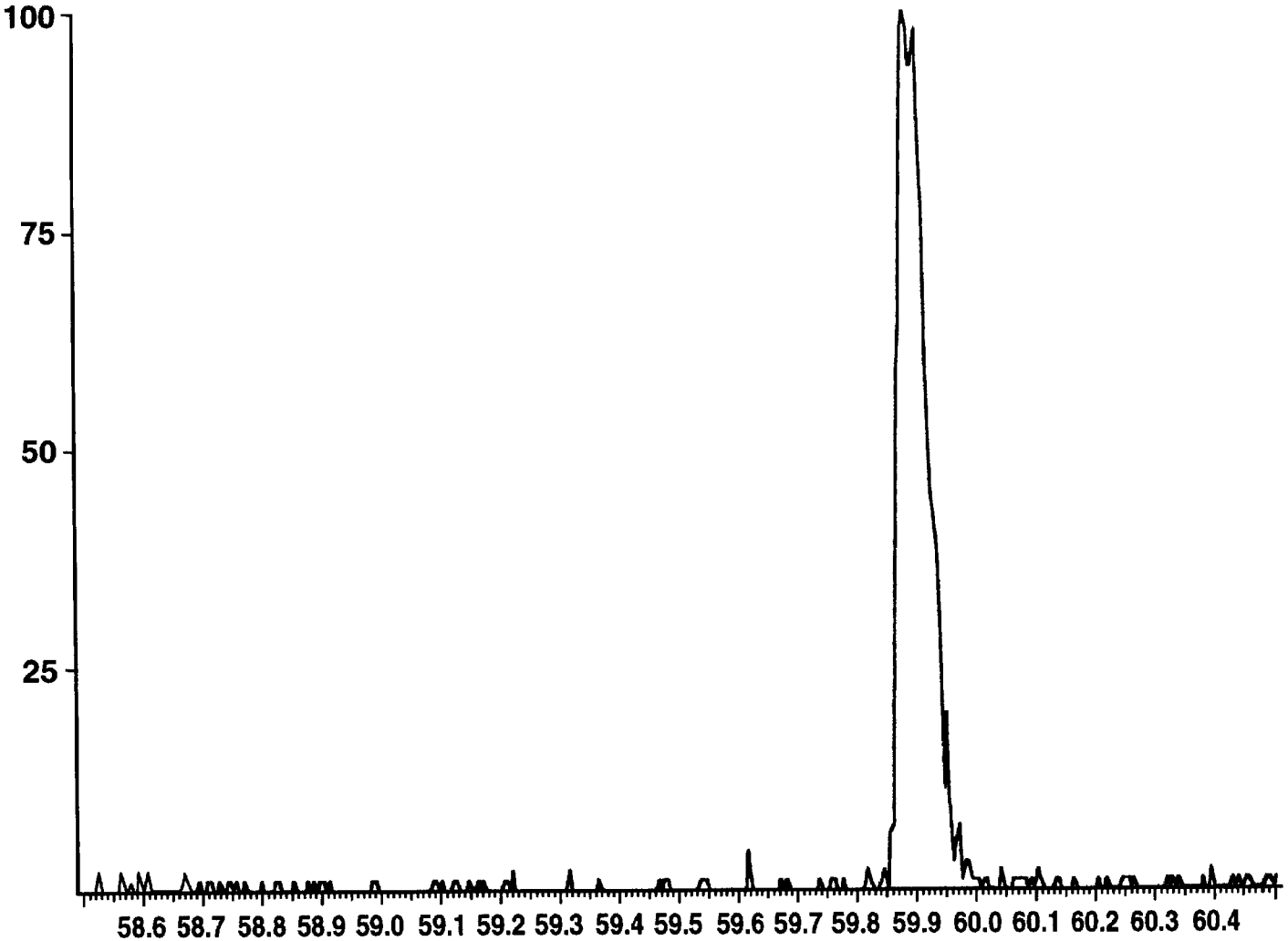
Figure 15D:
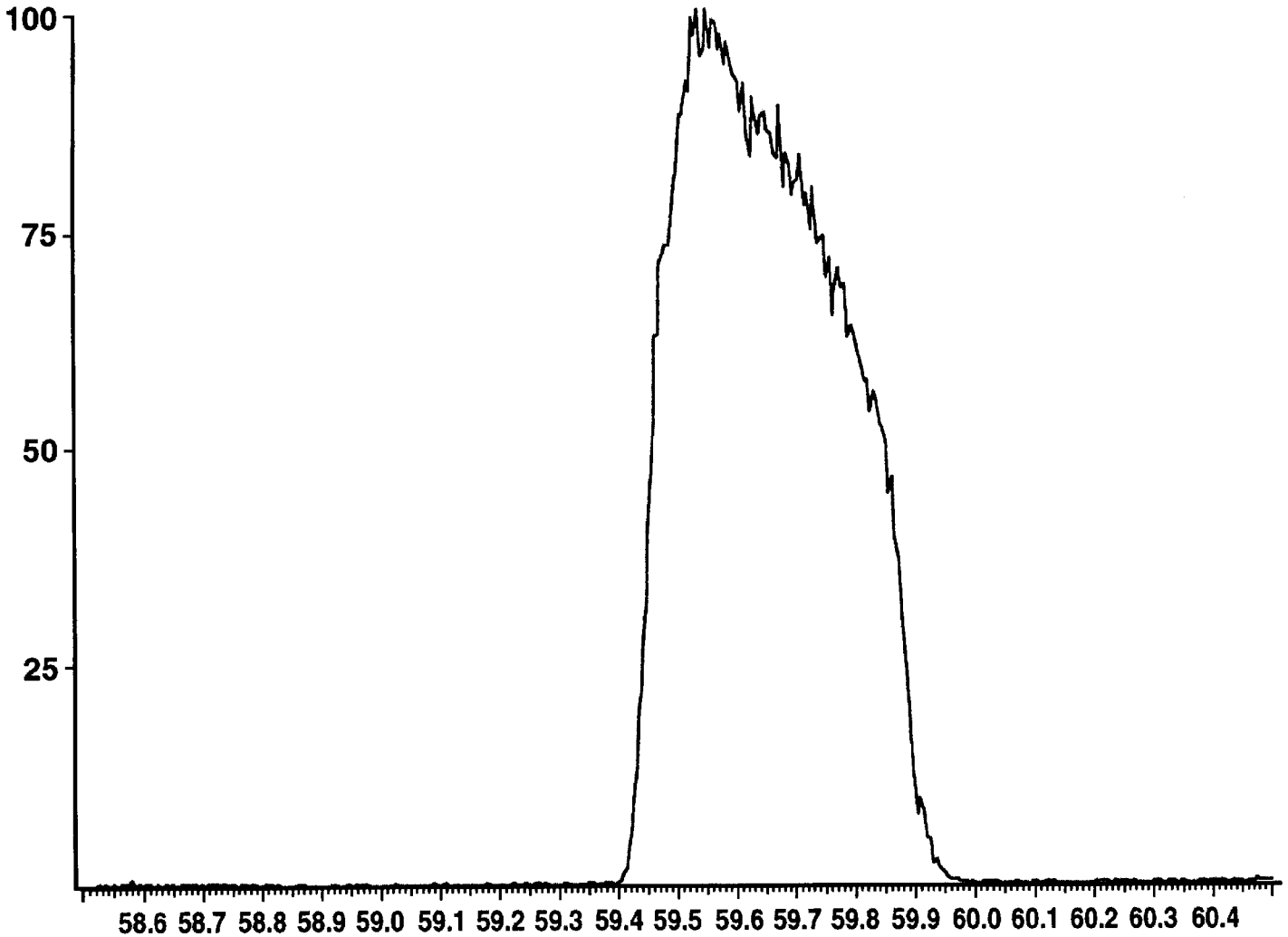
FIG. 15*d* shows a scan similar to FIG. 15*c* and the peak shape obtained with the second quadrupole scanned 0.8 m/e lower than the first quadrupole.
Figure 16A:
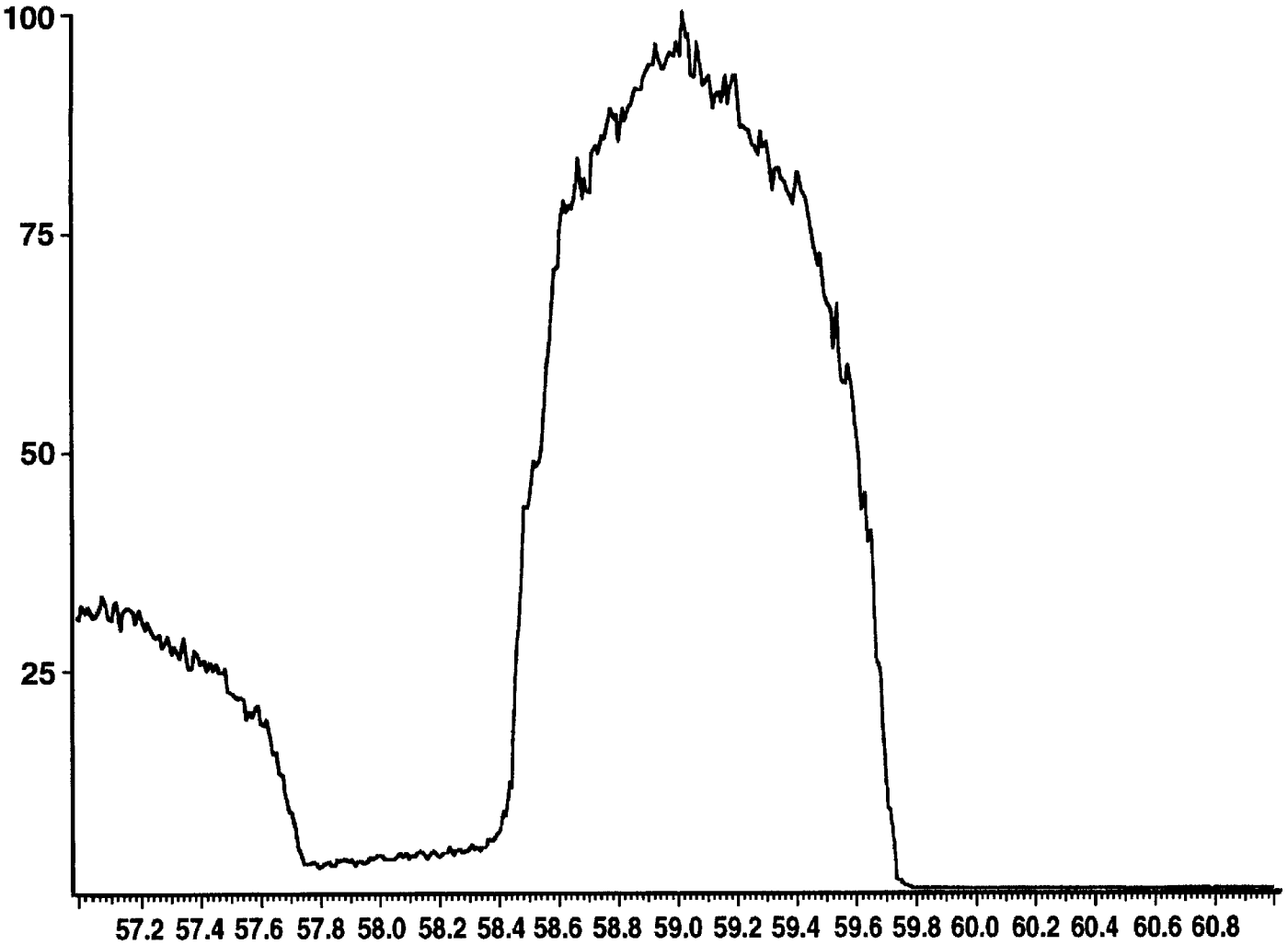
FIG. 16*a*, 16*b*, and 16*c* show peak shapes obtained in the first stability region, the figures showing respectively a peak at the tip of the first stability region in the first quadrupole rod set, the peak at the tip of the first stability region of the second quadrupole rod set, and the peak shape obtained by simultaneous scanning through both quadrupole rod sets with the second quadrupole set 1.3 m/e higher than the first quadrupole rod set.
Figure 16B:
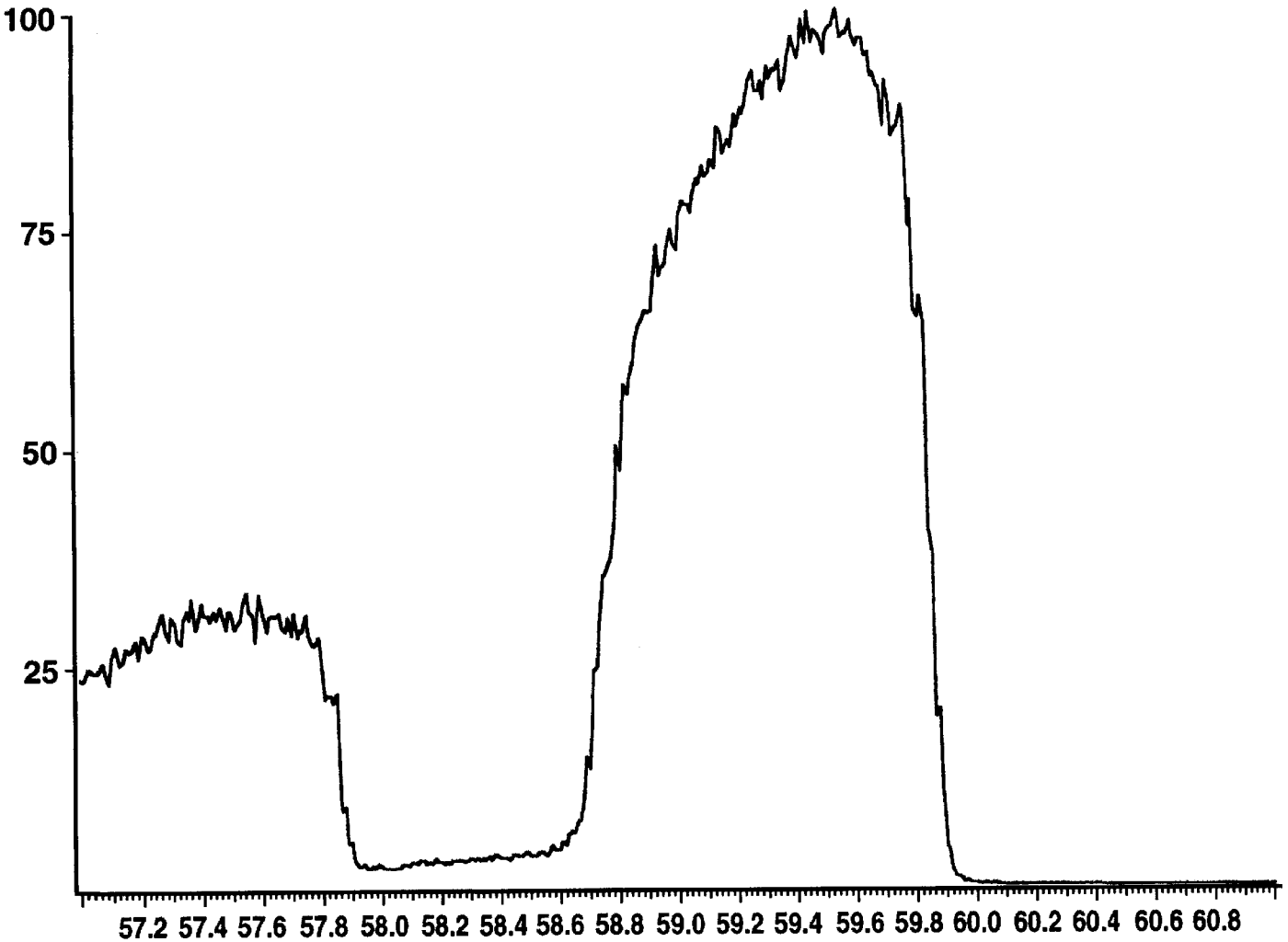
Figure 16C:
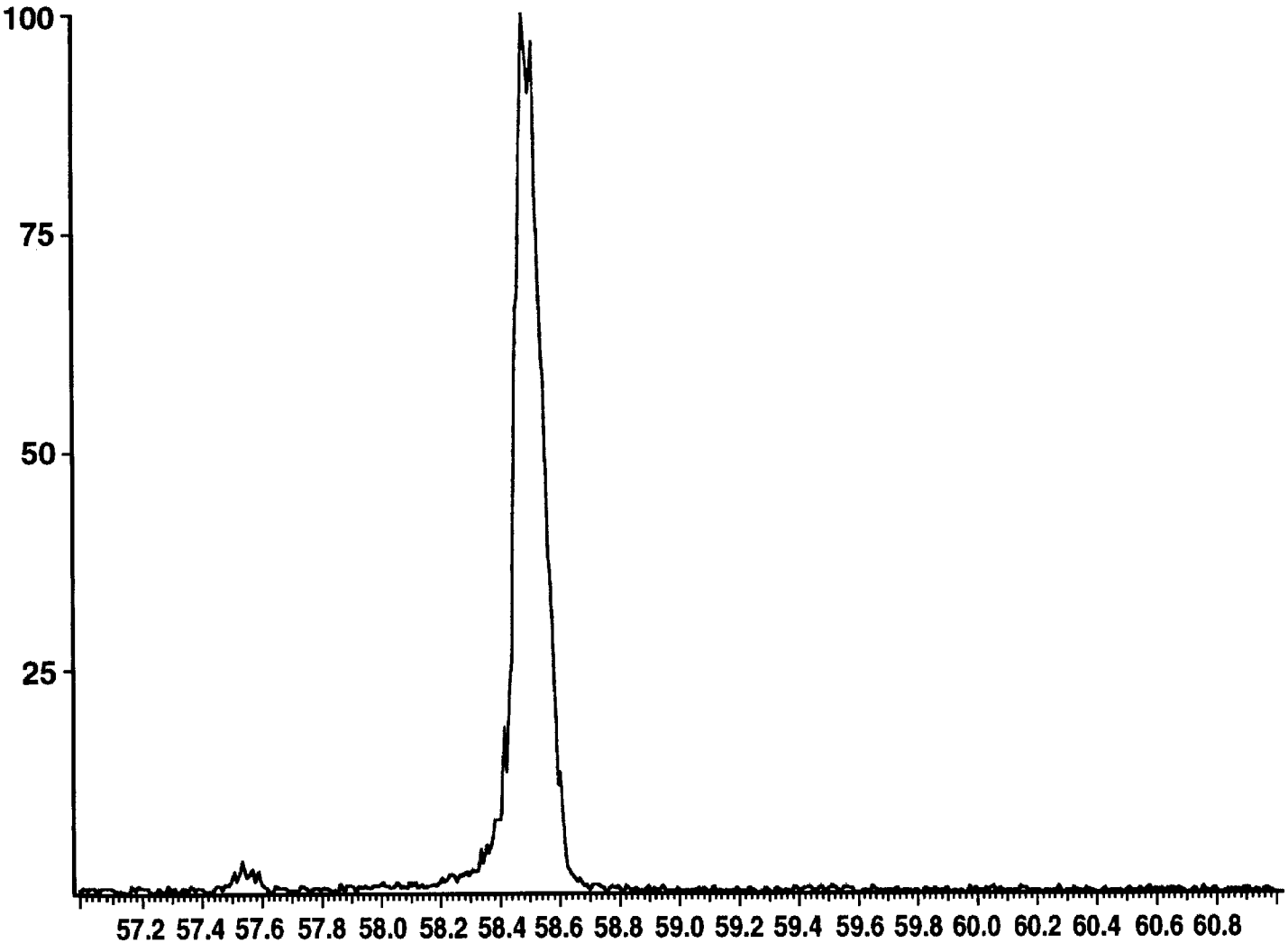
Figure 16D:
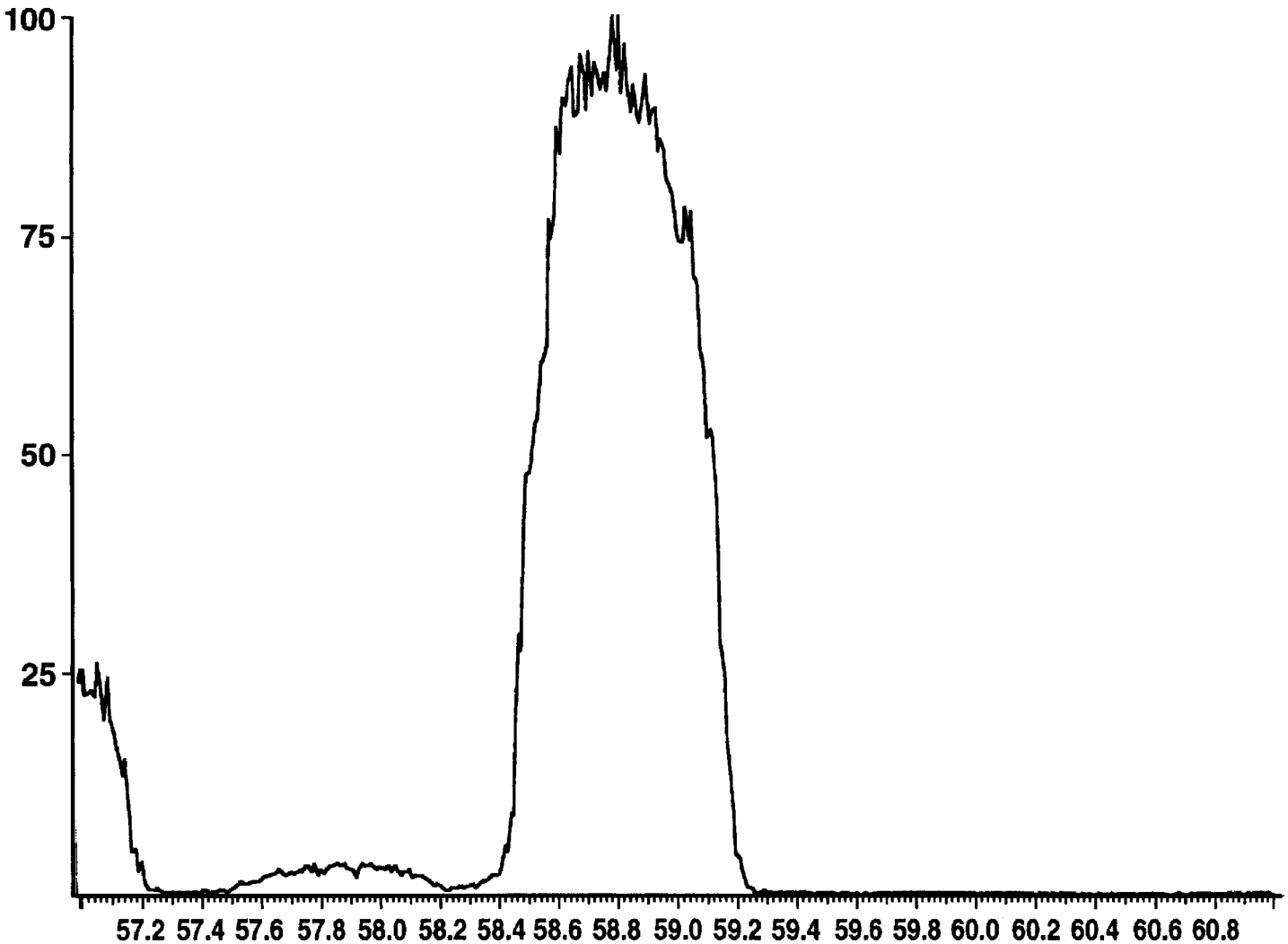
FIG. 16*d* shows a scan similar to FIG. 16*c* and the peak shape obtained with scanning both quadrupole rod sets with the second quadrupole set 0.7 m/e higher than the first quadrupole rod set.

FIG. 14*a* shows the peak shape obtained with operation at the upper tip of the third stability region in Q1, i.e. as in FIG. 3*a*. Here the ion energy in Q1 was ca. 8 eV and Q1 was operated at low resolution. For these reasons the pronounced peak tailing of FIGS. 4*a*, 4*b* (120 eV ion energy) is absent. FIG. 14*b* shows the peak shape of Q2 obtained at the lower tip of the third stability region, i.e. as in FIG. 3*b*. Again, the ion energy in Q2 was 8 eV (in contrast to FIGS. 5*a*, 5*b* where the ion energy was 110 eV) and Q2 was operated at low resolution. For these reasons the pronounced peak tailing of FIGS. 5*a*, 5*b* is absent. FIG. 14*c* shows the peak shape obtained by scanning Q1 and Q2 simultaneously with a mass shift of −1.3 m/e. The horizontal axis of FIG. 14*c* is labelled with the m/e setting of Q1. Q2 scans at a higher m/e value so that for any m/e value for Q1 or FIG. 14*a*, the equivalent transmission through Q2 on FIG. 14*b* can be found at that m/e value plus 1.3, i.e. the transmission at 58.7 m/e on FIG. 14*a* corresponds to an m/e of 60.0 on FIG. 14*b*. That is, the m/e setting of Q2 was 1.3 units higher than that of Q1. It is seen that the peak is considerably narrower than the peak from either Q1 or Q2 by itself. FIG. 14*d* shows the peak shape obtained by scanning Q1 and Q2 simultaneously but with Q2 set 0.1 m/e lower than Q1 (offset +0.1 m/e). Again the horizontal axis is labelled with the m/e setting of Q1. The peak is narrower than that of Q1 or Q2 but broader than that of FIG. 14*c*. This demonstrates that the resolution of the tandem analyzer can be changed by changing the mass offset between the two quadrupoles while maintaining the same low resolution in each quadrupole, as discussed above.

A second example is given in FIG. 15. FIG. 15*a* shows the peak shape obtained with Q1 scanned at the lower tip of the third stability region (FIG. 3*b*) and FIG. 15*b* the peak shape obtained by scanning Q2 at the upper tip of the third region (FIG. 3*a*). FIG. 15*c* shows the peak shape obtained with Q2 scanned 1.2 m/e lower than Q1. Again, the peak shape is considerably narrower than that of either Q1 or Q2 alone. FIG. 15*d* shows the peak shape obtained with Q2 scanned 0.8 m/e lower than Q1. The peak is narrower than that of either Q1 or Q2 but broader than that of FIG. 15*c* because the mass shift between the quadrupoles is less.

The invention is not limited to scanning the quadrupoles in the third stability region, although the ability to eliminate peak tails on both the high and low mass side of the peaks with operation in the third region is particularly attractive. The two quadrupoles can be scanned in any stability region or combination of stability regions, i.e. they do not both need to be operated in the same stability region.

Use of the first stability region is illustrated in FIG. 16. Thus, FIG. 16*a* shows the peak shape obtained with Q1 scanned in the conventional manner at the tip of the first stability region and FIG. 16*b* the peak shape obtained with Q2 scanned in the conventional manner at the tip of the first stability region. FIG. 16*c* shows the peak shape obtained by simultaneously scanning Q1 and Q2 with Q2 set 1.3 m/e higher than Q1. The horizontal axis in FIG. 16*c* is labelled with the m/e setting of Q1. Again, the resolution is greater than that of either Q1 or Q2. FIG. 16*d* shows the peak shape obtained with Q2 set 0.7 m/e higher than Q1. The horizontal axis in FIG. 16*d* is labelled with the m/e setting of Q1. The resolution is increased over that of Q1 or Q2 but less than that of FIG. 16*c* because the mass shift is less.

The detailed peak shape that is obtained from the tandem quadrupole mass analyzer will depend on the peak shapes of Q1 and Q2. This can depend on many factors such as rod quality, ion collection effects at the detector, ion energy, the manner in which ions are focussed into the quadrupole, the stability region used and which area or portion of the stability region is used. Nevertheless it is generally true that overlapping of broad peaks with a mass shift between Q1 and Q2 can improve the resolution over that of either Q1 and Q2. Generally, the resolution can be changed by changing the extent to which the peak of Q1 overlaps that of Q2, i.e. the mass shift between Q1 and Q2.

Figure 17:
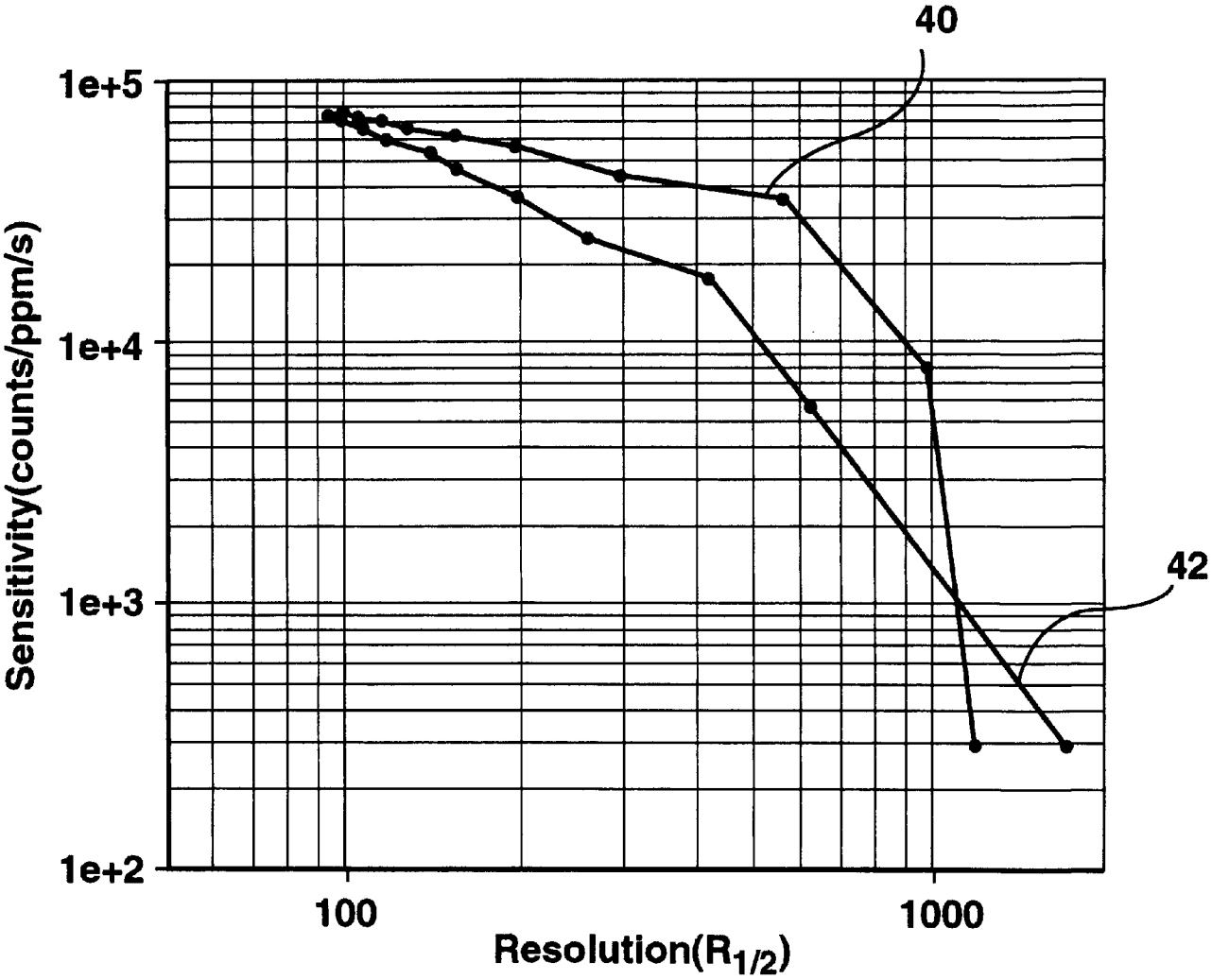
FIG. 17 is a graph showing variation of sensitivity with resolution with different mass offsets, where the first quadrupole is operated at the upper tip of the third stability region and the second quadrupole is operated at the lower tip of the third stability region.

The trade-off between resolution and transmission will depend on the details of the peak shapes of the individual analyzers. For the case where Q1 is operated at the upper tip of the third region and Q2 at the lower tip, the measured transmission vs. resolution is shown in FIG. 17. There are two curves because the resolution can be increased by scanning Q2 with a m/e setting either higher or lower than Q1. In FIG. 17, the upper curve 40 corresponds to a mass offset of the quadrupoles from +0.6 to −0.4 m/e, with −0.4 m/e giving the highest sensitivity and lowest resolution. The lower curve 42 corresponds to a mass offset of −0.5 to −1.4 m/e, with −1.4 m/e giving the highest resolution but lowest transmission. The two curves 40, 42 can be thought of as a single curve for mass shifts from +0.6 to −1.4 m/e. In this case because of the peak shapes and calibrations of Q1 and Q2 the maximum sensitivity and lowest resolution occurs for a mass shift around −0.4 m/e.

Figure 18:
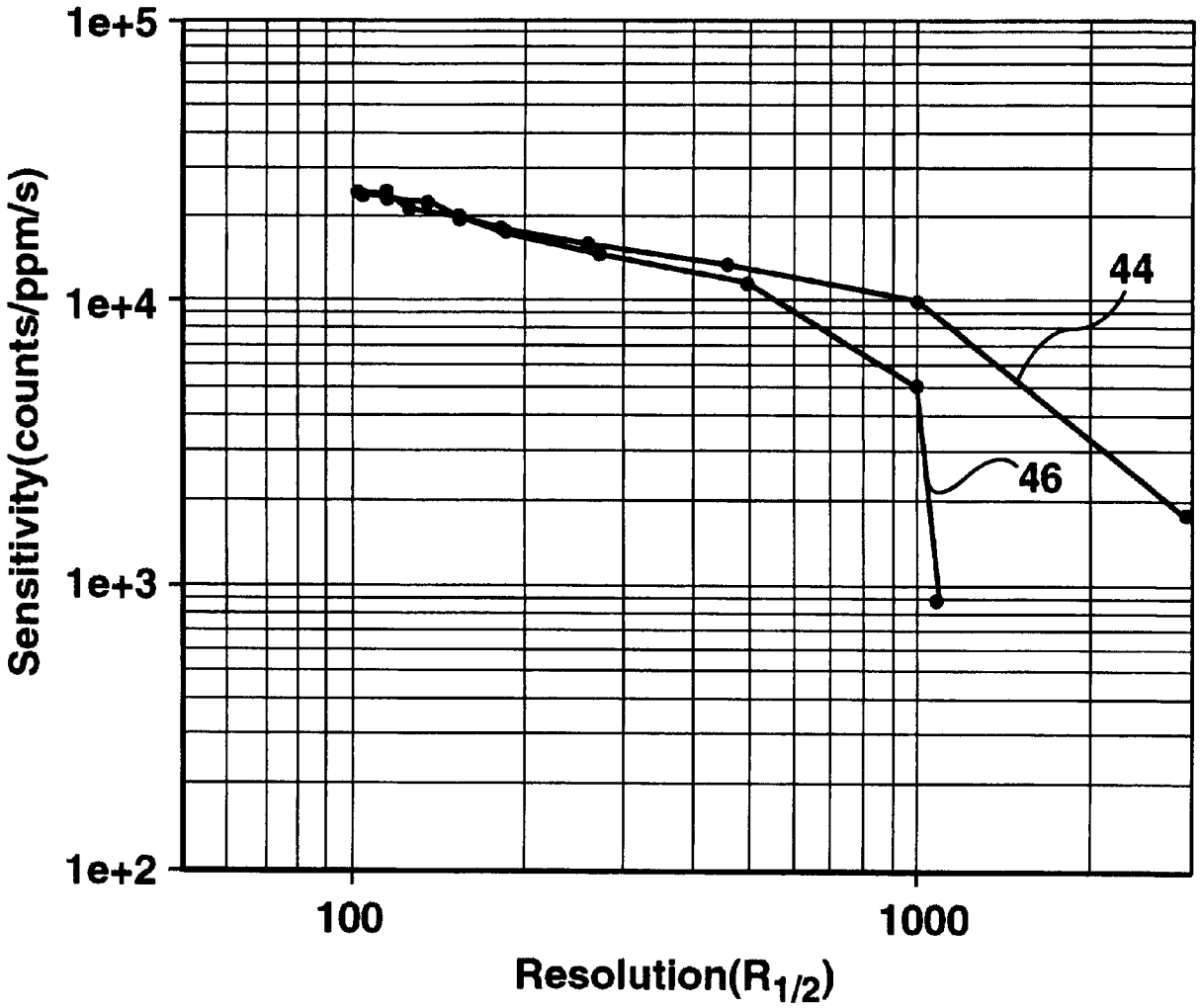
FIG. 18 is a graph showing variation of sensitivity with resolution, where the first quadrupole is operated at the lower tip of the third stability region and the second quadrupole is operated at the upper tip of the third stability region.

FIG. 18 shows transmission vs. resolution for the case where Q1 is operated at the lower tip of the third region and Q2 is operated at the upper tip. Again, there are two curves because Q2 can scan either higher or lower in mass than Q1. In this case there is little difference between the curves for $R_{1/2}$ less than about 500. The upper curve 44 in FIG. 18 corresponds to a mass shift from +0.5 to +1.2 m/e with +1.2 giving the lowest transmission at $R_{1/2}$1000.

Figure 19:
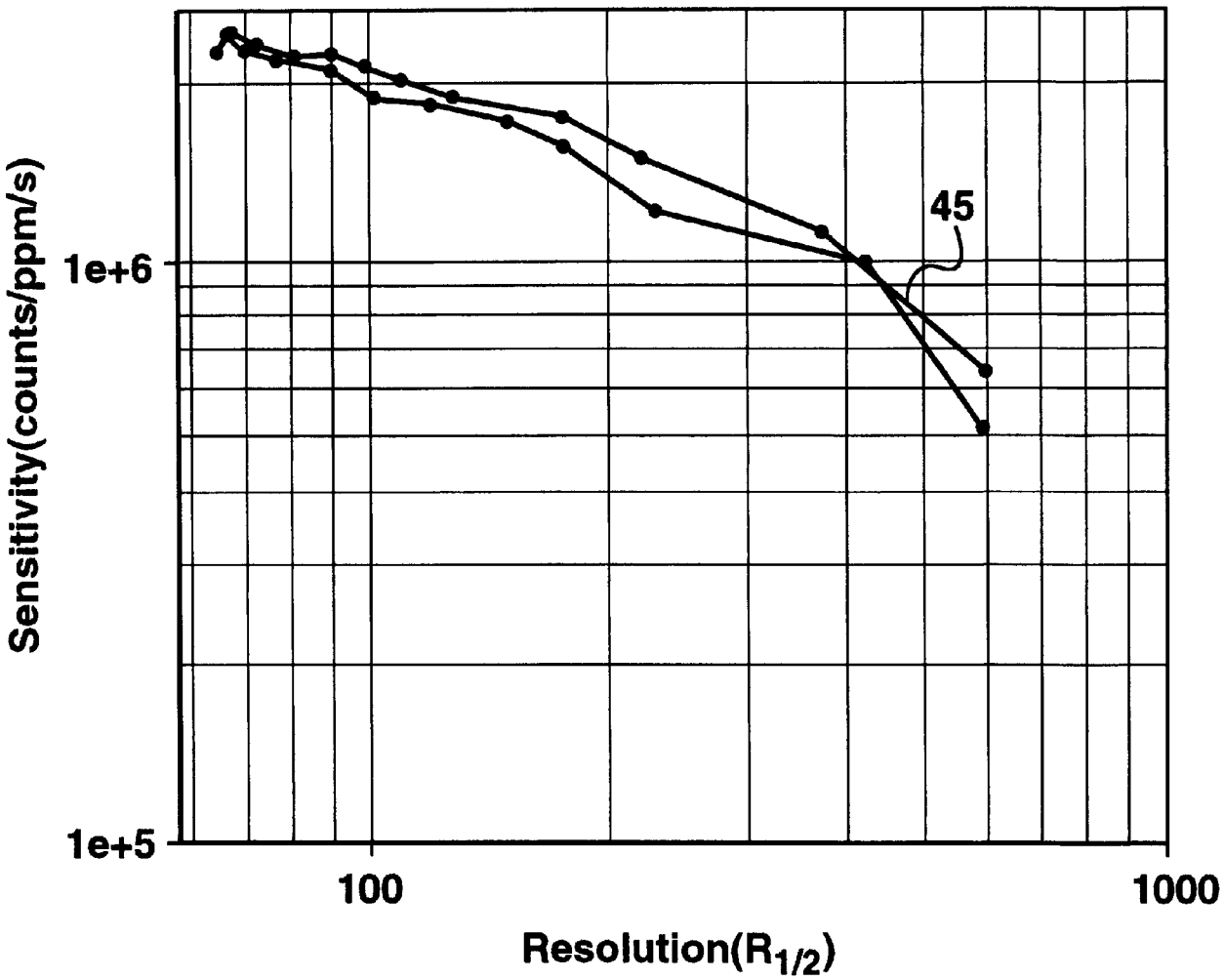
FIG. 19 is a graph showing variation of the transmission with resolution, where both quadrupoles were operated in the first stability region.

FIG. 19 shows transmission vs. resolution for the case where Q1 and Q2 were both operated in the first stability region. Here the two curves are similar, as might be expected and are indicated at 45, and operation with Q2 set either higher or lower than Q1 gives similar transmission resolution curves. With conventional quadrupole operation, the resolution is changed by changing the ratio of DC voltage (U) to RF voltage (V) that is applied to the rod set, so as to change where the operating line intersects a stability region. Where this ratio is increased, i.e. the DC voltage is increased, this is generally accompanied by a decrease in sensitivity because the "acceptance" of the quadrupole decreases. The acceptance is the area of a region in phase space that contains positions, x, y and radial velocities that are transmitted by the quadrupole. As the resolution increases only ions closer to the quadrupole axis and with smaller radial velocities are transmitted and in general a smaller fraction of the ions incident on the quadrupole is transmitted. The extent to which the ion transmission decreases will depend on how well the ions are focused into the quadrupole acceptance.

Figure 20:
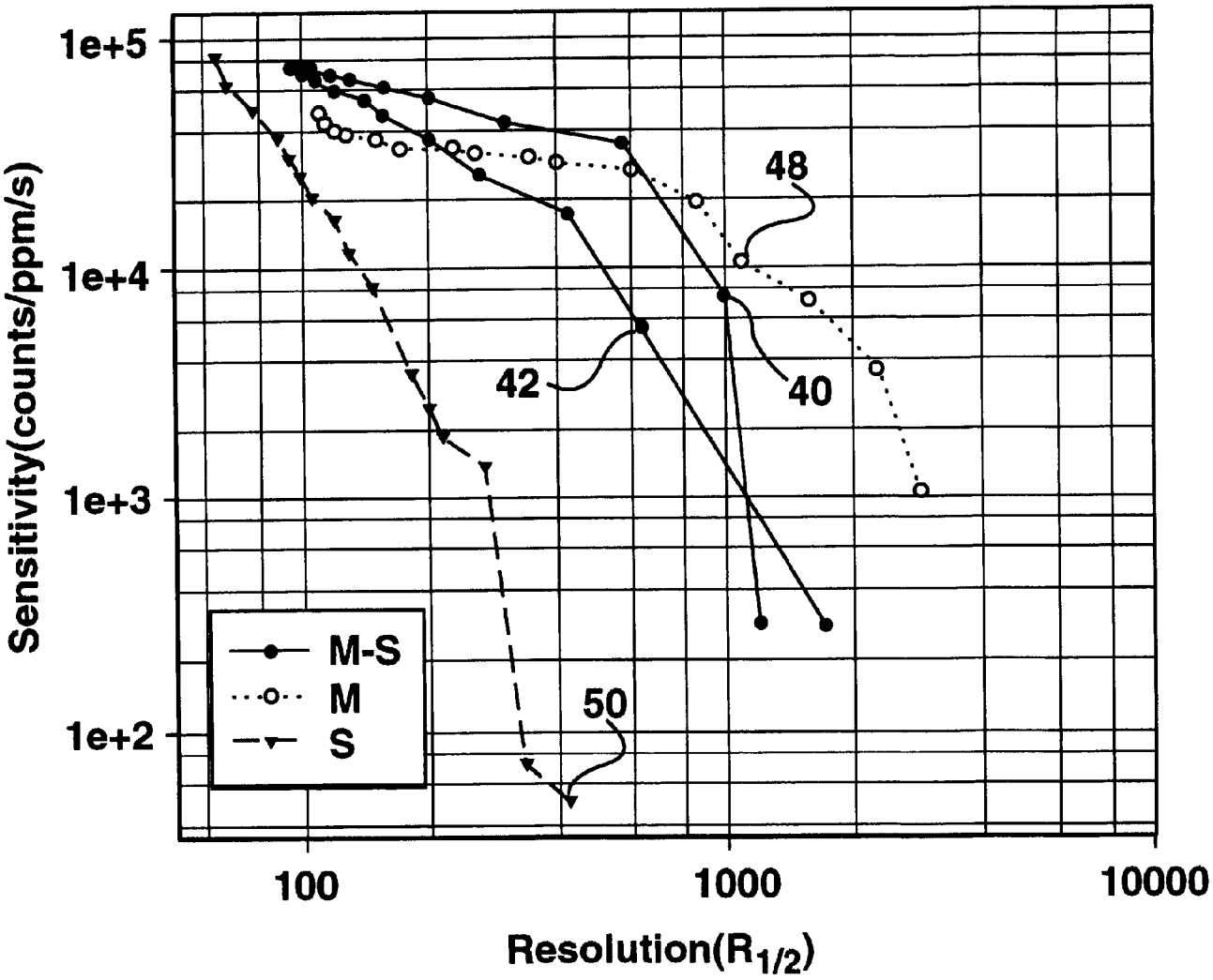
FIGS. 20 and 21 are graphs showing variation of transmission with resolution comparing operation in different modes at the upper and lower tips of the third stability region.

In FIG. 20 the transmission-resolution curves of the tandem analyzer are compared to that obtained by scanning Q1 alone in the third region with the resolution changed conventionally by changing the DC/RF voltage ratio. Here, the tandem analyzer was operated with Q1 at the upper tip of the third region and Q2 at the lower tip of the third region and the data for the tandem analyzer are the same as those of FIG. 17, as indicated again at 40, 42. There is also shown operation of the first quadrupole Q1, by itself (i.e. with Q2 removed) at the upper tip (curve 48) and lower tip (curve 50) of the third stability region. The ion measured was $Co^+$ at m/e 59. It is seen that for $R_{1/2}$ less than about 400, the transmission of the tandem analyzer is somewhat higher than that of Q1 operated conventionally at the upper tip. The transmission of the tandem analyzer is also much greater than that of Q1 operated at the lower tip.

Figure 21:
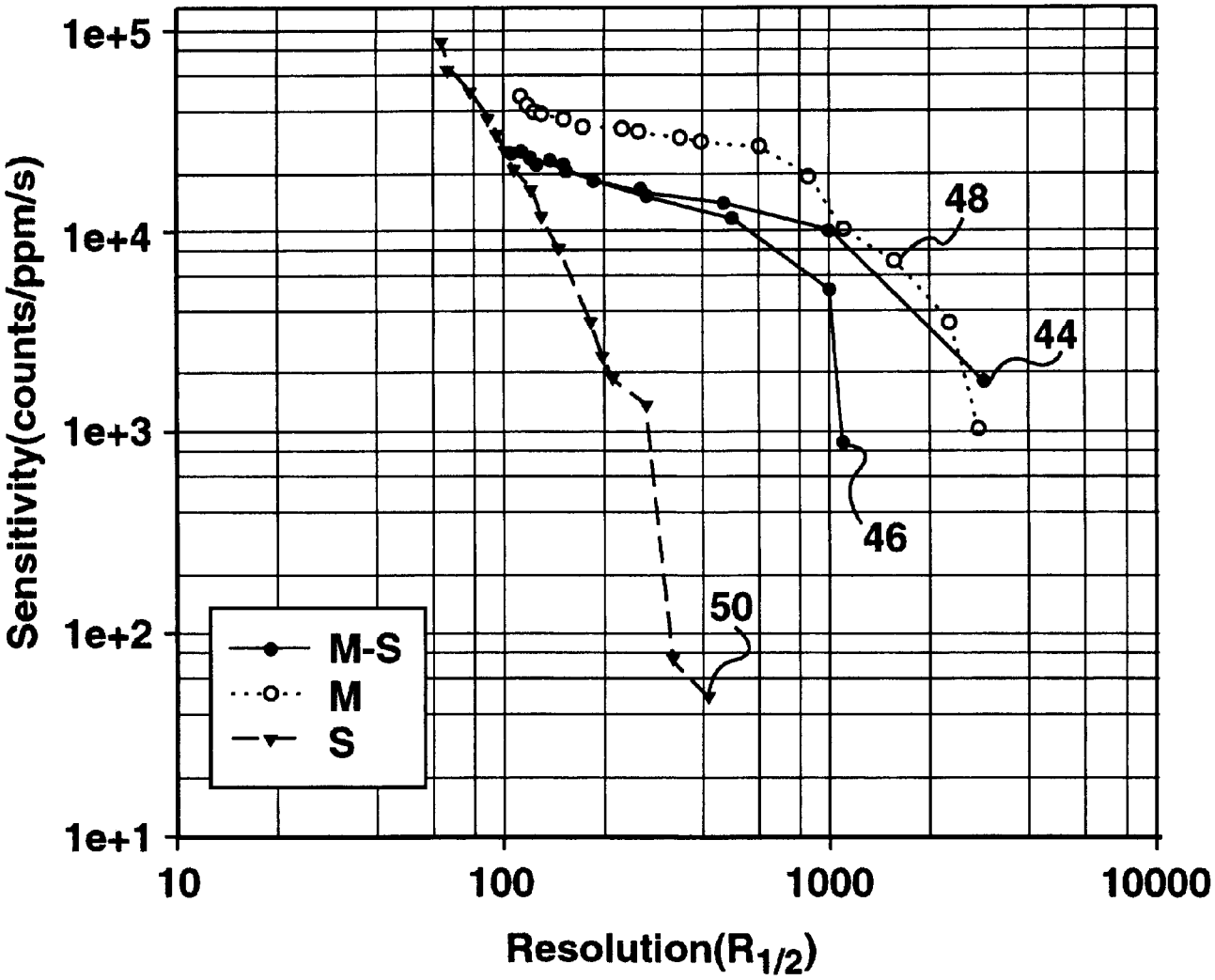

FIG. 21 shows a similar comparison, but here the tandem analyzer was operated with Q1 at the lower tip of the third stability region, and Q2 at the upper tip of the third stability region. The data for the tandem analyzer are the same as those of FIG. 18, as indicated again at 44, 46. As for FIG. 20, there is also shown operation of the first quadrupole Q1, by itself, at 48 and 50. In this case the transmission of the tandem analyzer is intermediate between that of Q1 operated at the lower and upper tips of the third stability region.

Figure 22:
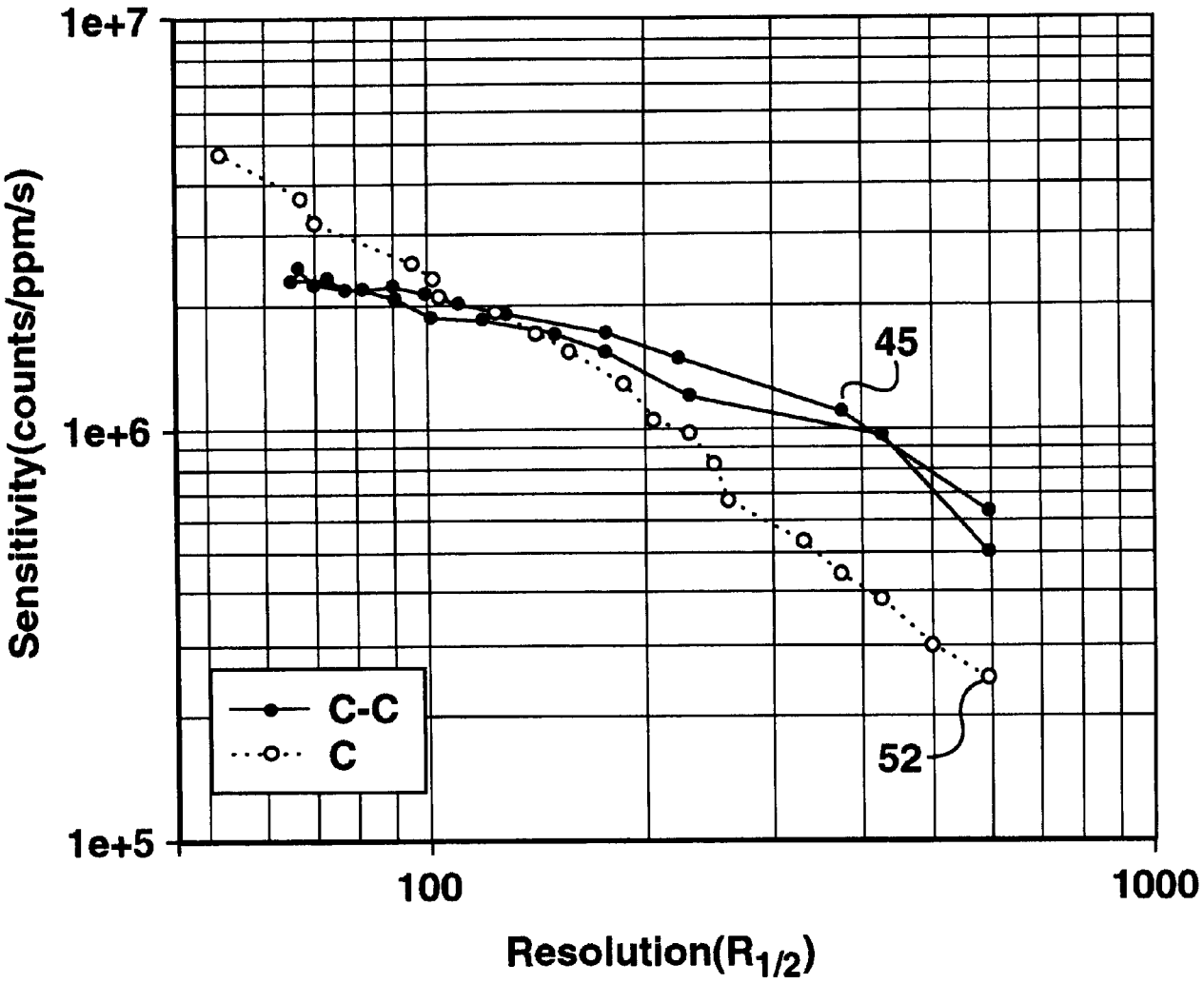
FIG. 22 is a graph showing the variation of sensitivity with resolution for different modes of operation in the first stability region.

FIG. 22 shows a comparison of the transmission vs. resolution of the tandem analyzer with the Q1 operated conventionally in the first stability region. Here the tandem analyzer was operated with Q1 and Q2 in the first stability region, again indicated at 45. Transmission of the first quadrupole Q1, alone, is indicated at 52, and for these data the second quadrupole Q2 is operated as a transmission device in an RF only mode. In this case the transmission of the tandem analyzer is less at lower resolution. However, the transmission of the tandem analyzer decreases less rapidly as the resolution is increased. At $R_{1/2}$=500 the transmission of the tandem analyzer is more than twice that of Q1 operated conventionally. Further increases to the sensitivity of the tandem mass analyzer are described in the next section on phase shifting.

The reason that the transmission of the tandem analyzer can be higher than a single analyzer is that each quadrupole is operated at low resolution. Thus, the acceptance of each analyzer can be larger and a larger fraction of the ions incident on the tandem analyzer can be transmitted. However the extent to which the sensitivity is higher will depend on how well the ion source matches the quadrupole acceptance and the exact operation points in the stability diagrams.

Figure 23:
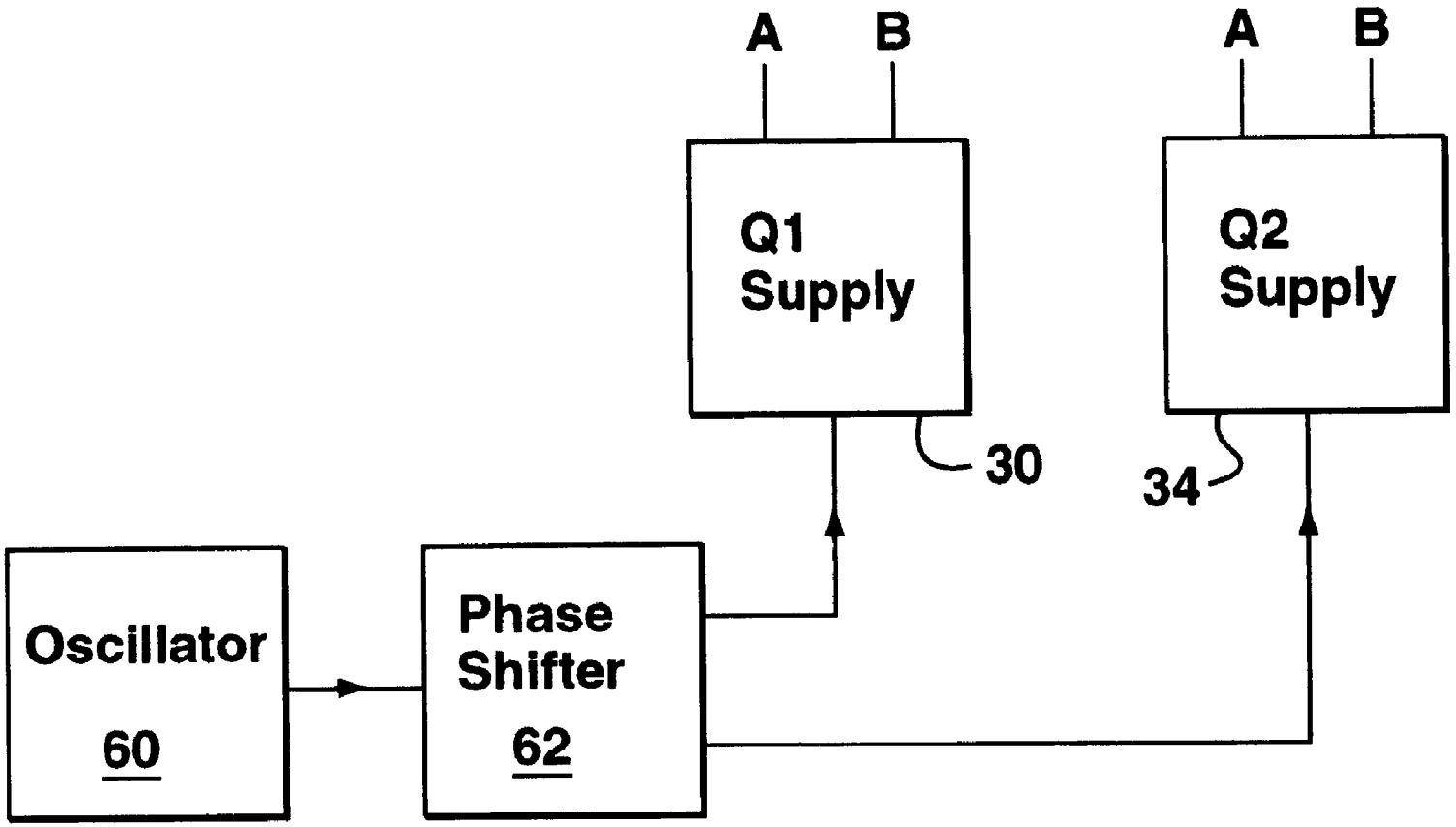
FIG. 23 is a schematic view of a power supply for two tandem quadrupoles, including a phase shifter.

All of the above data were obtained with the quadrupoles operated at the same frequency and phase locked with no phase shift between the quadrupoles. However, the inventors have discovered that the transmission of the tandem analyzer can be increased if a controlled phase shift is introduced between the quadrupoles. The apparatus of FIG. 23 was used. The output of a single oscillator 60 was fed to a phase shift generator 62 which had two outputs. These outputs were connected to the external drive inputs 29*a*, 39*a* of the power supplies for the two quadrupoles. The phase shifter 62 allows a variable phase shift of −100° to +100° to be introduced between the two outputs. The transmission of the tandem analyzer was then measured for different phase shifts between Q1 and Q2. The transmission was found to vary with phase in a manner that depends on the stability regions of the quadrupoles and their mass offset. However, it was generally found that the transmission varied strongly with phase shift. Moreover, it was found that often there is a relatively narrow band of phases or phase shifts that will give good transmission. This can only be discovered by measuring the transmission or sensitivity at a large number of operating conditions, with phase shifts that vary from one another only by small angles.

Figure 24:
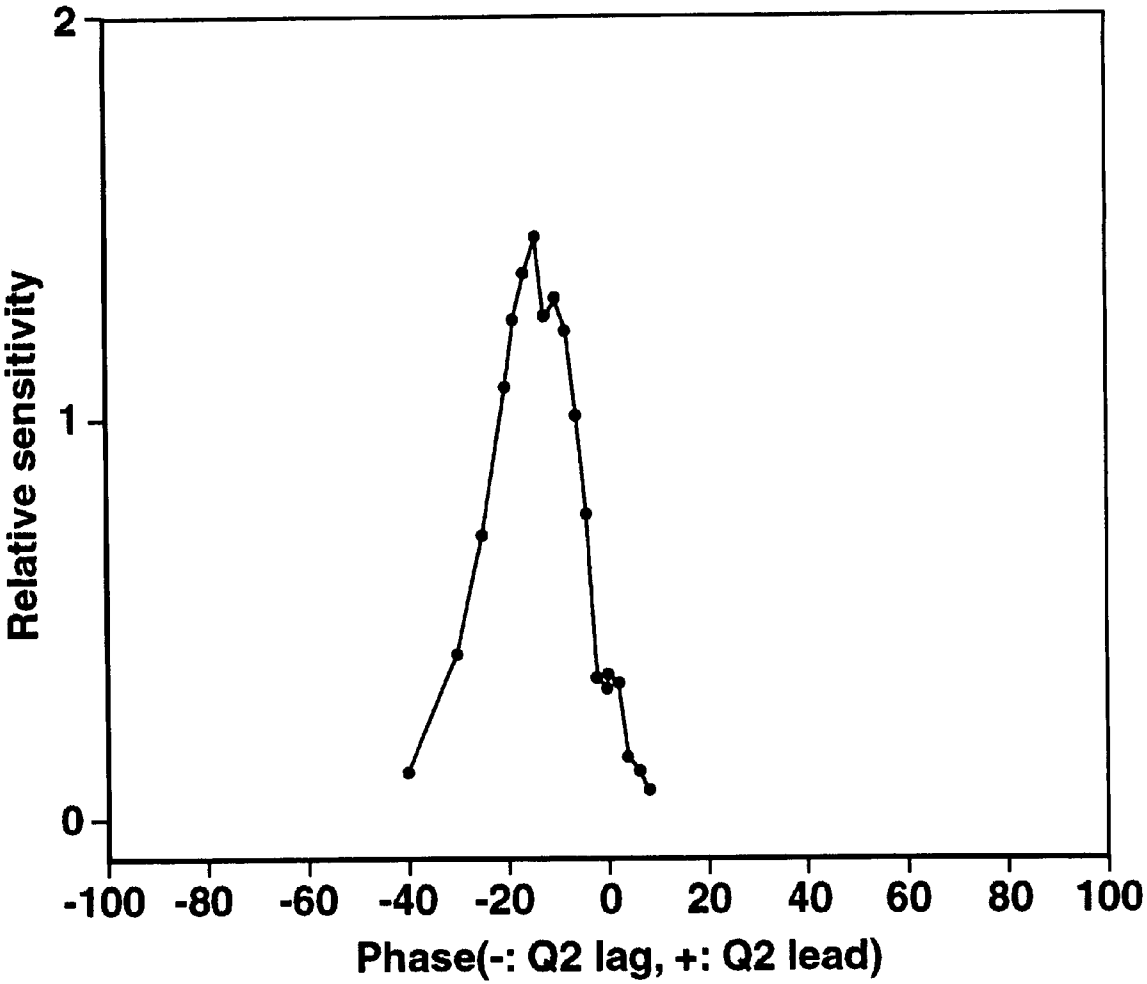
FIG. 24 is a graph showing the variation of relative sensitivity with phase shift between the two quadrupoles, operated in a selected mode in the third stability region.

FIG. 24 for example shows the variation of sensitivity or transmission with the phase shift applied between Q1 and Q2 in degrees. Here a negative number means the RF of Q2 lags Q1. The sensitivity was measured with the phase shifter 62 removed, that is with Q1 and Q2 both driven directly from the oscillator 60. The sensitivity obtained with the phase shifter in the circuit was then normalized to this sensitivity. In FIG. 24 the sensitivity with a phase shift of zero degrees is lower than with no phase shifter installed. This was unexpected. To restore the sensitivity to that without the phase shifter required introducing a small phase shift of ca. −6°, as a correction or adjustment factor. It is believed that this may be due to a small uncontrolled phase shift in the connections between the phase shifter and quadrupole power supplies. For FIG. 24, the tandem analyzer was operated with Q1 at the upper tip of the third region and Q2 at the lower tip. A mass offset of −0.4 m/e was introduced between Q1 and Q2 such that $R_{1/2}$ of the tandem analyzer was 750 for $Co^+$ m/e=59 ions. FIG. 24 shows that the ion transmission depends strongly on the phase shift. There is a narrow range of phases near −14° where the transmission is optimum and about 40% greater than the transmission without a phase shift. If a correction factor is included, this corresponds to an additional phase shift of about 8° beyond that which gave transmission equal to having no phase shifter connected. i.e. use of the phase shifter increased the transmission by about 40%.

Figure 25:
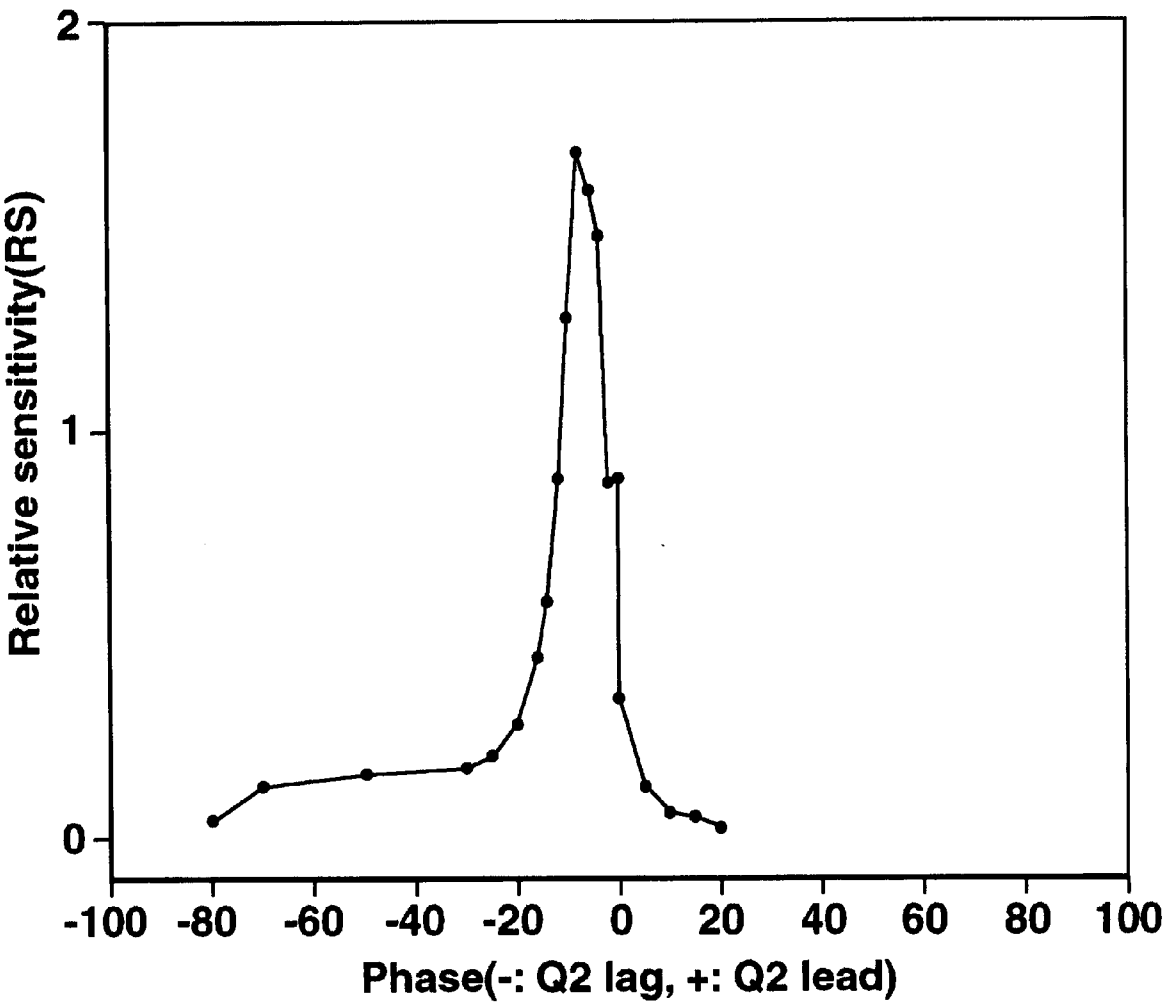
FIG. 25 is a curve showing the variation of relative sensitivity with phase shift between two quadrupoles, comparable to FIG. 24, at a different resolution.

FIG. 25 shows similar data, but here the mass shift of Q1 and Q2 was changed to −0.1 m/e so that $R_{1/2}$ of the tandem analyzer was 1500. In this case to restore the transmission to that without the phase shifter required introducing a correction factor of about −3°. Again, there is a dramatic dependence of the transmission on phase and the optimum transmission with the phase shifter connected is about 1.6 times that with no phase shifter. The optimum phase shift at this resolution is about −8°, or about −5° after correction to give a sensitivity at zero degrees equal to the sensitivity with no phase shifter connected. This demonstrates that the optimum phase shift will in general depend on the resolution of the tandem analyzer. Nevertheless if a fixed phase shift of about −10° greater than that giving sensitivity equal to that with no phase shifter installed was used, good transmission would be obtained at both $R_{1/2}$=750 and $R_{1/2}$=1500.

Figure 26:
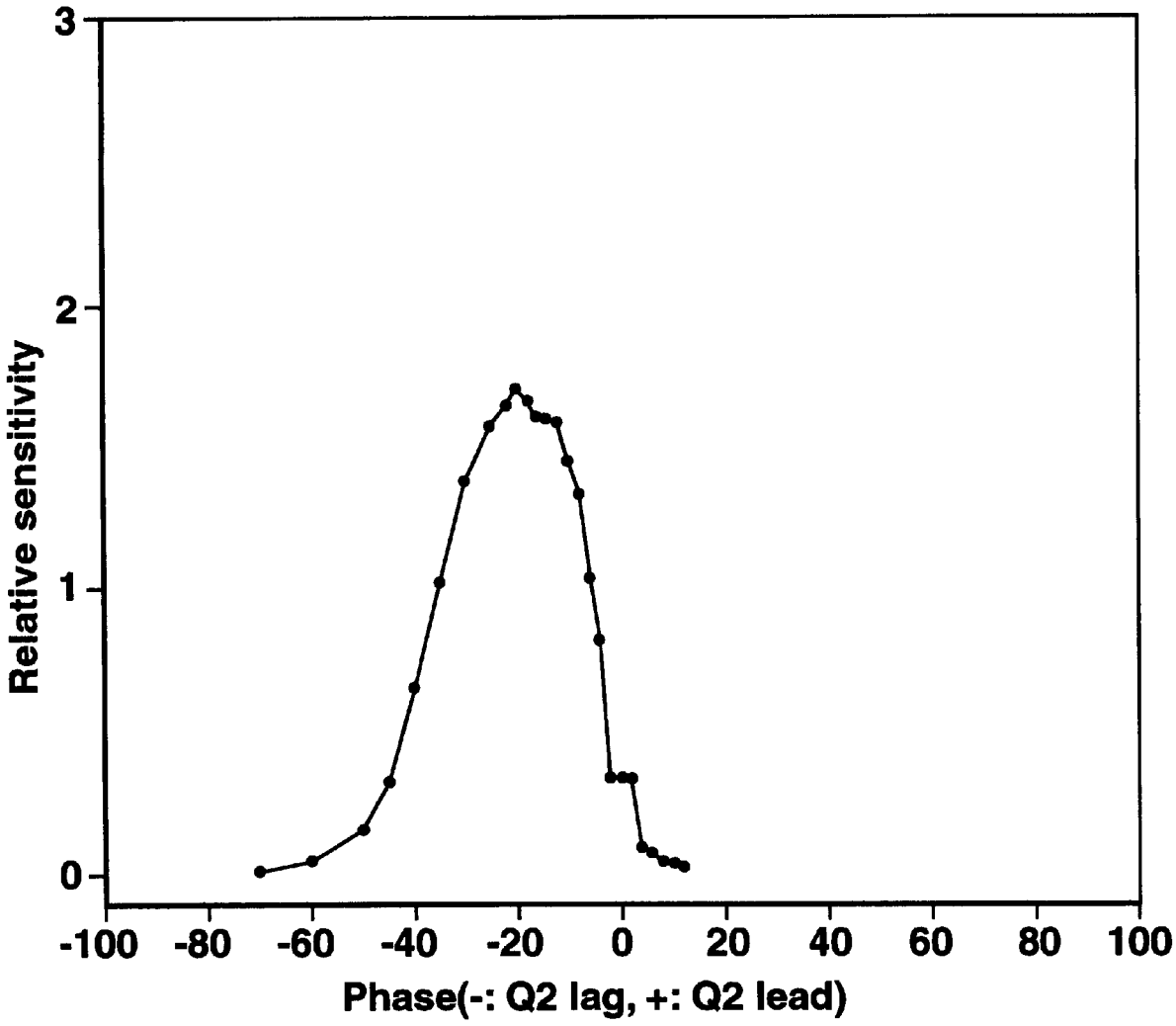
FIG. 26 is a graph showing the variation of relative sensitivity with phase shift between two quadrupoles, for a different mode of operation.

FIG. 26 shows a curve of transmission vs. phase shift for the case where Q1 is operated at the lower tip of the third region and Q2 at the upper tip (the opposite way around from FIGS. 24 and 25). The resolution of the tandem analyzer in this case was $R_{1/2}$=200 for $Co^+$ ions at m/e=59. Again, there is a narrow range of phases near −20°, before correction or adjustment, for which the transmission is maximum and the optimum phase gives a transmission about 1.6 times greater than that with no phase shift.

Figure 27:
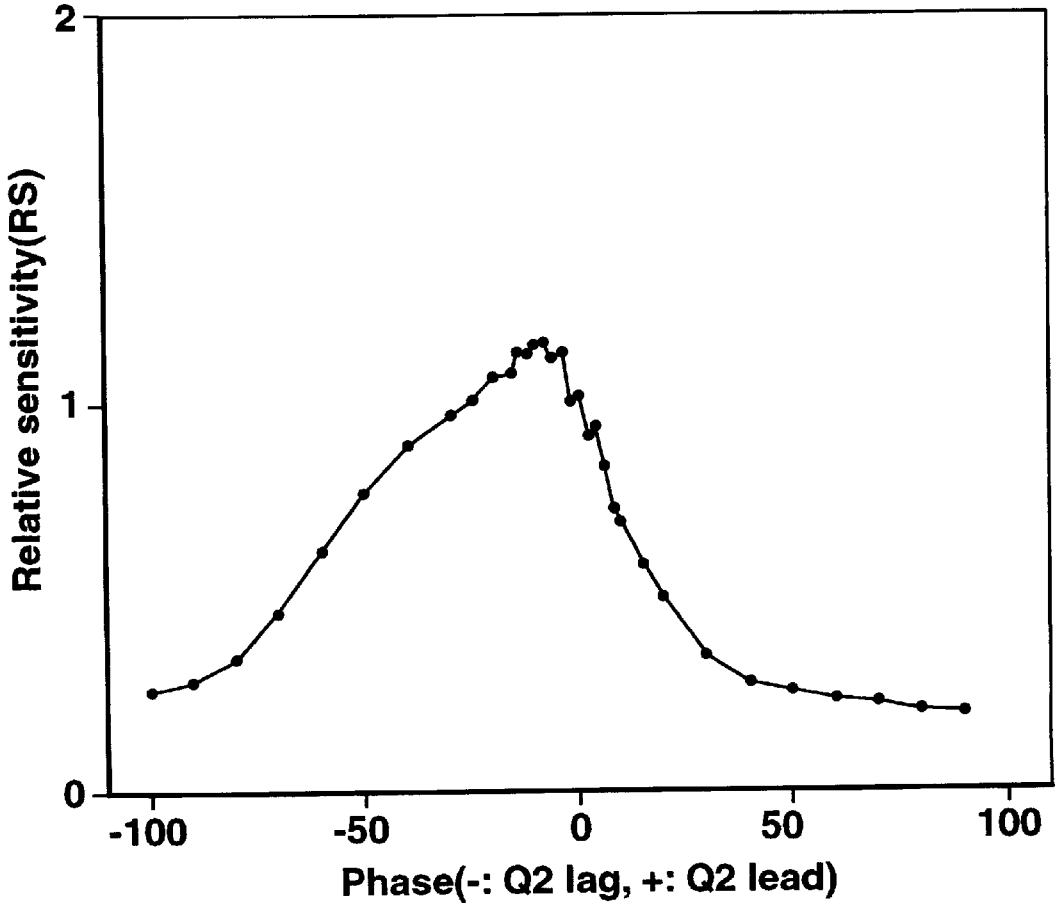
FIG. 27 is a graph showing the variation of relative sensitivity with phase shift between two quadrupoles, for operation in the first stability region.

FIG. 27 shows transmission vs. phase shift for the case where Q1 and Q2 were operated in the first stability region. A mass offset between Q1 and Q2 of +0.7 m/e was used to give $R_{1/2}$=300 for the tandem analyzer for $Co^+$ ions at m/e=59. Again there is an optimum phase shift near −8°, again after correction to unit relative sensitivity at zero phase shift, although in this case the curve is somewhat broader than those of FIGS. 24–26.

FIGS. 24–27 demonstrate that phase locking the quadrupoles with a controlled phase shift can increase the transmission dramatically. If for example the quadrupoles were operated at different frequencies, they would average over all phases between −180° and +180°. For the case shown in FIG. 24, this would give an average transmission of only about 7% of that obtained by phase locking the quadrupoles with the optimum phase shift. FIGS. 24–27 also demonstrate that small phase shifts can make large differences in the ion transmission. If the two quadrupoles were operated at the same frequency but not phase locked, the phase between them would change in an uncontrolled manner and the sensitivity of the device would also change in an uncontrolled manner.

The optimum phase shift will likely depend on the number of RF cycles that the ions spend in the fringing field between the two quadrupoles. This will vary with the ion energy, the RF frequency, and the spacing between the quadrupoles. The optimum phase shift will also depend on the resolution settings of the individual quadrupoles and the stability regions in which the quadrupoles are operated. It is important to note that changing the phase shift between the quadrupoles did not change the resolution of the tandem mass analyzer, only the sensitivity. Thus, if a tandem mass analyzer were built without phase locking so that the phase varied between the quadrupoles, good resolution could be obtained but with much lower sensitivity.

The invention also allows good peak shape to be obtained with quadrupoles operated under conditions that give poor peak shape from each. Here poor peak shape means a peak shape with structure or "dips". Peak structure can have two sources; mechanical imperfections of the quadrupole and ion collection effects at the exit of the quadrupole. Mechanical imperfections can couple the x and y motion in the quadrupole and lead to so-called non-linear resonances. These resonances cause ions to become unstable and strike the rods under conditions where they would otherwise have stable trajectories. Nonlinear resonances occur only for selected a and q values. Thus as the quadrupole scans over a peak it may reach a and q values that give a nonlinear resonance and the transmission will decrease, giving a "dip" on the peak. Peak structure can also be caused by ion collection effects. If ion trajectories are such that ions leave the quadrupole near the rods, they will experience strong defocusing fields and may not reach the detector. Conversely if the trajectories are such that ions are near the center of the rods at the quadrupole exit they will not be defocused and the transmission to the detector will be greater. The position of the ions at the quadrupole exit will depend on the fundamental frequencies of ion motion and the ion energies. As the quadrupole scans over a peak the frequencies of motion change and ions may alternately be close the centre of the quadrupole or near the quadrupole rods. Thus structure can be introduced to the peak shape. These effects are particularly severe for the higher stability regions because the frequencies of ion motion vary to a greater extent across a peak and also because the defocusing fields at the quadrupole exit are stronger, giving more pronounced structure.

Figure 28A:
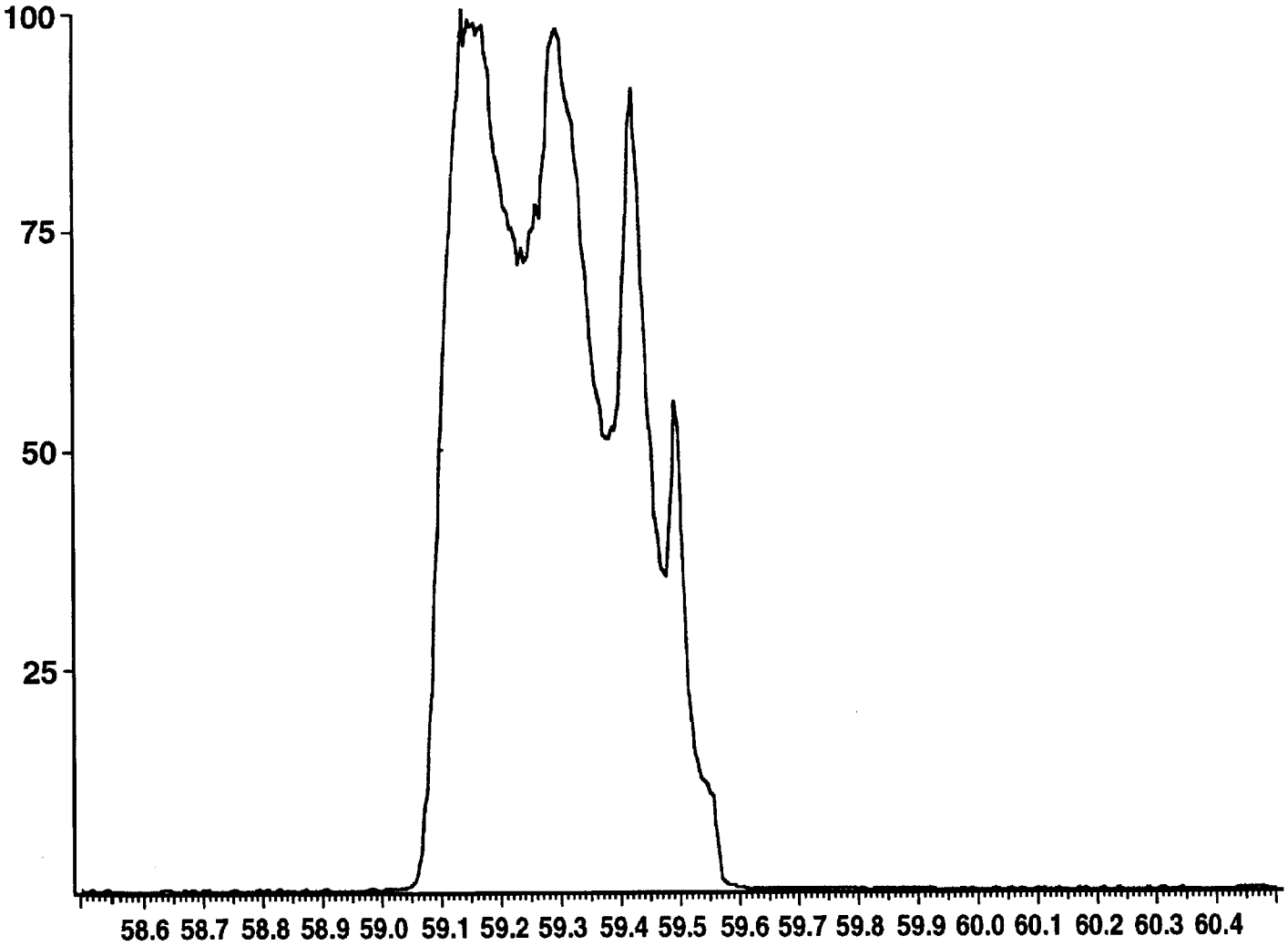
FIGS. 28*a* and 28*b* show peak shapes obtained with operation of two quadrupoles at the upper and lower tips of the third stability region, showing the effect of mechanical imperfections and ion collection effects.
Figure 28B:
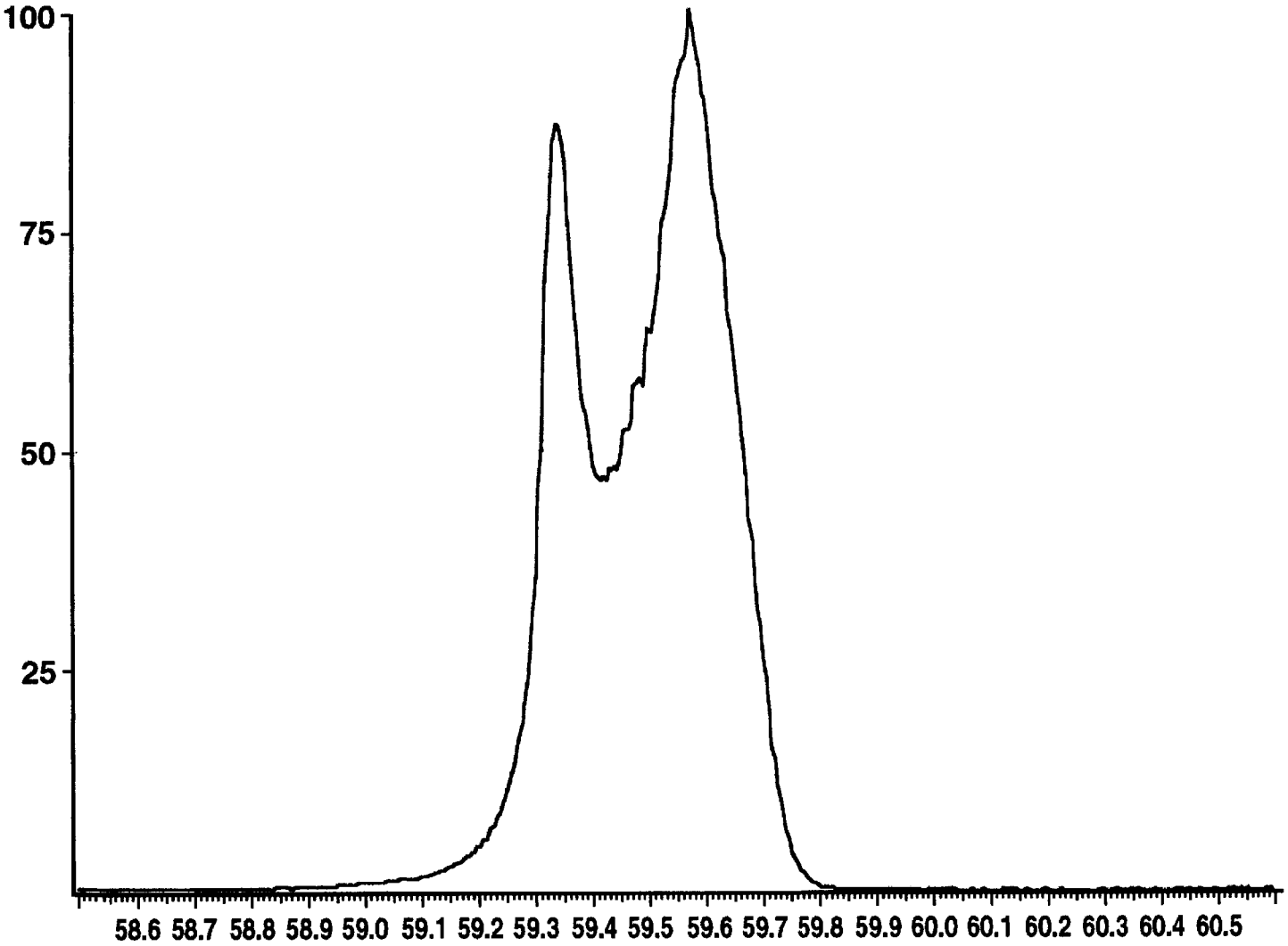
Figure 28C:
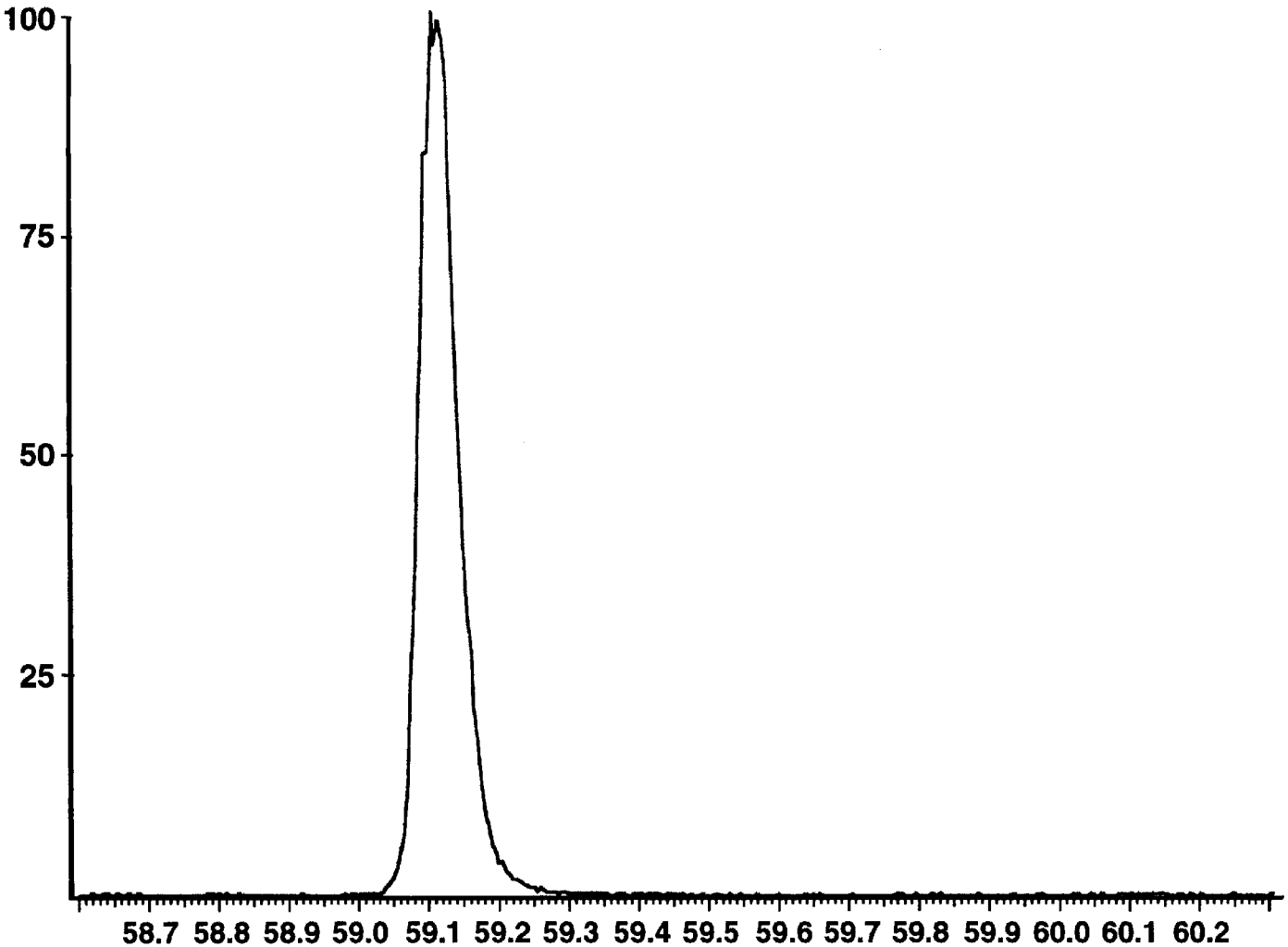
FIG. 28*c* shows the peak shape produced when the two quadrupoles are scanned together, with the second quadrupole scanned 0.6 m/e higher than the first quadrupole.

The effects of peak structure from the individual quadrupoles and from the tandem analyzer are illustrated in FIGS. 28*a, b* and *c*. FIG. 28*a* shows the peak shape obtained with Q1 operated in the third stability region at the upper tip. There is considerable structure on the peak. This structure is caused by field imperfections of the quadrupole, such as would be caused by pole misalignment of a rod set with low mechanical precision or by ion collection effects at the detector. FIG. 28*b* shows the peak shape obtained with Q2 operated at the lower tip of the third stability region. There is a split peak, again because of field imperfections of the quadrupole or ion collection effects at the detector. If however the peaks are overlapped with Q2 scanned 0.6 m/e higher than Q1, the peak shape of FIG. 28*c* is produced. This peak is much smoother and of much higher quality than the peaks that can be produced by either Q1 or Q2. Thus, it is an advantage of the invention that it can be used to overcome peak shape problems caused by low quality rods or ion collection effects. Structure similar to that of FIGS. 28*a,b* can be seen in FIGS. 4 and 5 although the structure is somewhat less pronounced. For the case where structure is caused by mechanical imperfections, it will still be possible to obtain good peak shape from the tandem mass analyzer. Thus another advantage of the invention is that rod sets of lower mechanical precision and thus lower cost can be used to produce spectra with good resolution and good peak shapes.

Figure 29A:
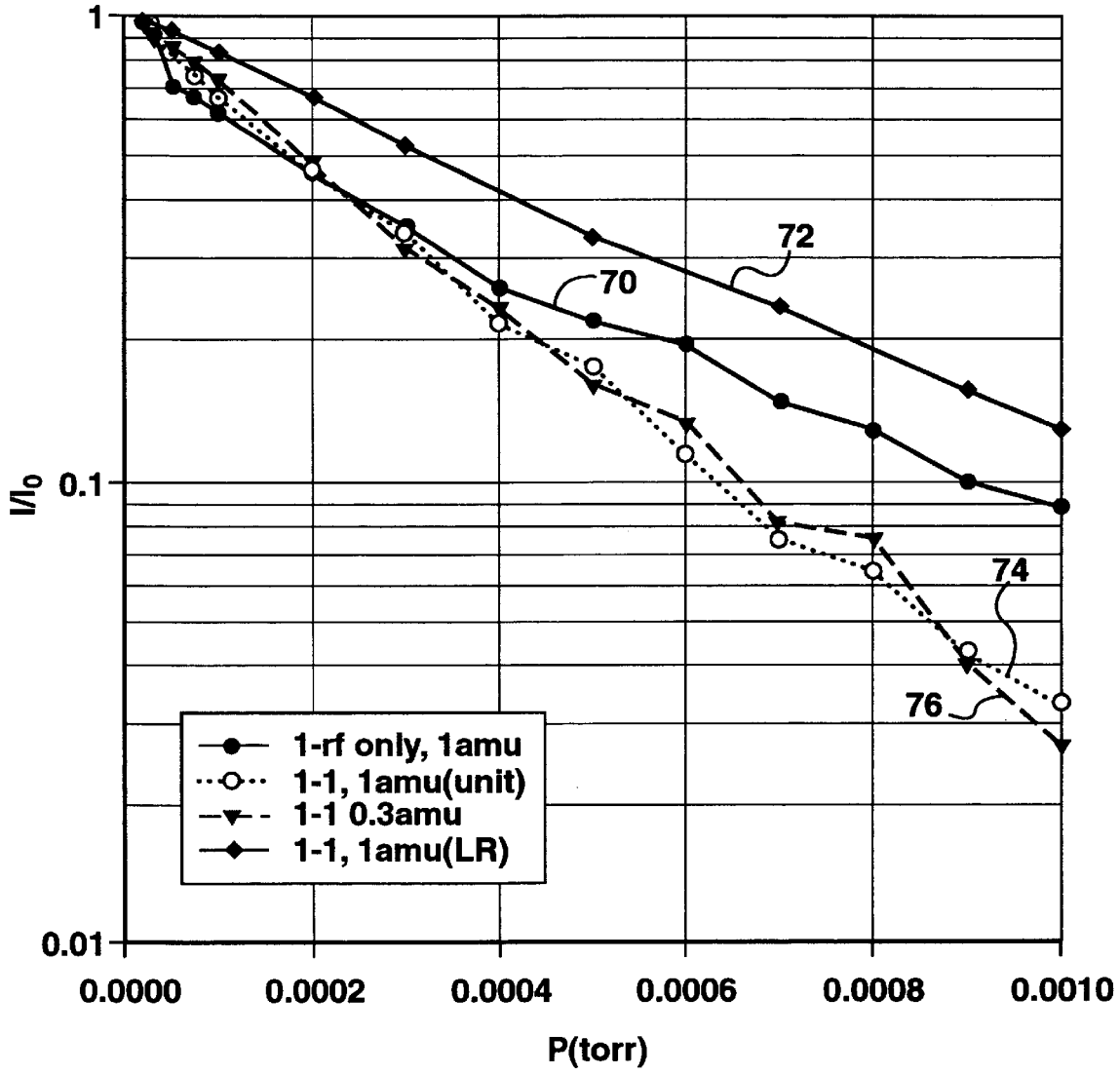
FIGS. 29*a* and 29*b* are graphs showing variation of intensity with pressure and FIG. 30 is a graph showing the variation of transmission with resolution where both quadrupoles are operated in the second stability region.
Figure 29B:
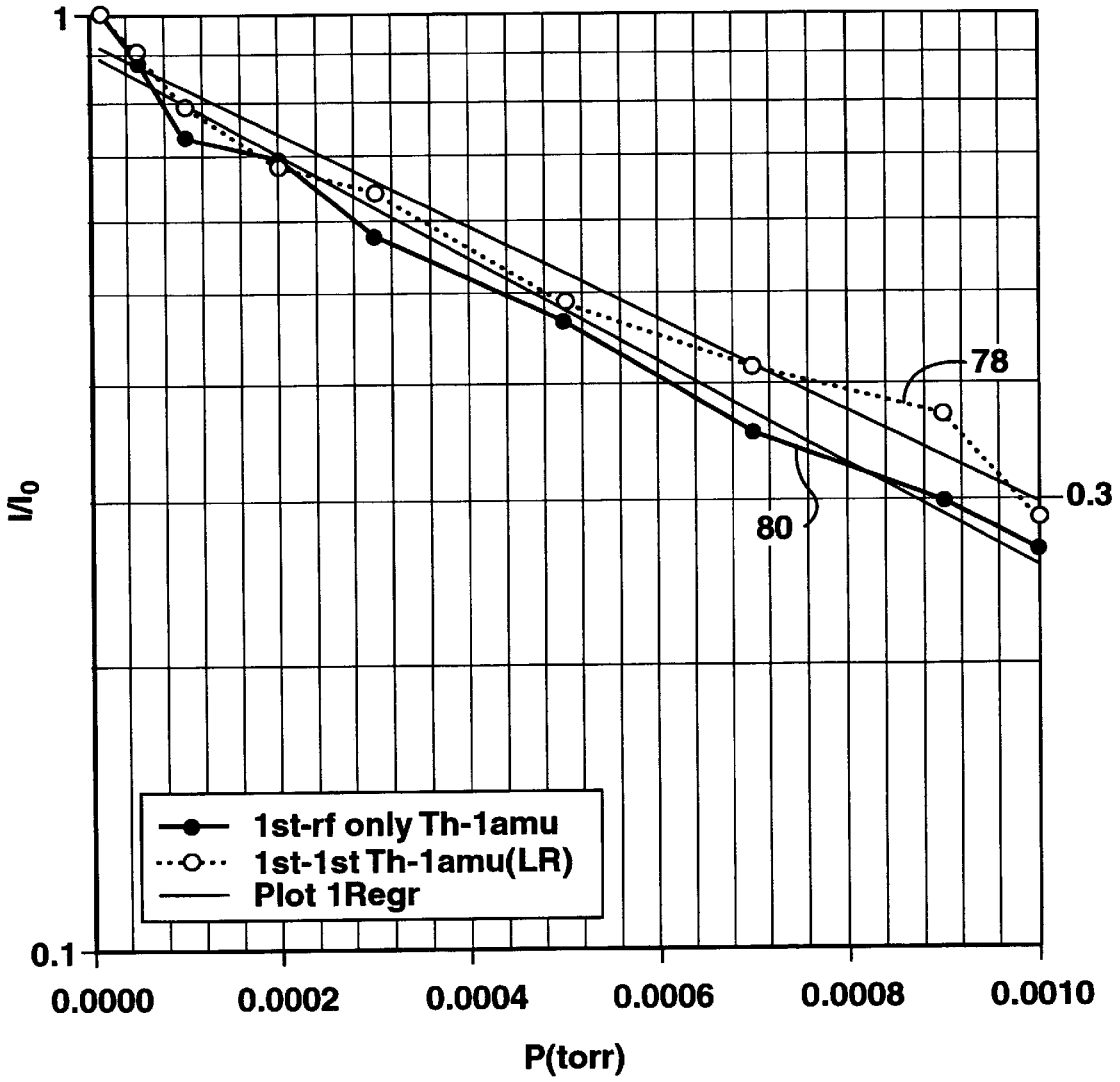

Reference will now be made to FIGS. 29*a* and 29*b*, which show variation of intensity with pressure within the quadrupole. These tests were carried out, because it is desirable to operate mass analyzing quadrupoles at high pressure and it is an advantage of the present invention that the device can be operated at relatively high pressure. In a low pressure quadrupole, the vacuum system can be the most expensive subassembly for the quadrupole.

Currently, many quadrupoles require pressures as low as $2\times10^{-5}$ Torr. This imposes significant demands in terms of pumping requirements and operational expenses. For many applications, it would be highly desirable to provide a quadrupole that could operate at higher pressures, so that lower speed, lower cost pumps can be used. Such pumps are both cheaper for initial manufacture and cheaper to operate.

Conventionally, operation at higher pressures causes collisions between ions and neutral background gas. These collisions cause sensitivity losses and reduction in resolution. Ions which collide with gas molecules can be scattered out of the quadrupole and this reduces sensitivity. The degree of scattering will depend upon the relative masses of the ions and the gas and the gas pressure.

Commonly, the ion beam intensity that is transmitted, I, is given by the following formula:

$$\frac{I}{I_0} = e^{-n\sigma i} \tag{5}$$

where $I_0$ is the intensity without any gas being present (i.e. without any losses), and n is the number of density of the gas (molecules $cm^{-3}$), σ is the "scattering loss cross-section" in $cm^2$, and l is the length of the mass analyzer in cm.

To minimize scattering losses, the scattering loss cross-section, σ, for a mass analyzer should be as small as possible. A small value of σ is indicative of a mass analyzer which can tolerate collisions without loss of ions, which in turn means that it can be operated at relatively high pressures.

Accordingly, various measurements were made of the intensity at different pressures, to determine the scattering loss cross-sections for a tandem or dual quadrupole analyzer in accordance with the present invention and a conventional mass analyzer or quadrupole operated in the first stability region.

FIG. 29*a* shows at 70 the characteristics of a conventional quadrupole operated in the first stability region at unit resolution, that is with the resolution set to give a peak having a width of 1 mass unit or AMU. This quadrupole was 20 cm long, and the tests were scanned with $Co^+$ ions with m/e=59, and using nitrogen gas.

The curve at 72 shows the operation of two quadrupoles operated at very low resolution, as detailed above, to give overall unit resolution as for curve 70.

The two quadrupoles had similar dimensions, in terms of rod diameter and spacing of the rods as for the tests detailed above, and with rod lengths of 20 cm, i.e. the same as the conventional quadrupole, so that the overall rod length for the two quadrupoles was 40 cm, or twice the length the single quadrupole used in the first test.

Additional curves 74 and 76 are included, to show operation of the tandem or dual quadrupole, with both quadrupoles operated at unit resolution and operated with no mass shift to give unit resolution (curve 74) and the two quadrupoles operated at unit resolution and mass shifted to give a 0.3 AMU wide peak.

It can be seen that similar decreases in intensity are seen for the tandem and single mass analyzers, as shown for curves 70 and 72. However, the tandem analyzer was 40 cm long and the single analyzer was 20 cm long. Fitting the data of FIG. 29*a* to equation (5) above gives a scattering loss cross-section of $36.5\times10^{-16}$ $cm^2$ (36.5 $Å^2$) for the single analyzer or quadrupole and $15.5\times10^{-16}$ $cm^2$ (15.5 $Å^2$) for the tandem analyzer. Thus, the loss coefficient for the tandem analyzer is less than half of that for the single quadrupole.

While the tandem analyzer was operated with two quadrupoles each having a length of 20 cm, this length is believed to be unnecessary. Thus, it is believed that it would be possible to half the length of the rods and still get much the same performance, in particular, to obtain much the same scattering loss cross-section.

FIG. 29*b* shows a similar plot with thorium, Th+, ions having a mass of 232. These were used, to show the characteristics with heavy ions, since quadrupole mass spectrometers were often used to analyze relatively heavy ions from various biological sources. Again, nitrogen gas was used. Curve 78 shows a characteristic with a tandem quadrupole analyzer in accordance with the present invention. Again, this is with both quadrupoles operating in the first stability region and at a very low resolution, with peaks having approximately a ten mass unit width, but mass shifted to give unit resolution. Curve 80 shows the characteristics of a single mass analyzer operated at unit resolution in the first stability region. Also shown in FIG. 29*b* are straight lines showing the best fit to the data points.

While the overall lost intensity is similar for the two cases, again the dual tandem analyzer had twice the effective length. Consequently, the calculated loss cross sections are $9\times10^{-16}$ $cm^2$ (9 $Å^2$), for tandem or dual analyzer, and $18\times10^{-16}$ $cm^2$ (18 $Å^2$) for the single mass analyzer.

Accordingly, if a single mass analyzer is used with a total length of 20 cm, and the scattering loss cross-section signal was maintained at 9 $Å^2$, the transmitted intensity of the ion beam would be:

$$\frac{I}{I_0} = 0.55 \tag{6}$$

This is about twice what it would be for the single analyzer operating with a loss cross-section of 18 $Å^2$. Accordingly, it can be seen that the method of the present invention gives an improved loss coefficient while operating the tandem analyzer with each quadrupole having a low resolution.

It is believed that if the resolution of the individual quadrupoles was decreased even further, one would still obtain good results, and possibly even a lower loss coefficient, but at the time the electronics were not available to permit such tests to be carried out.

The invention has been described for operation of the two quadrupoles of the tandem mass analyzer in the third stability region in the order upper tip-lower tip and lower tip-upper tip and also for operation of the quadrupoles both in the first region. However, any stability region or combination of stability regions may be used, depending on the particular application.

Figure 30:
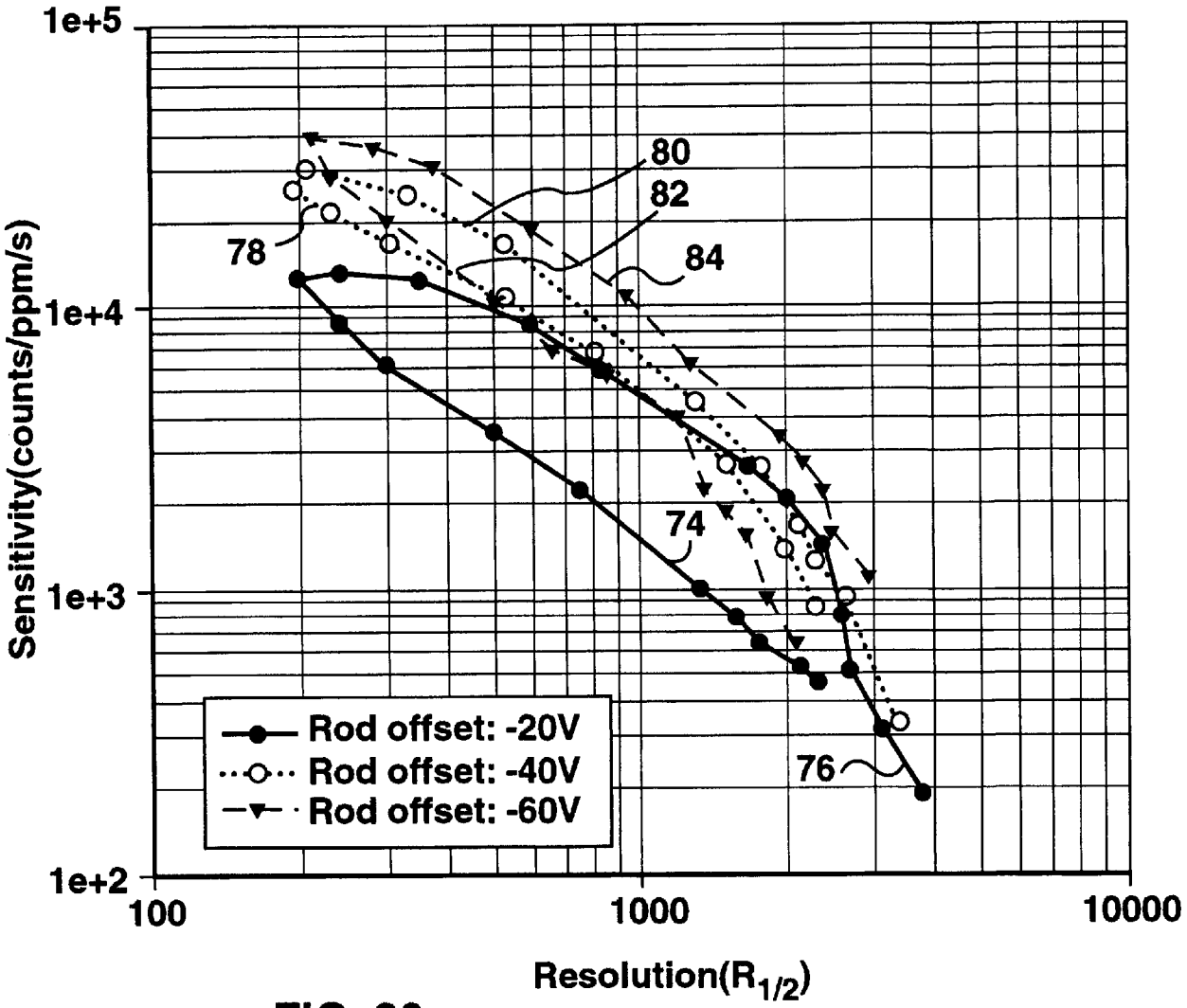

FIG. 30 for example shows transmission resolution curves for the tandem mass analyzer with both Q1 and Q2 operated in the second stability region. $Co^+$ ions at m/e 59 were used for these tests. For these curves each quadrupole was operated with no DC voltage between the poles (a=0) so that the resolution, $R_{1/2}$, of each operated alone was about 150. The resolution of the tandem analyzer was then increased by introducing mass shifts between Q1 and Q2 of −0.6 to +0.3 m/e. It can be seen that this increased the resolution from about 200 to as high as 3700. The highest transmission was obtained with a mass shift of −0.2 m/e. The curves 74, 76 were obtained with an ion energy in the quadrupole of about 23 eV, the curves 78, 80 with 43 eV and the curves 82, 84 with an ion energy of 63 eV.

The present invention provides the possibility of operating each quadrupole at very low resolution, and correspondingly with a higher acceptance. Such high acceptance can make up for other losses. Thus, one could operate two quadrupoles in tandem, at relatively high pressure and higher acceptance. By suitable alignment of the peak profiles, a combined high resolution output can be obtained. For example, it might be possible to operate the quadrupoles at a pressure of $2\times10^{31\ 4}$ Torr, i.e. a factor of 10 higher than is conventional or common.

It is expected that the present invention also enables high resolution to be obtained with relatively imperfect rod sets. In other words, it may be possible to manufacture rod sets to relatively poor manufacturing tolerances, which can considerably reduce costs. Any imperfections that this causes can be overcome by operation in accordance with the present invention. This again enables cheaper and simpler quadrupoles to be constructed and made.

We claim:

1. A method of operating a quadrupole spectrometer apparatus including a first quadrupole rod set and a second quadrupole rod set, the method comprising:

(1) applying RF and DC voltages to the first and second quadrupole rod sets, to scan the first and second quadrupole rod sets in selected stability regions, and operating both the first and second quadrupole in a resolving mode for ions with the same mass to charge ratio;

(2) generating a stream of ions and passing the stream of ions through the first quadrupole rod set and subsequently the second quadrupole rod set, and detecting ions exiting the second quadrupole rod set;

(3) obtaining a peak shape from the ions exiting the second quadrupole rod set, the peak shape having at least one of higher resolution than the resolution of either one of the first and second quadrupole rod sets and less peak tailing than either one of the first and second rod sets.

2. A method as claimed in claim 1, which includes mounting the first and second quadrupoles close to one another along a common axis.

3. A method as claimed in claim 2, which comprises providing quadrupoles having the same inscribed circle diameter with a radius of $r_0$, wherein the method comprises mounting the quadrupoles less than or equal to $r_0$ apart, with no intervening lens.

4. A method as claimed in claim 3, which comprises mounting the first and second quadrupole rod sets a distance less than or equal to 0.3 $r_0$ apart.

5. A method as claimed in claim 1, which includes adjusting the voltages applied to the first and second quadrupole rod sets, to provide a mass shift between the first and second quadrupoles, to improve the resolution.

6. A method as claimed in claim 1, wherein the first and second quadrupoles are operated at the same frequency.

7. A method as claimed in claim 1, which includes operating the first and second quadrupole rod sets at the same frequency and locking the phase of the first and second quadrupoles relative to one another.

8. A method as claimed in claim 7, which comprises providing a fixed phase shift between the first and second quadrupoles.

9. A method as claimed in claim 8, which comprises providing a phase shift of in the range 10–20°, with the signal provided to the second quadrupole rod set lagging behind the signal supplied to the first quadrupole rod set.

10. A method as claimed in claim 1, which comprises operating the first and second quadrupole rod sets in the third stability region, with one of the quadrupole rod sets operating at the upper tip of the third stability region and the other of the quadrupole rod sets operating at the lower tip of the third stability region.

11. A method as claimed in claim 1, which comprises operating both of the first and second quadrupole rod sets in the first stability region.

12. A method as claimed in claim 1, which comprises operating the first and second quadrupole rod sets in different stability regions.

13. A method of operating a mass spectrometer comprising a plurality of separate quadrupole rod sets, the method comprising:

(1) providing desired RF and DC voltages to each quadrupole rod set and providing the same frequency of RF voltage to each quadrupole rod set;

(2) phase locking each quadrupole rod set with each adjacent quadrupole rod set; and (3) for each quadrupole rod set downstream from a first quadrupole rod set, providing a phase shift relative to an immediate upstream quadrupole rod set.

14. A mass spectrometry apparatus comprising:

two aligned quadrupole rod sets;

voltage generation means for generating a radio frequency signal for each rod set and connected to the two quadrupole rod sets;

an oscillator; and a phase shifter connected to the oscillator and having outputs connected to the voltage generation means for the quadrupole rod sets, the oscillator generating a signal determining the frequency of the radio frequency signals supplied to each rod set, and the phase shifter being adjustable to enable the relative phase between the radio frequency signals applied to the two rod sets to be adjusted.

15. A method of operating a spectrometer apparatus including a first Wien filter stage and a second Wien filter stage, the method comprising:

(1) applying electric fields and magnetic fields in the first and second stages, to scan the first and second Wien filter stages, whereby both the first and second spectrometer stages operate in a resolving mode for ions with the same mass to charge ratio;

(2) generating a stream of ions and passing the stream of ions through the first Wien filter stage and subsequently the second Wien filter stage, and detecting ions exiting the second Wien filter stage;

(3) obtaining a peak shape from the ions exiting the second Wien filter stage, the peak shape having at least one of higher resolution than the resolution of either one of the first and second Wien filter stages sets and less peak tailing than either one of the first and second Wien filter stages.

16. A method as claimed in claim 15, which includes mounting the first and second Wien filter stages close to one another along a common axis.

17. A method as claimed in claim 15, which comprises providing a mass shift between the Wien filter stages.

18. A method of operating a spectrometer apparatus including a first spectrometer stage and a second spectrometer stage, the method comprising:

(1) applying at least one of electric fields and magnetic fields in the first and second spectrometer stages, to scan the first and second spectrometer stages;

(2) generating a stream of ions and passing the stream of ions through the first spectrometer stage and subsequently through the second spectrometer stage, and detecting ions exiting the second spectrometer stage;

(3) obtaining a peak shape from the ions exiting the second spectrometer stage, wherein the first and second spectrometer stages are operated in a resolving mode for a selected mass, wherein a mass shift is provided between the selected masses of the first and second spectrometer stages and an overlap is provided between the peak shapes of the first and second spectrometer stages, whereby the peak shape obtained at the exit of the second spectrometer stage has at least one of higher resolution than the resolution of either one of the first and second spectrometer stage sets and less peak tailing than either one of the first and second spectrometer stages.

19. A method as claimed in claim 18, which comprises providing each of the first and second mass spectrometer stages as one of a magnetic mass analyzer, a Wien filter and a quadrupole mass spectrometer.

20. A method as claimed in claim 19, which comprises providing a magnetic mass analyzer as one of the mass spectrometer stages and a Wien filter as the other mass spectrometer stage.

* * * * *